US011052008B2

(12) United States Patent
Lim et al.

(10) Patent No.: US 11,052,008 B2
(45) **Date of Patent: *Jul. 6, 2021**

(54) SURGICAL FRAME AND METHOD FOR USE THEREOF FACILITATING PATIENT TRANSFER

(71) Applicant: Warsaw Orthopedic, Inc., Warsaw, IN (US)

(72) Inventors: Roy K. Lim, Germantown, TN (US); Matthew M. Morrison, Cordova, TN (US); Thomas V. McGahan, Germantown, TN (US); Richard A. Hynes, Melbourne Beach, FL (US)

(73) Assignee: WARSAW ORTHOPEDIC, INC., Warsaw, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/986,911

(22) Filed: Aug. 6, 2020

(65) Prior Publication Data

US 2020/0360214 A1 Nov. 19, 2020

Related U.S. Application Data

(63) Continuation of application No. 15/638,802, filed on Jun. 30, 2017, now Pat. No. 10,874,570.

(51) Int. Cl.
*A61G 13/04* (2006.01)
*A61G 13/08* (2006.01)
(Continued)

(52) U.S. Cl.
CPC ..... *A61G 13/04* (2013.01); *A61G 7/008* (2013.01); *A61G 7/015* (2013.01); *A61G 13/08* (2013.01); *A61G 13/12* (2013.01)

(58) Field of Classification Search
CPC ..... A61G 7/001; A61G 7/002; A61G 7/005; A61G 7/008; A61G 7/012; A61G 7/015;
(Continued)

(56) References Cited

U.S. PATENT DOCUMENTS 2,691,979 A 10/1954 Watson
3,060,925 A 10/1962 Honsaker et al.
(Continued)

FOREIGN PATENT DOCUMENTS

CN 2100875 U 4/1992
CN 201185976 1/2009
(Continued)

OTHER PUBLICATIONS

Examination Report dated Apr. 8 2020 from Australian Application No. 2016308175.
(Continued)

*Primary Examiner* — Robert G Santos

(57) ABSTRACT

A surgical frame and a method for use thereof facilitates transfer of a patient from and to a surgical table/gurney. The surgical table includes a main beam positionable such that a surgical table/gurney with patient laying thereon can be positioned under the main beam. The main beam includes componentry for supporting a patent thereon, and the main beam can be rotated, raised/lowered, and tilted upwardly/downwardly to afford positioning and repositioning of the main beam to facilitate transfer of a patient from the surgical table/gurney to the main beam and transfer from the main beam to the surgical table/gurney.

20 Claims, 40 Drawing Sheets

(51) Int. Cl.
*A61G 7/008* (2006.01)
*A61G 7/015* (2006.01)
*A61G 13/12* (2006.01)

(58) Field of Classification Search
CPC ..... A61G 7/018; A61G 13/02; A61G 13/04; A61G 13/06; A61G 13/08; A61G 7/075; A61G 13/12; A61G 13/1205; A61G 13/121; A61G 13/122; A61G 13/1225; A61G 13/123; A61G 13/1235; A61G 13/124; A61G 13/1245; A61G 13/125; A61G 13/1255
USPC ..... 5/607–609, 600, 621–624
See application file for complete search history.

(56) References Cited

U.S. PATENT DOCUMENTS 3,227,440 A 1/1966 Scott
3,293,667 A 12/1966 Ohrberg
3,306,287 A 2/1967 Arp
3,389,702 A 6/1968 Kennedy
3,828,377 A 8/1974 Fary, Sr.
4,029,089 A 6/1977 Mulhlland
4,655,200 A 4/1987 Knight
4,705,026 A 11/1987 Chaussy
4,866,796 A 9/1989 Robinson
4,872,656 A 10/1989 Brendgord
4,901,384 A 2/1990 Eary
4,915,101 A 4/1990 Cuccia
5,009,407 A 4/1991 Watanabe
5,088,706 A 2/1992 Jackson
5,103,511 A 4/1992 Sequin
5,131,106 A 7/1992 Jackson
5,390,383 A 2/1995 Carn
5,410,769 A 5/1995 Waterman
5,444,882 A 8/1995 Andrews
5,613,254 A 3/1997 Clayman
5,642,302 A 6/1997 Dumont
5,860,899 A 1/1999 Rassman
5,991,651 A 11/1999 LaBarbera
6,003,176 A 12/1999 Wasley
6,076,525 A 6/2000 Hoffman
6,112,349 A 9/2000 Connolly
6,154,901 A 12/2000 Carr
6,260,220 B1 7/2001 Lamb
6,295,671 B1 10/2001 Reesby et al.
6,311,349 B1 11/2001 Kazakia
6,367,104 B1 4/2002 Fallbo, Sr. et al.
6,378,149 B1 4/2002 Sanders et al.
6,516,483 B1 2/2003 VanSteenburg
6,566,833 B2 5/2003 Bartlett
6,615,430 B2 9/2003 Heimbrock
6,671,905 B2 1/2004 Bartlett et al.
6,681,423 B2 1/2004 Zachrisson
6,701,554 B2 3/2004 Heimbrock
6,701,558 B2 3/2004 VanSteenburg
6,715,169 B2 4/2004 Niederkrom
6,728,983 B2 5/2004 Bartlett et al.
6,732,390 B2 5/2004 Krywiczanin
6,739,006 B2 5/2004 Borders et al.
6,820,621 B2 11/2004 DeMayo
6,874,181 B1 4/2005 Connolly et al.
6,934,986 B2 8/2005 Krywiczanin et al.
6,941,951 B2 9/2005 Hubert et al.
6,966,081 B1 11/2005 Sharps
7,100,225 B1 9/2006 Bailey
7,189,214 B1 3/2007 Saunders
7,219,379 B2 5/2007 Krywiczanin et al.
7,234,180 B2 6/2007 Horton et al.
7,290,302 B2 11/2007 Sharps
7,426,930 B1 9/2008 Bailey
7,472,440 B2 1/2009 Bartlett et al.
7,484,253 B1 2/2009 Coppens
7,496,980 B2 3/2009 Sharps
7,600,281 B2 10/2009 Skripps
7,669,262 B2 3/2010 Skripps
7,739,762 B2 6/2010 Lamb et al.
7,882,583 B2 2/2011 Skripps
8,118,029 B2 2/2012 Gneiting et al.
8,286,283 B2 10/2012 Copeland et al.
8,286,637 B2 10/2012 Kaska
8,413,660 B2 4/2013 Weinstein et al.
8,439,948 B1 5/2013 King
8,443,473 B2 5/2013 Maxwell
8,584,281 B2 11/2013 Diel et al.
8,635,725 B2 1/2014 Tannoury et al.
9,072,646 B2 7/2015 Skripps et al.
9,265,680 B2 2/2016 Sharps
9,339,430 B2 5/2016 Jackson et al.
9,358,170 B2 6/2016 Jackson
9,414,982 B2 8/2016 Jackson
9,498,397 B2 11/2016 Hight et al.
9,522,078 B2 12/2016 Pizzini
9,554,959 B2 1/2017 Carn
9,655,793 B2 5/2017 Hertz
9,700,476 B2 7/2017 Hoel et al.
9,713,562 B2 7/2017 Perlman et al.
9,744,089 B2 8/2017 Jackson
9,937,006 B2 4/2018 Skripps et al.
9,993,380 B2 6/2018 Jackson
10,136,863 B2 11/2018 Kaiser et al.
10,314,758 B2 6/2019 Dolliver et al.
10,342,722 B2 7/2019 Garrido
10,406,054 B1 9/2019 Scholl et al.
10,426,684 B2 10/2019 Dubois et al.
10,543,142 B2 1/2020 Lim et al.
10,548,796 B2 2/2020 Lim et al.
10,576,006 B2 3/2020 Lim et al.
10,695,252 B2 6/2020 Jackson
10,722,413 B2 * 7/2020 Lim ..... A61G 13/122
10,729,607 B2 8/2020 Jackson
10,751,240 B2 * 8/2020 Lim ..... A61G 13/122
10,835,438 B2 * 11/2020 Jackson ..... A61G 13/0036
10,835,439 B2 * 11/2020 Lim ..... A61B 34/30
10,849,809 B2 * 12/2020 Lim ..... A61G 7/015
10,874,570 B2 * 12/2020 Lim ..... A61G 13/08
10,881,570 B2 * 1/2021 Lim ..... A61G 13/121
10,888,484 B2 * 1/2021 Lim ..... A61G 13/0036
10,893,996 B2 * 1/2021 Lim ..... A61G 13/08
10,898,401 B2 * 1/2021 Lim ..... A61B 34/30
10,900,448 B2 * 1/2021 Lim ..... F02M 31/0825
2002/0138905 A1 10/2002 Barltett et al.
2002/0138906 A1 10/2002 Barltett et al.
2002/0157186 A1 10/2002 VanSteenburg
2003/0140419 A1 7/2003 Barltett et al.
2003/0140420 A1 7/2003 Niederkrom
2003/0145382 A1 8/2003 Krywiczanin
2003/0178027 A1 9/2003 DeMayo et al.
2004/0010849 A1 1/2004 Krywiczanin et al.
2004/0133983 A1 7/2004 Newkirk
2005/0181917 A1 8/2005 Dayal
2006/0037141 A1 2/2006 Krywiczanin et al.
2006/0123546 A1 6/2006 Horton
2006/0162076 A1 7/2006 Bartlett et al.
2006/0162084 A1 7/2006 Mezue
2008/0034502 A1 2/2008 Copeland et al.
2008/0134434 A1 6/2008 Celauro
2008/0222811 A1 9/2008 Gilbert et al.
2009/0139030 A1 6/2009 Yang
2010/0037397 A1 2/2010 Wood
2010/0192300 A1 8/2010 Tannoury
2010/0293719 A1 11/2010 Klemm et al.
2011/0099716 A1 5/2011 Jackson
2012/0103344 A1 5/2012 Hunter
2012/0144589 A1 6/2012 Skripps et al.
2012/0255122 A1 10/2012 Diel et al.
2013/0111666 A1 5/2013 Jackson
2013/0191994 A1 8/2013 Bellows et al.
2013/0283526 A1 10/2013 Gagliardi
2013/0307298 A1 11/2013 Meiki
2014/0059773 A1 3/2014 Carn
2014/0068861 A1 3/2014 Jackson
2014/0109316 A1 4/2014 Jackson et al.

(56) References Cited

U.S. PATENT DOCUMENTS

| | | | | |
|---|---|---|---|---|
| 2014/0137327 | A1 | 5/2014 | Tannoury et al. | |
| 2015/0044956 | A1 | 2/2015 | Hacker | |
| 2015/0245971 | A1 | 9/2015 | Bernardoni et al. | |
| 2015/0272681 | A1 | 10/2015 | Skripps et al. | |
| 2016/0000621 | A1 | 1/2016 | Jackson | |
| 2016/0047394 | A1 | 2/2016 | Lee | |
| 2016/0081582 | A1 | 3/2016 | Rapoport | |
| 2016/0089287 | A1 | 3/2016 | Buerstner | |
| 2016/0193099 | A1 | 7/2016 | Drake | |
| 2017/0027797 | A1 | 2/2017 | Dolliver et al. | |
| 2017/0049651 | A1 | 2/2017 | Lim | |
| 2017/0049653 | A1 | 2/2017 | Lim | |
| 2017/0079864 | A1 | 3/2017 | Riley | |
| 2017/0112698 | A1 | 4/2017 | Hight et al. | |
| 2017/0135891 | A1 | 5/2017 | Kettner | |
| 2017/0151115 | A1 | 6/2017 | Jackson | |
| 2017/0341232 | A1 | 11/2017 | Perplies | |
| 2017/0348171 | A1 | 12/2017 | Jackson | |
| 2018/0116891 | A1 | 5/2018 | Beale et al. | |
| 2018/0185228 | A1 | 7/2018 | Catacchio et al. | |
| 2018/0193104 | A1 | 7/2018 | Beale et al. | |
| 2018/0363596 | A1 | 12/2018 | Lim et al. | |
| 2019/0000702 | A1 | 1/2019 | Lim et al. | |
| 2019/0000707 | A1 | 1/2019 | Lim et al. | |
| 2019/0046381 | A1 | 2/2019 | Lim et al. | |
| 2019/0046383 | A1 | 2/2019 | Lim et al. | |
| 2019/0209409 | A1 | 7/2019 | Jackson et al. | |
| 2020/0000668 | A1 | 1/2020 | Lim et al. | |
| 2020/0060913 | A1 | 2/2020 | Lim et al. | |
| 2020/0060914 | A1 | 2/2020 | Lim et al. | |
| 2020/0060915 | A1 | 2/2020 | Lim et al. | |
| 2020/0138660 | A1 | 5/2020 | Jackson | |
| 2020/0170868 | A1 | 6/2020 | Jackson | |
| 2020/0188208 | A1* | 6/2020 | Lim | A61B 6/04 |
| 2020/0138659 | A1 | 7/2020 | Lim et al. | |
| 2020/0281788 | A1* | 9/2020 | Lim | A61G 13/08 |
| 2020/0297568 | A1* | 9/2020 | Lim | A61G 7/008 |
| 2020/0337923 | A1* | 10/2020 | Lim | A61G 13/1295 |
| 2020/0337926 | A1* | 10/2020 | Lim | A61G 13/123 |
| 2020/0337927 | A1* | 10/2020 | Lim | A61G 13/04 |
| 2020/0360214 | A1* | 11/2020 | Lim | A61G 7/008 |

FOREIGN PATENT DOCUMENTS

| | | |
|---|---|---|
| CN | 103298440 A | 9/2013 |
| JP | 2012-228509 | 11/2012 |
| JP | 5237301 | 7/2013 |
| JP | 2017113528 | 6/2017 |
| JP | 2018069048 | 5/2018 |
| WO | 2007058673 | 5/2007 |
| WO | 2017031225 | 2/2017 |
| WO | 2017139548 | 8/2017 |

OTHER PUBLICATIONS

Office Action and Search Report dated Aug. 27, 2019 for corresponding Chinese application No. 201680046857.4.

Second Office Action dated Mar. 24, 2020 from Chinese Application No. 201680046857.4.

Office Action dated Dec. 17, 2019 for corresponding Japanese Application No. 2018-504646 with English translation.

Office Action dated Jun. 2, 2020 for corresponding Japanese application No. 2018-566265 with English translation.

International Search Report dated Nov. 21, 2016 from International Application No. PCT/US2016/047394.

International Search Report and Written Opinion dated Dec. 4, 2019 from International Application No. PCT/US2019/046979.

International Search Report and Written Opinion dated Dec. 4, 2018 in PCT/US2018/045480.

International Preliminary Report on Patentability and Written Opinion dated Feb. 11, 2020 in PCT/US2018/045480.

Extended Search Report dated Mar. 20, 2019 for corresponding EP Application No. 16837764.6.

Written Opinion of International Searching Authority dated Nov. 21, 2016 for International Application No. PCT/US2016/047394.

International Preliminary Report on Patentability dated Feb. 20, 2018 for PCT/US2016/047394.

* cited by examiner

SURGICAL FRAME AND METHOD FOR USE THEREOF FACILITATING PATIENT TRANSFER

The present application is a continuation of U.S. application Ser. No. 15/638,802 filed Jun. 30, 2017, all of which is incorporated herein by reference.

BACKGROUND OF THE INVENTION

Field of the Invention

The present invention relates to a surgical frame and a method for use thereof facilitating transfer of a patient from and to a surgical table/gurney. More particularly, the present invention relates to a surgical frame and a method for use thereof, where the surgical frame includes a main beam positionable such that a surgical table/gurney can be positioned under the main beam to facilitate transfer of a patient from the surgical table/gurney to the main beam and transfer from the main beam to the surgical table/gurney. More specifically, the present invention relates to a surgical frame and a method for use thereof, where the surgical frame includes a main beam that can be rotated, raised/lowered, and tilted upwardly/downwardly to afford positioning and repositioning of the main beam to facilitate transfer of a patient from the surgical table/gurney to the main beam and transfer from the main beam to the surgical table/gurney.

Description of the Prior Art

Typically, surgical frames used to support patients require a patient to be manually positioned thereon. That is, typical surgical frames require a patient to be physically manipulated by humans to position the patient thereon. However, such manual or physical manipulation can cause a patient to be subject to unnecessary stress/torsion. Therefore, there is a need for a surgical frame and a method for use thereof, where the surgical frame can be configured to minimize unnecessary stress/torsion on a patient during transfer from and to a surgical table/gurney. The surgical frame can include a main beam that can be rotated, raised/lowered, and tilted upwardly/downwardly to afford positioning and repositioning of the main beam to facilitate transfer of a patient from the surgical table/gurney to the main beam and transfer from the main beam to the surgical table/gurney.

SUMMARY OF THE INVENTION

The present invention in one preferred embodiment contemplates a method of transferring a patient from a surgical table/gurney using a surgical frame, the method including laying the patient on the surgical table/gurney; at least one of raising, lowering, pivoting, or tilting, and rotating a main beam of the surgical frame to position the main beam away from a patient receiving area defined by the surgical frame; positioning the surgical table/gurney and the patient positioned thereon in the patient receiving area; at least one of raising, lowering, pivoting, or tilting, and rotating the main beam of the surgical frame to position at least a portion of the main beam adjacent the patient; attaching portions of the patient to the main beam; lifting the patient from the surgical table/gurney using the surgical frame; and at least one of raising, lowering, pivoting, or tilting, and rotating the main beam and the patient attached thereto to position the patient for surgery.

The present invention in another preferred embodiment contemplates a method of transferring a patient from a surgical table/gurney using a surgical frame, the method including laying the patient on the surgical table/gurney; raising and rotating a main beam of the surgical frame to position the main beam away from a patient receiving area defined by the surgical frame; positioning the surgical table/gurney and the patient positioned thereon in the patient receiving area and positioning a portion of the surgical table/gurney over a portion of the surgical frame; lowering and rotating the main beam of the surgical frame to position at least a portion of the main beam adjacent the patient; attaching portions of the patient to the main beam; lifting the patient from the surgical table/gurney by raising the main beam of the surgical frame; removing the surgical table/gurney from the patient receiving area; and at least one of raising, lowering, pivoting, or tilting, and rotating the main beam and the patient attached thereto to position the patient for surgery.

The present invention in yet another preferred embodiment contemplates a method of transferring a patient from a surgical table/gurney using a surgical frame, the method including laying the patient on the surgical table/gurney; raising and rotating a main beam of the surgical frame to position the main beam away from a patient receiving area defined by the surgical frame; positioning the surgical table/gurney and the patient positioned thereon in the patient receiving area and positioning a portion of the surgical table/gurney over a portion of the surgical frame; lowering and rotating the main beam of the surgical frame to position at least a portion of the main beam adjacent the patient; attaching portions of the patient to the main beam; lifting the patient from the surgical table/gurney by raising the main beam of the surgical frame; removing the surgical table/gurney from the patient receiving area; at least one of raising, lowering, pivoting, or tilting, and rotating the main beam and the patient attached thereto to position the patient for surgery; performing surgery on the patient; raising the main beam and the patient attached thereto after completion of the surgery; positioning the surgical table/gurney in the patient receiving area after completion of the surgery; lowering the patient onto the surgical table/gurney by lowering the main beam of the surgical table/gurney after completion of surgery; and removing the surgical table/gurney and the patient positioned thereon from the patient receiving area after completion of the surgery.

These and other objects of the present invention will be apparent from review of the following specification and the accompanying drawings.

DETAILED DESCRIPTION OF THE PREFERRED EMBODIMENT

Figure 1:
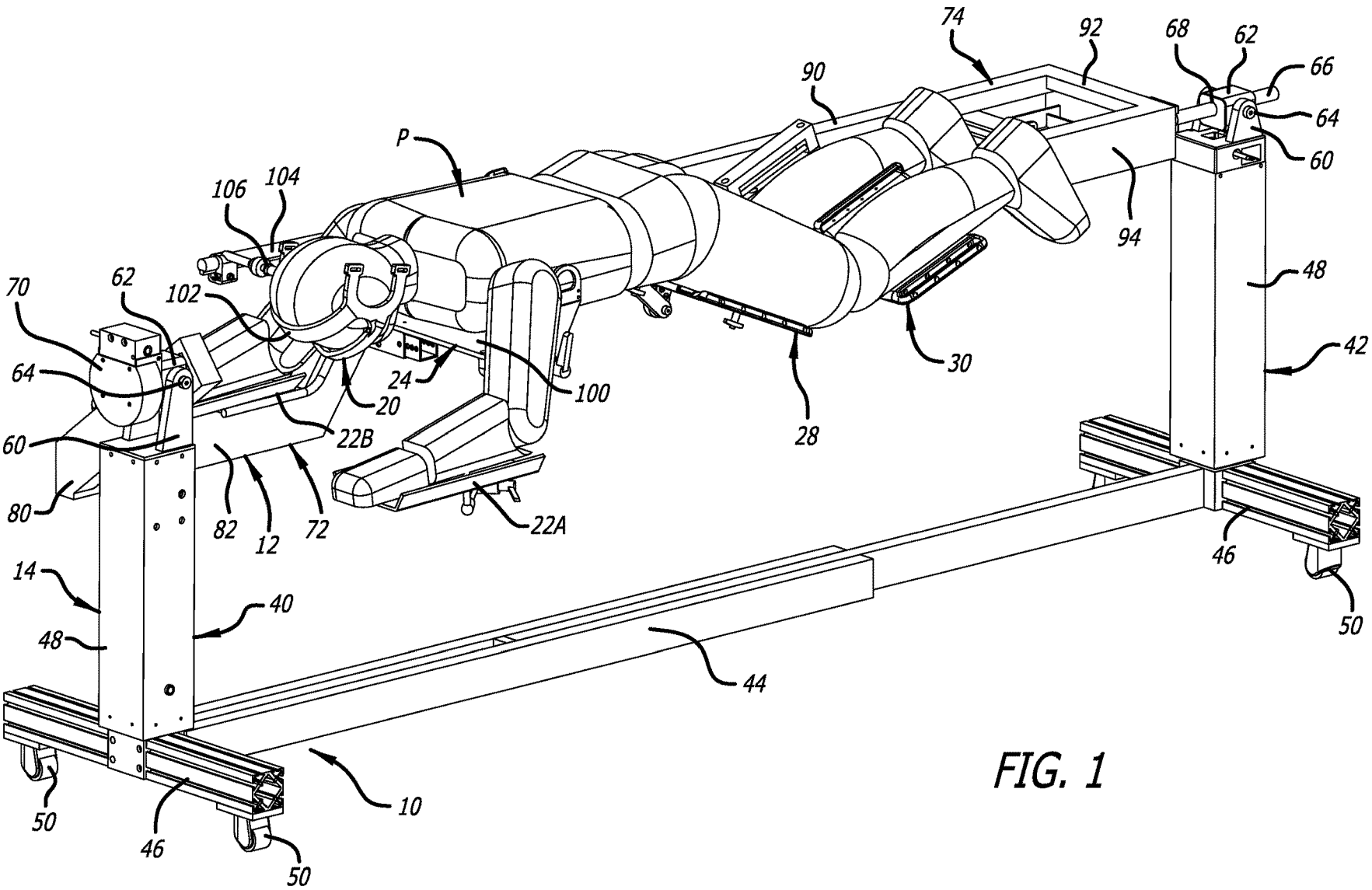
FIG. 1 is a top perspective view of a prior art surgical frame with a patient positioned thereon in a prone position.
Figure 2:
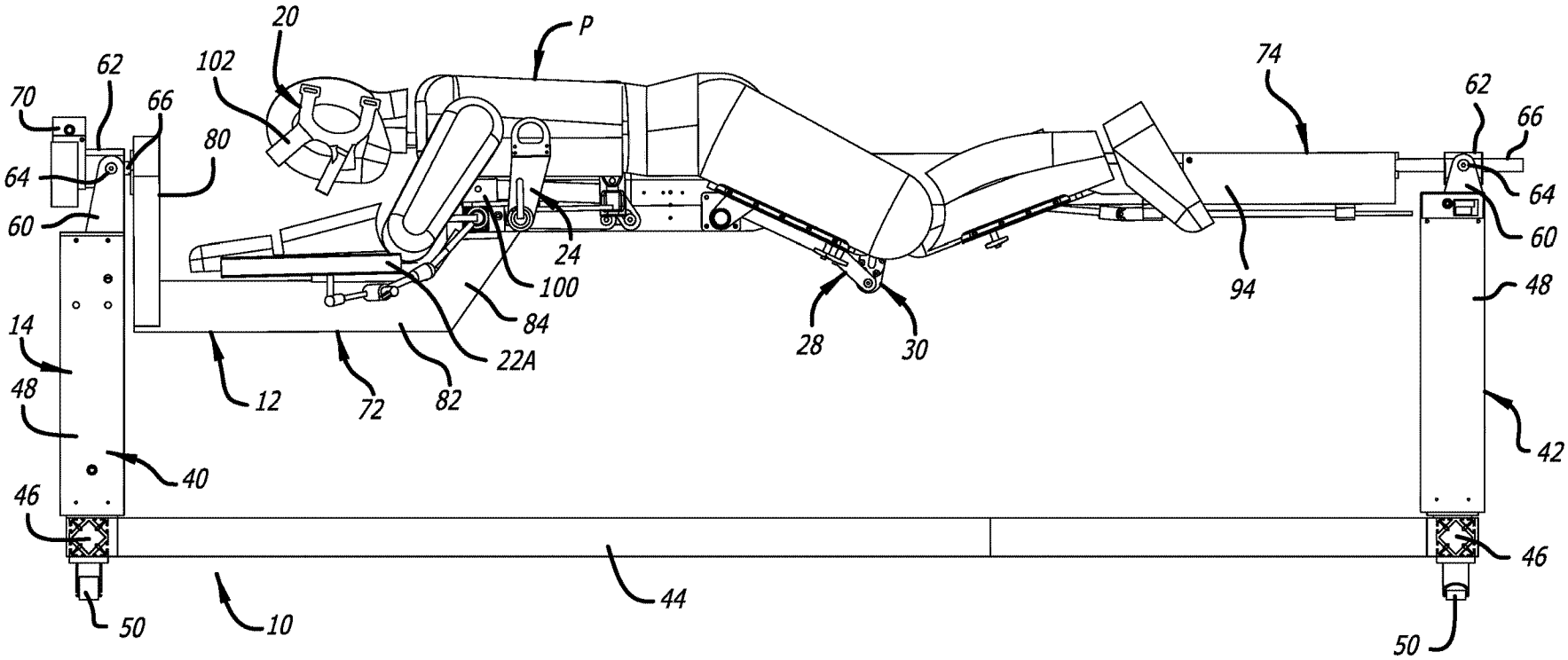
FIG. 2 is a side elevational view of the surgical frame of FIG. 1 with the patient positioned thereon in a prone position.
Figure 3:
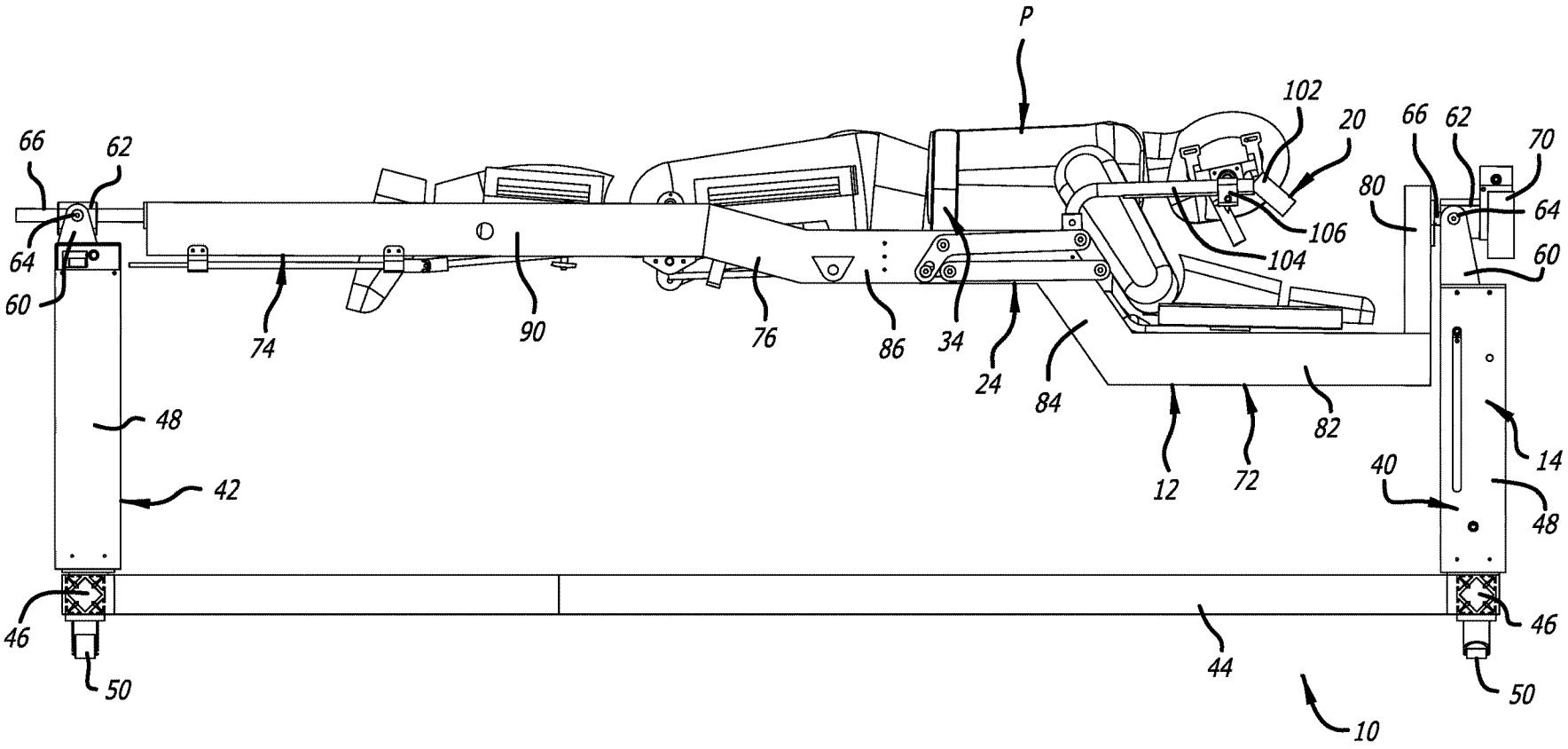
FIG. 3 is another side elevational view of the surgical frame of FIG. 1 with the patient positioned thereon in a prone position.

FIGS. 1-26 depict a prior art embodiment of a surgical support frame generally indicated by the numeral 10. FIGS.

1-26 were previously described in U.S. Ser. No. 15/239,256, which is hereby incorporated by reference herein in its entirety. As discussed below, the surgical frame 10 serves as an exoskeleton to support the body of the patient P as the patient's body is manipulated thereby, and, in doing so, serves to support the patient P such that the patient's spine does not experience unnecessary torsion.

The surgical frame 10 is configured to provide a relatively minimal amount of structure adjacent the patient's spine to facilitate access thereto and to improve the quality of imaging available before and during surgery. Thus, the surgeon's workspace and imaging access are thereby increased. Furthermore, radio-lucent or low magnetic susceptibility materials can be used in constructing the structural components adjacent the patient's spine in order to further enhance imaging quality.

The surgical frame 10 has a longitudinal axis and a length therealong. As depicted in FIGS. 1-5, for example, the surgical frame 10 includes an offset structural main beam 12 and a support structure 14. The offset main beam 12 is spaced from the ground by the support structure 14. As discussed below, the offset main beam 12 is used in supporting the patient P on the surgical frame 10 and various support components of the surgical frame 10 that directly contact the patient P (such as a head support 20, arm supports 22A and 22B, torso-lift supports 24 and 160, a sagittal adjustment assembly 28 including a pelvic-tilt mechanism 30 and a leg adjustment mechanism 32, and a coronal adjustment assembly 34). As discussed below, an operator such as a surgeon can control actuation of the various support components to manipulate the position of the patient's body. Soft straps (not shown) are used with these various support components to secure the patient P to the frame and to enable either manipulation or fixation of the patient P. Reusable soft pads can be used on the load-bearing areas of the various support components.

Figure 4:
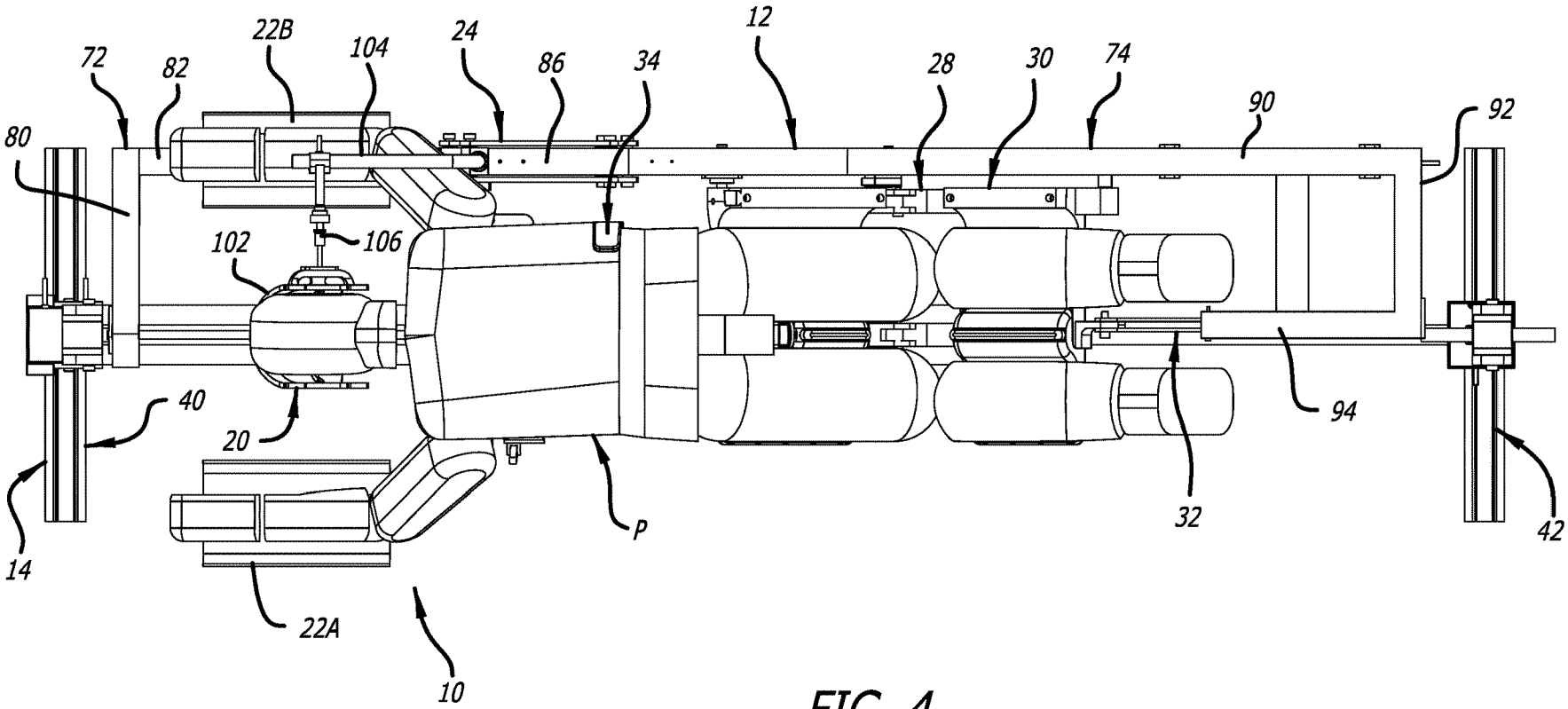
FIG. 4 is a top plan view of the surgical frame of FIG. 1 with the patient positioned thereon in a prone position.
Figure 5:
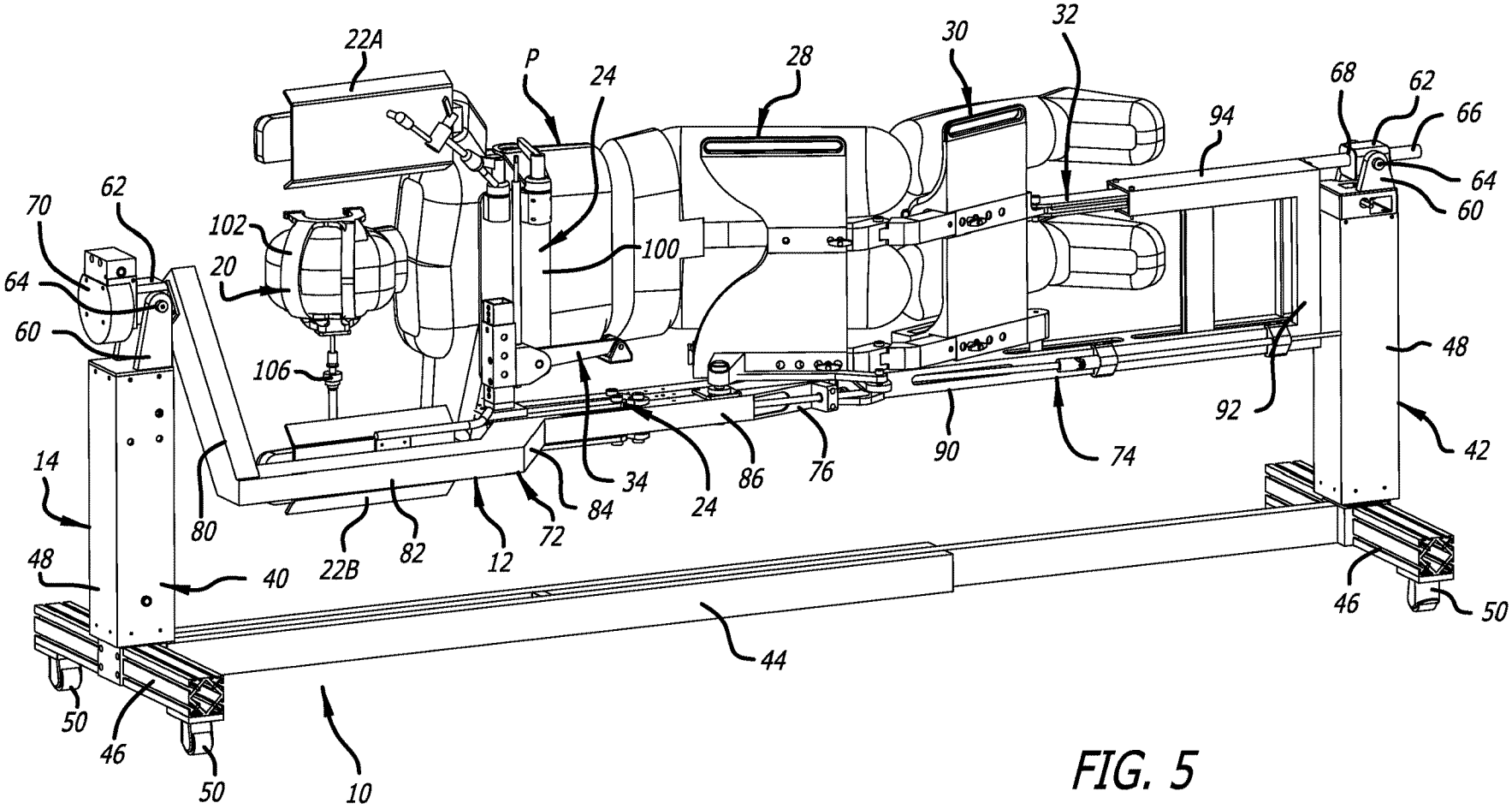
FIG. 5 is a top perspective view of the surgical frame of FIG. 1 with the patient positioned thereon in a lateral position.

The offset main beam 12 is used to facilitate rotation of the patient P. The offset main beam 12 can be rotated a full 360° before and during surgery to facilitate various positions of the patient P to afford various surgical pathways to the patient's spine depending on the surgery to be performed. For example, the offset main beam 12 can be positioned to place the patient P in a prone position (e.g., FIGS. 1-4), a lateral position (e.g., FIG. 5), and in a position 45° between the prone and lateral positions. Furthermore, the offset main beam 12 can be rotated to afford anterior, posterior, lateral, anterolateral, and posterolateral pathways to the spine. As such, the patient's body can be flipped numerous times before and during surgery without compromising sterility or safety. The various support components of the surgical frame 10 are strategically placed to further manipulate the patient's body into position before and during surgery. Such intraoperative manipulation and positioning of the patient P affords a surgeon significant access to the patient's body. To illustrate, when the offset main beam 12 is rotated to position the patient P in a lateral position, as depicted in FIG. 5, the head support 20, the arm supports 22A and 22B, the torso-lift support 24, the sagittal adjustment assembly 28, and/or the coronal adjustment assembly 34 can be articulated such that the surgical frame 10 is OLIF-capable or DLIF-capable.

As depicted in FIG. 1, for example, the support structure 14 includes a first support portion 40 and a second support portion 42 interconnected by a cross member 44. Each of the first and second support portions 40 and 42 include a horizontal portion 46 and a vertical support post 48. The horizontal portions 46 are connected to the cross member 44, and casters 50 can be attached to the horizontal portions 46 to facilitate movement of the surgical frame 10.

The vertical support posts 48 can be adjustable to facilitate expansion and contraction of the heights thereof. Expansion and contraction of the vertical support posts 48 facilitates raising and lowering, respectively, of the offset main beam 12. As such, the vertical support posts 48 can be adjusted to have equal or different heights. For example, the vertical support posts 48 can be adjusted such that the vertical support post 48 of the second support portion 42 is raised 12 inches higher than the vertical support post 48 of the first support portion 40 to place the patient P in a reverse Trendelenburg position.

Furthermore, cross member 44 can be adjustable to facilitate expansion and contraction of the length thereof. Expansion and contraction of the cross member 44 facilitates lengthening and shortening, respectively, of the distance between the first and second support portions 40 and 42.

The vertical support post 48 of the first and second support portions 40 and 42 have heights at least affording rotation of the offset main beam 12 and the patient P positioned thereon. Each of the vertical support posts 48 include a clevis 60, a support block 62 positioned in the clevis 60, and a pin 64 pinning the clevis 60 to the support block 62. The support blocks 62 are capable of pivotal movement relative to the clevises 60 to accommodate different heights of the vertical support posts 48. Furthermore, axles 66 extending outwardly from the offset main beam 12 are received in apertures 68 formed the support blocks 62. The axles 66 define an axis of rotation of the offset main beam 12, and the interaction of the axles 66 with the support blocks 62 facilitate rotation of the offset main beam 12.

Furthermore, a servomotor 70 can be interconnected with the axle 66 received in the support block 62 of the first support portion 40. The servomotor 70 can be computer controlled and/or operated by the operator of the surgical frame 10 to facilitate controlled rotation of the offset main beam 12. Thus, by controlling actuation of the servomotor 70, the offset main beam 12 and the patient P supported thereon can be rotated to afford the various surgical pathways to the patient's spine.

As depicted in FIGS. 1-5, for example, the offset main beam 12 includes a forward portion 72 and a rear portion 74. The forward portion 72 supports the head support 20, the arm supports 22A and 22B, the torso-lift support 24, and the coronal adjustment assembly 34, and the rear portion 74 supports the sagittal adjustment assembly 28. The forward and rear portions 72 and 74 are connected to one another by connection member 76 shared therebetween. The forward portion 72 includes a first portion 80, a second portion 82, a third portion 84, and a fourth portion 86. The first portion 80 extends transversely to the axis of rotation of the offset main beam 12, and the second and fourth portions 82 and 86 are aligned with the axis of rotation of the offset main beam 12. The rear portion 74 includes a first portion 90, a second portion 92, and a third portion 94. The first and third portions 90 and 94 are aligned with the axis of rotation of the offset main beam 12, and the second portion 92 extends transversely to the axis of rotation of the offset main beam 12.

The axles 66 are attached to the first portion 80 of the forward portion 72 and to the third portion 94 of the rear portion 74. The lengths of the first portion 80 of the forward portion 72 and the second portion 92 of the rear portion 74 serve in offsetting portions of the forward and rear portions 72 and 74 from the axis of rotation of the offset main beam 12. This offset affords positioning of the cranial-caudal axis of patient P approximately aligned with the axis of rotation of the offset main beam 12.

Programmable settings controlled by a computer controller (not shown) can be used to maintain an ideal patient height for a working position of the surgical frame 10 at a near-constant position through rotation cycles, for example, between the patient positions depicted in FIGS. 1 and 5. This allows for a variable axis of rotation between the first portion 40 and the second portion 42.

Figure 6:
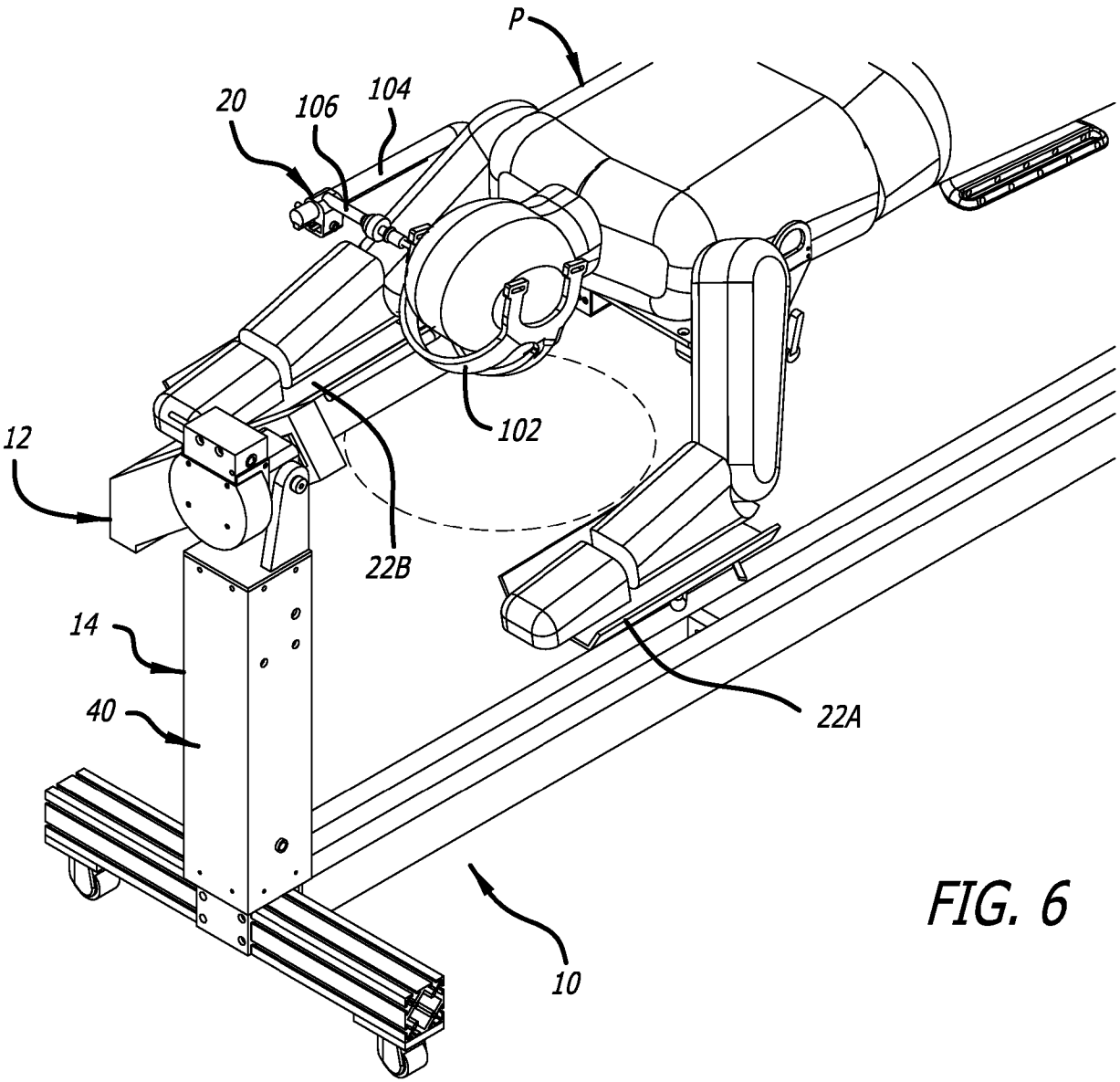
FIG. 6 is a top perspective view of portions of the surgical frame of FIG. 1 showing an area of access to the head of the patient positioned thereon in a prone position.

As depicted in FIG. 5, for example, the head support 20 is attached to a chest support plate 100 of the torso-lift support 24 to support the head of the patient P. If the torso-lift support 24 is not used, the head support 20 can be directly attached to the forward portion 72 of the offset main beam 12. As depicted in FIGS. 4 and 6, for example, the head support 20 further includes a facial support cradle 102, an axially adjustable head support beam 104, and a temple support portion 106. Soft straps (not shown) can be used to secure the patient P to the head support 20. The facial support cradle 102 includes padding across the forehead and cheeks, and provides open access to the mouth of the patient P. The head support 20 also allows for imaging access to the cervical spine. Adjustment of the head support 20 is possible via adjusting the angle and the length of the head support beam 104 and the temple support portion 106.

As depicted in FIG. 5, for example, the arm supports 22A and 22B contact the forearms and support the remainder of the arms of the patient P, with the first arm support 22A and the second arm support 22B attached to the chest support plate 100 of the torso-lift support 24. If the torso-lift support 24 is not used, the arm supports 22A and 22B can both be directly attached to the offset main beam 12. The arm supports 22A and 22B are positioned such that the arms of the patient P are spaced away from the remainder of the patient's body to provide access (FIG. 6) to at least portions of the face and neck of the patient P, thereby providing greater access to the patient.

Figure 7:
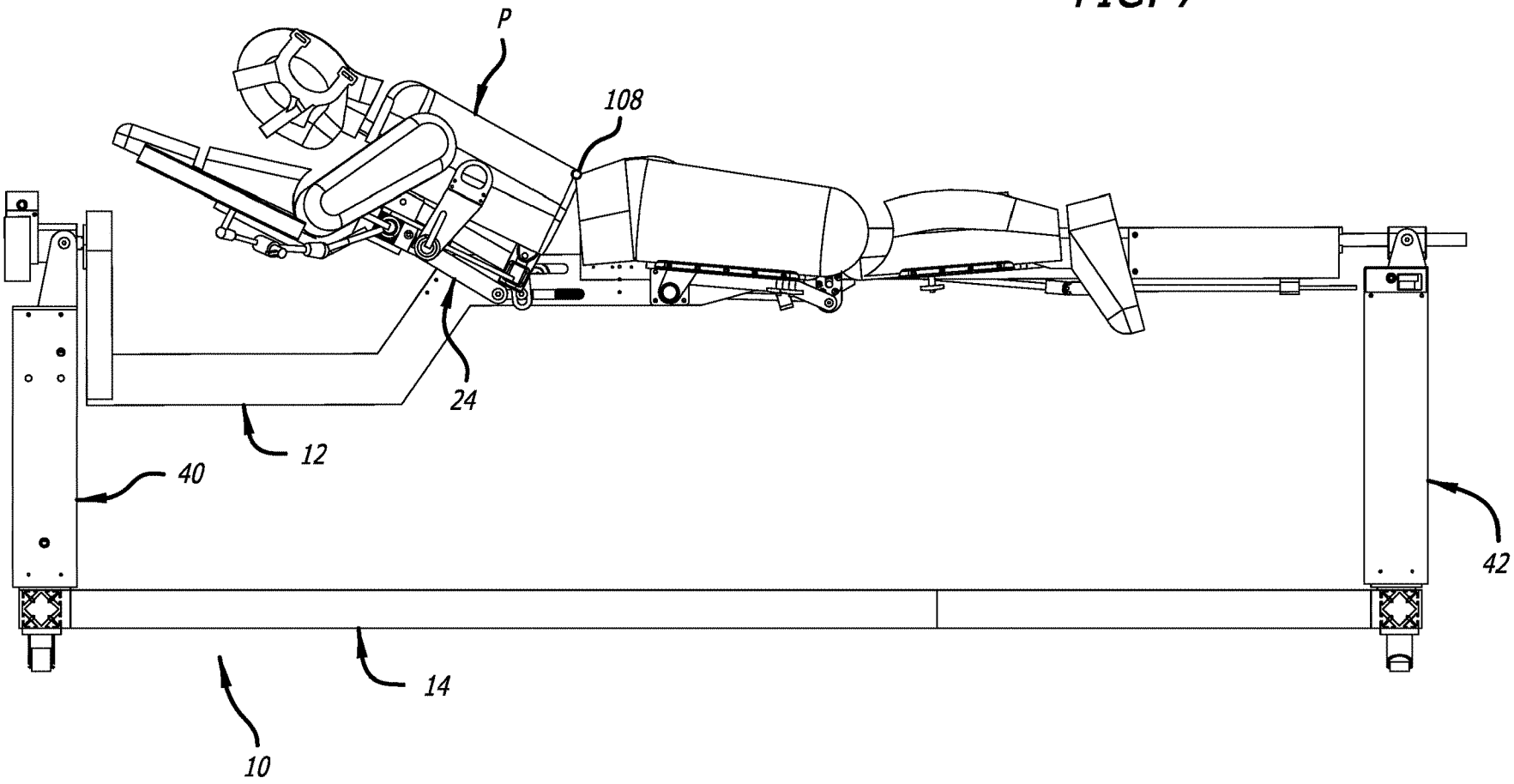
FIG. 7 is a side elevational view of the surgical frame of FIG. 1 showing a torso-lift support supporting the patient in a lifted position.
Figure 8:
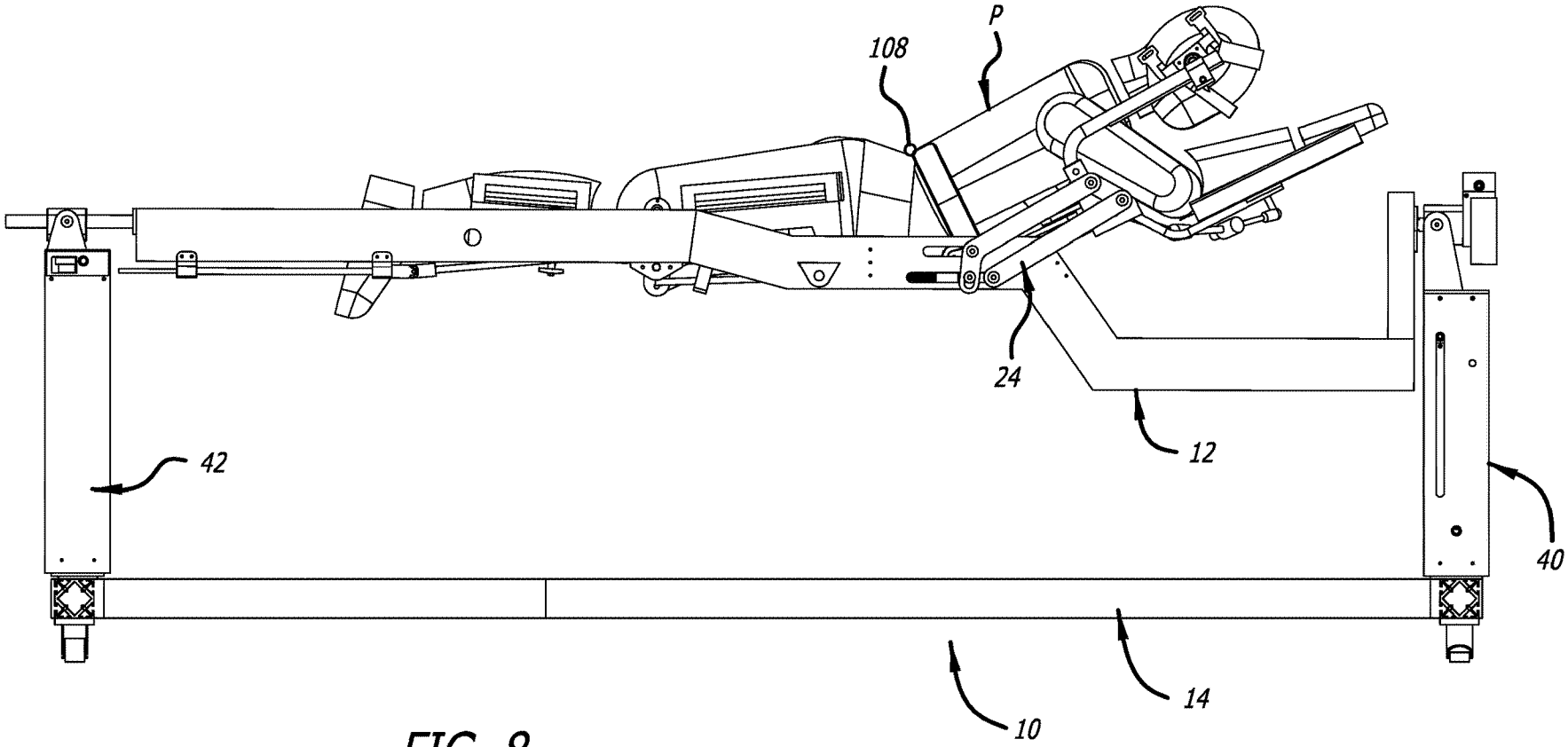
FIG. 8 is another side elevational view of the surgical frame of FIG. 1 showing the torso-lift support supporting the patient in the lifted position.
Figure 9:
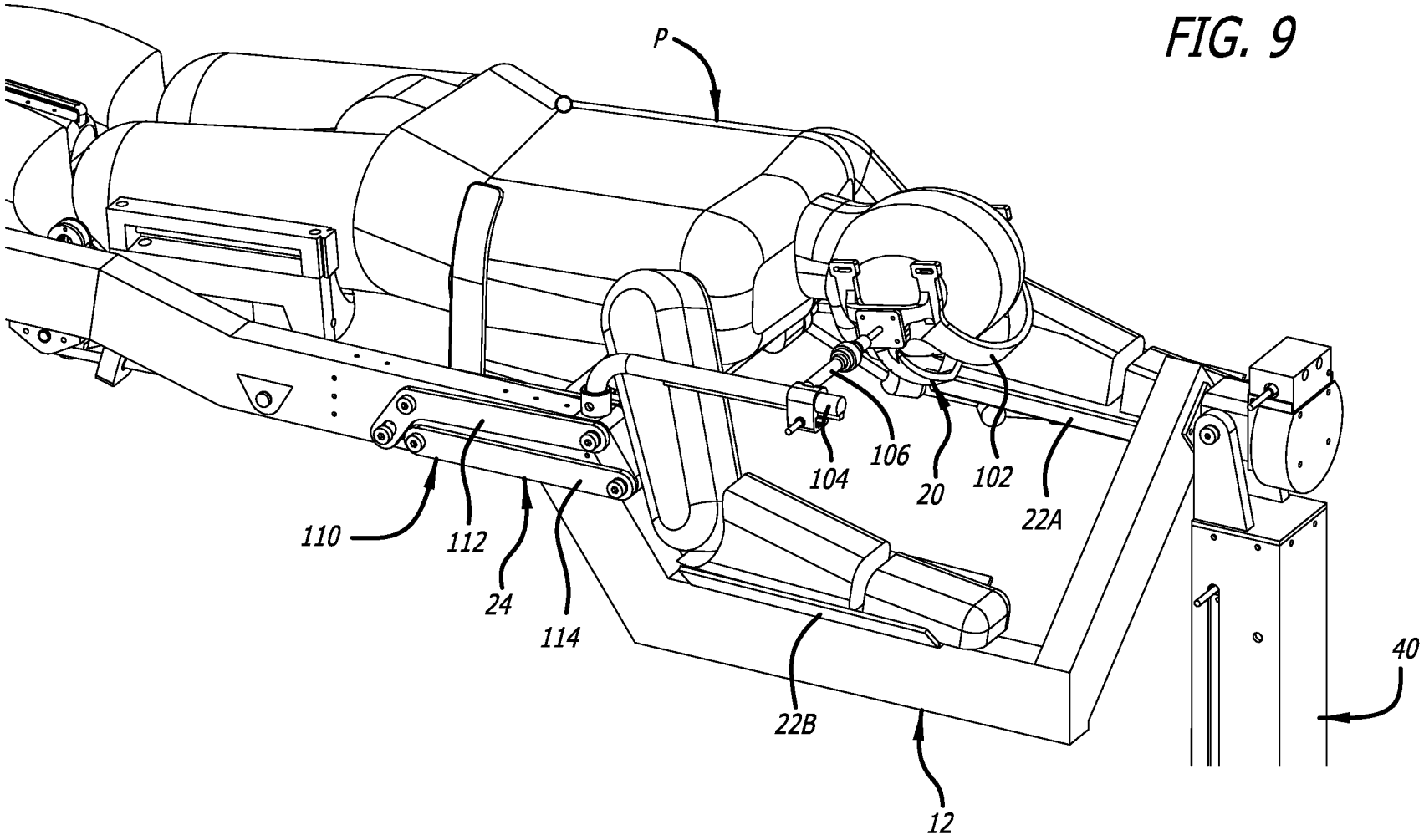
FIG. 9 is an enlarged top perspective view of portions of the surgical frame of FIG. 1 showing the torso-lift support supporting the patient in an unlifted position.

As depicted in FIGS. 7-12, for example, the surgical frame 10 includes a torso-lift capability for lifting and lowering the torso of the patient P between an uplifted position and a lifted position, which is described in detail below with respect to the torso-lift support 24. As depicted in FIGS. 7 and 8, for example, the torso-lift capability has an approximate center of rotation ("COR") 108 that is located at a position anterior to the patient's spine about the L2 of the lumbar spine, and is capable of elevating the upper body of the patient at least an additional six inches when measured at the chest support plate 100.

As depicted in FIGS. 9-12, for example, the torso-lift support 24 includes a "crawling" four-bar mechanism 110 attached to the chest support plate 100. Soft straps (not shown) can be used to secure the patient P to the chest support plate 100. The head support 20 and the arm supports 22A and 22B are attached to the chest support plate 100, thereby moving with the chest support plate 100 as the chest support plate 100 is articulated using the torso-lift support 24. The fixed COR 108 is defined at the position depicted in FIGS. 7 and 8. Appropriate placement of the COR 108 is important so that spinal cord integrity is not compromised (i.e., overly compressed or stretched) during the lift maneuver performed by the torso-lift support 24.

Figure 10:
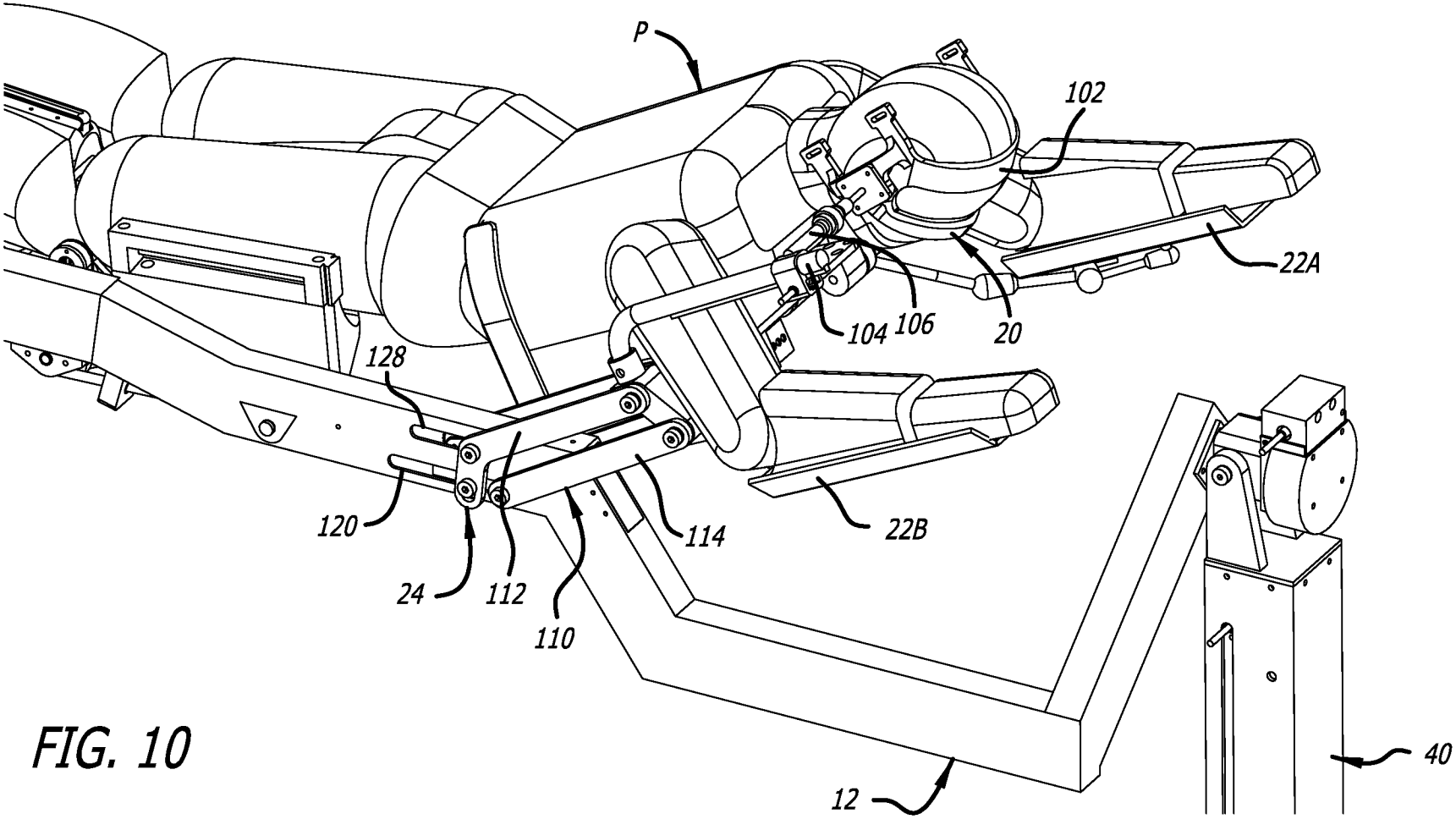
FIG. 10 is an enlarged top perspective view of portions of the surgical frame of FIG. 1 showing the torso-lift support supporting the patient in the lifted position.
Figure 11:
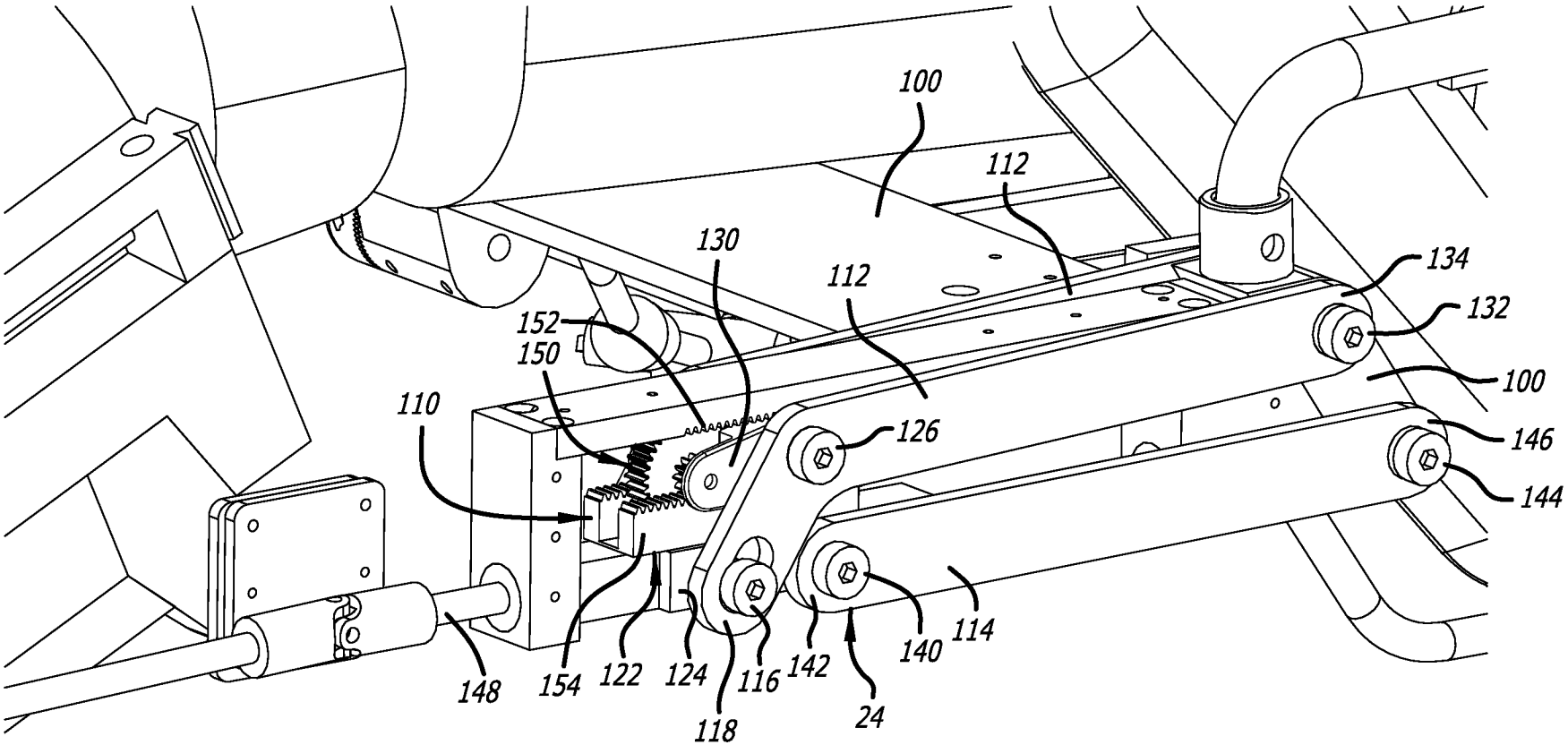
FIG. 11 is an enlarged top perspective view of componentry of the torso-lift support in the unlifted position.
Figure 12:
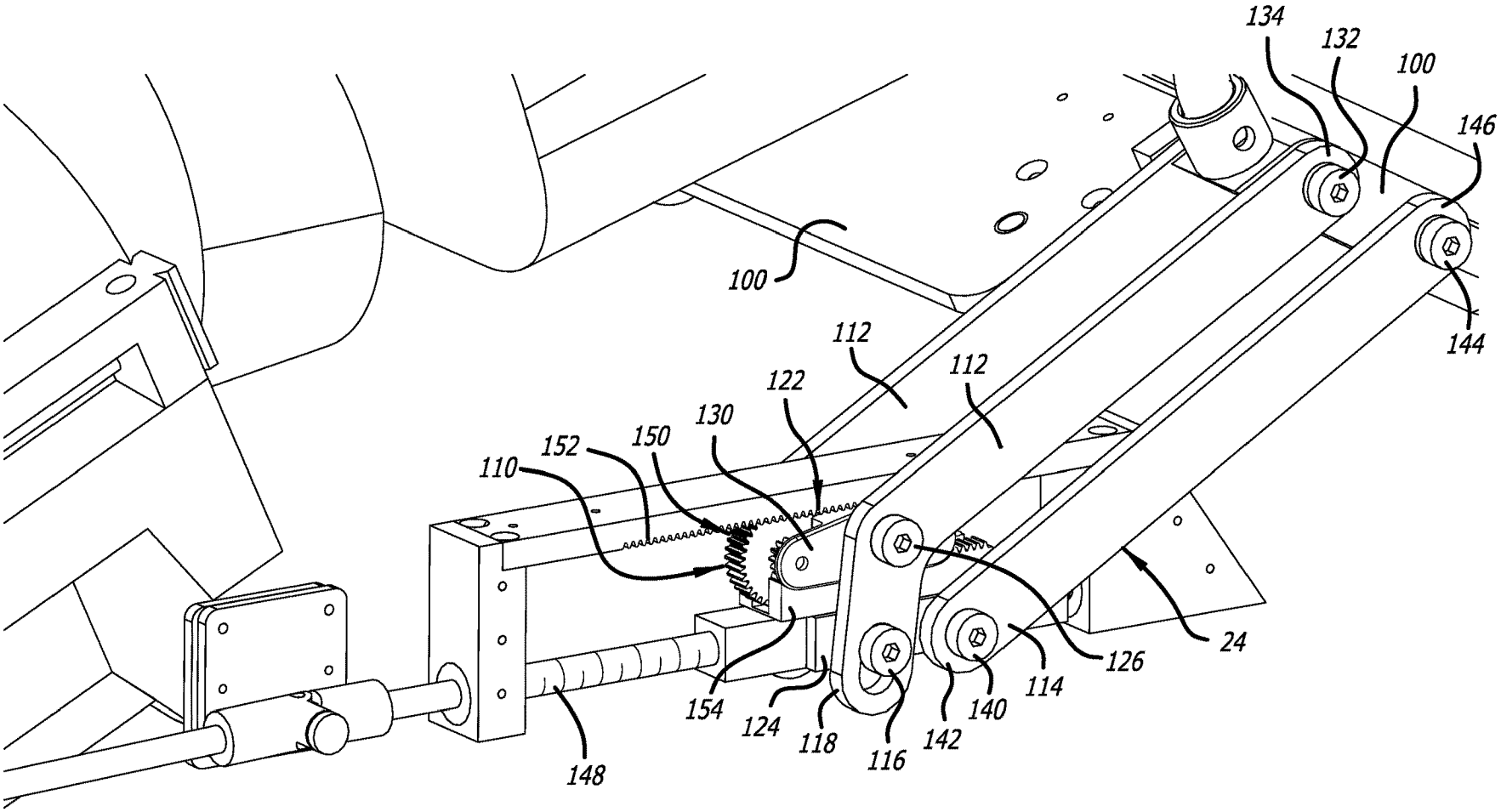
FIG. 12 is an enlarged top perspective view of the componentry of the torso-lift support in the lifted position.

As depicted in FIGS. 10-12, for example, the four-bar mechanism 110 includes first links 112 pivotally connected between offset main beam 12 and the chest support plate 100, and second links 114 pivotally connected between the offset main beam 12 and the chest support plate 100. As depicted in FIGS. 11 and 12, for example, in order to maintain the COR 108 at the desired fixed position, the first and second links 112 and 114 of the four-bar mechanism 110 crawl toward the first support portion 40 of the support structure 14, when the patient's upper body is being lifted. The first and second links 112 and 114 are arranged such that neither the surgeon's workspace nor imaging access are compromised while the patient's torso is being lifted.

As depicted in FIGS. 11 and 12, for example, each of the first links 112 define an L-shape, and includes a first pin 116 at a first end 118 thereof. The first pin 116 extends through first elongated slots 120 defined in the offset main beam 12, and the first pin 116 connects the first links 112 to a dual rack and pinion mechanism 122 via a drive nut 124 provided within the offset main beam 12, thus defining a lower pivot point thereof. Each of the first links 112 also includes a second pin 126 positioned proximate the corner of the L-shape. The second pin 126 extends through second elongated slots 128 defined in the offset main beam 12, and is linked to a carriage 130 of rack and pinion mechanism 122. Each of the first links 112 also includes a third pin 132 at a second end 134 that is pivotally attached to chest support plate 100, thus defining an upper pivot point thereof.

As depicted in FIGS. 11 and 12, for example, each of the second links 114 includes a first pin 140 at a first end 142 thereof. The first pin 140 extends through the first elongated slot 120 defined in the offset main beam 12, and the first pin 140 connects the second links 114 to the drive nut 124 of the rack and pinion mechanism 122, thus defining a lower pivot point thereof. Each of the second links 114 also includes a second pin 144 at a second end 146 that is pivotally connected to the chest support plate 100, thus defining an upper pivot point thereof.

As depicted in FIGS. 11 and 12, the rack and pinion mechanism 122 includes a drive screw 148 engaging the drive nut 124. Coupled gears 150 are attached to the carriage 130. The larger of the gears 150 engage an upper rack 152 (fixed within the offset main beam 12), and the smaller of the gears 150 engage a lower rack 154. The carriage 130 is defined as a gear assembly that floats between the two racks 152 and 154.

As depicted in FIGS. 11 and 12, the rack and pinion mechanism 122 converts rotation of the drive screw 148 into linear translation of the first and second links 112 and 114 in the first and second elongated slots 120 and 128 toward the first portion 40 of the support structure 14. As the drive nut 124 translates along drive screw 148 (via rotation of the drive screw 148), the carriage 130 translates towards the first portion 40 with less travel due to the different gear sizes of the coupled gears 150. The difference in travel, influenced by different gear ratios, causes the first links 112 pivotally attached thereto to lift the chest support plate 100. Lowering of the chest support plate 100 is accomplished by performing this operation in reverse. The second links 114 are "idler" links (attached to the drive nut 124 and the chest support plate 100) that controls the tilt of the chest support plate 100 as it is being lifted and lowered. All components associated with lifting while tilting the chest plate predetermine where COR 108 resides. Furthermore, a servomotor (not shown) interconnected with the drive screw 148 can be computer controlled and/or operated by the operator of the surgical frame 10 to facilitate controlled lifting and lowering of the chest support plate 100. A safety feature can be provided, enabling the operator to read and limit a lifting and lowering force applied by the torso-lift support 24 in order to prevent injury to the patient P. Moreover, the torso-lift support 24 can also include safety stops (not shown) to prevent over-extension or compression of the patient P, and sensors (not shown) programmed to send patient position feedback to the safety stops.

Figure 13A:
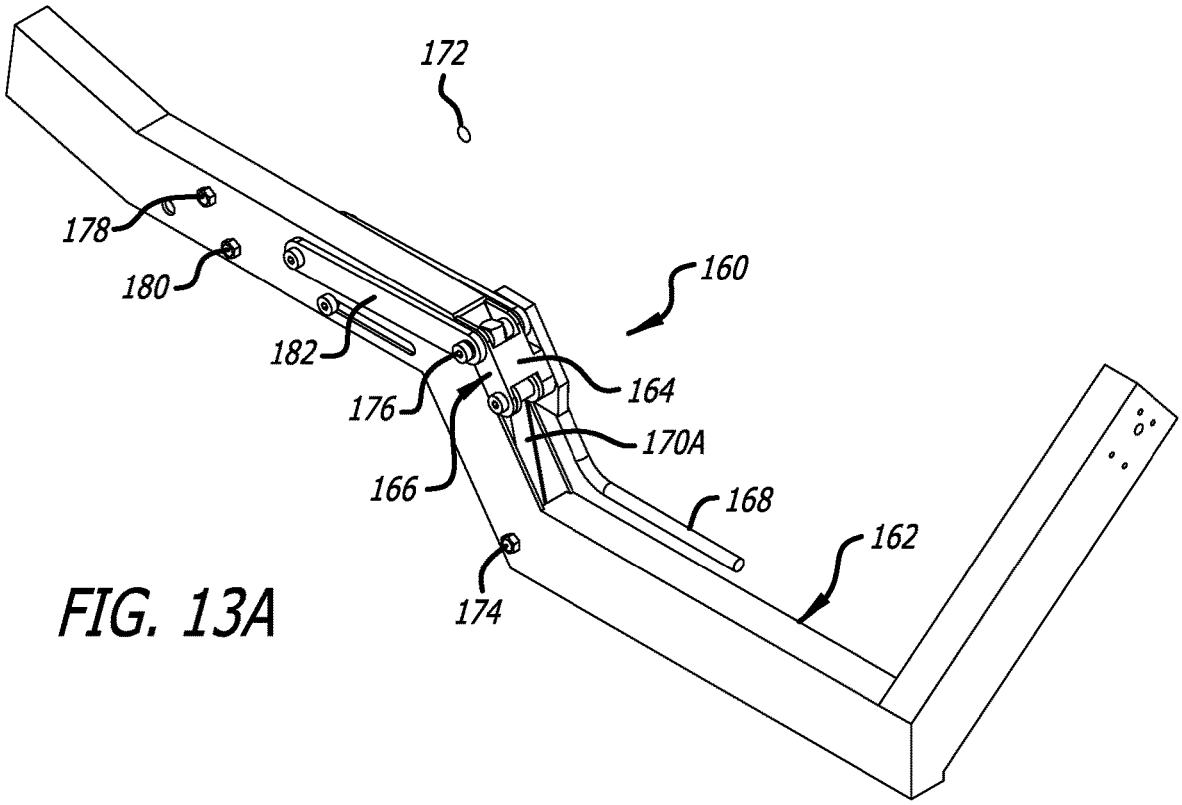
FIG. 13A is a perspective view of an embodiment of a structural offset main beam for use with another embodiment of a torso-lift support showing the torso-lift support in a retracted position.

An alternative preferred embodiment of a torso-lift support is generally indicated by the numeral 160 in FIGS. 13A-15. As depicted in FIGS. 13A-13C, an alternate offset main beam 162 is utilized with the torso-lift support 160. Furthermore, the torso-lift support 160 has a support plate 164 pivotally linked to the offset main beam 162 by a chest support lift mechanism 166. An arm support rod/plate 168 is connected to the support plate 164, and the second arm support 22B. The support plate 164 is attached to the chest support plate 100, and the chest support lift mechanism 166 includes various actuators 170A, 170B, and 170C used to facilitate positioning and repositioning of the support plate 164 (and hence, the chest support plate 100).

Figure 13B:
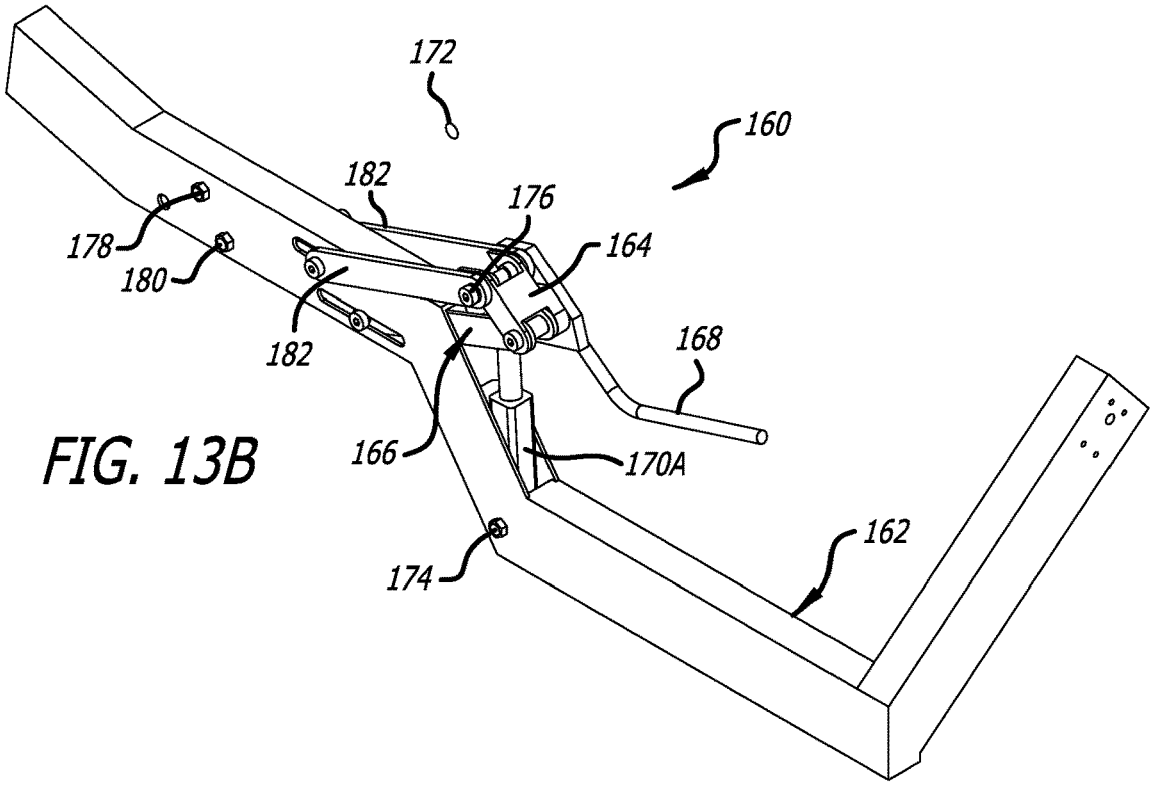
FIG. 13B is a perspective view similar to FIG. 13A showing the torso-lift support at half travel.
Figure 13C:
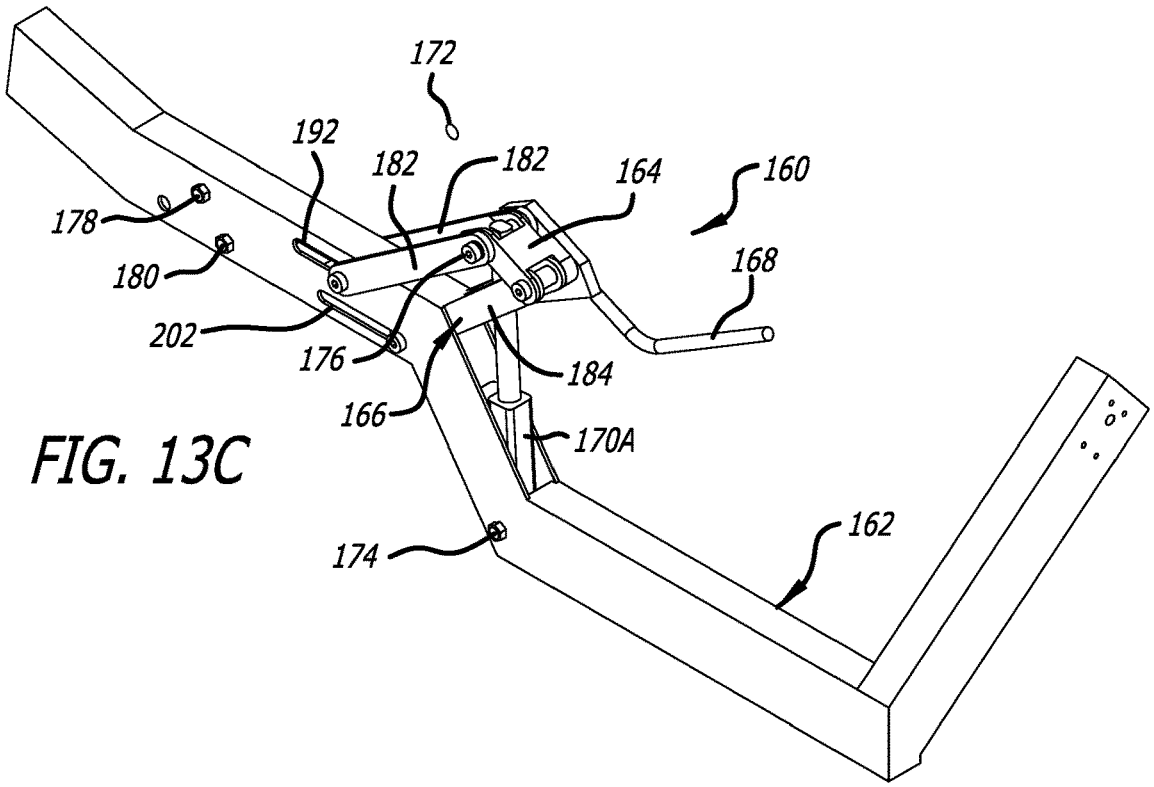
FIG. 13C is a perspective view similar to FIGS. 13A and 13B showing the torso-lift support at full travel.

As discussed below, the torso-lift support 160 depicted in FIGS. 13A-15 enables a COR 172 thereof to be programmably altered such that the COR 172 can be a fixed COR or a variable COR. As their names suggest, the fixed COR stays in the same position as the torso-lift support 160 is actuated, and the variable COR moves between a first position and a second position as the torso-lift support 160 is actuated between its initial position and final position at full travel thereof. Appropriate placement of the COR 172 is important so that spinal cord integrity is not compromised (i.e., overly compressed or stretched). Thus, the support plate 164 (and hence, the chest support plate 100) follows a path coinciding with a predetermined COR 172 (either fixed or variable). FIG. 13A depicts the torso-lift support 160 retracted, FIG. 13B depicts the torso-lift support 160 at half travel, and FIG. 13C depicts the torso-lift support 160 at full travel.

Figure 14:
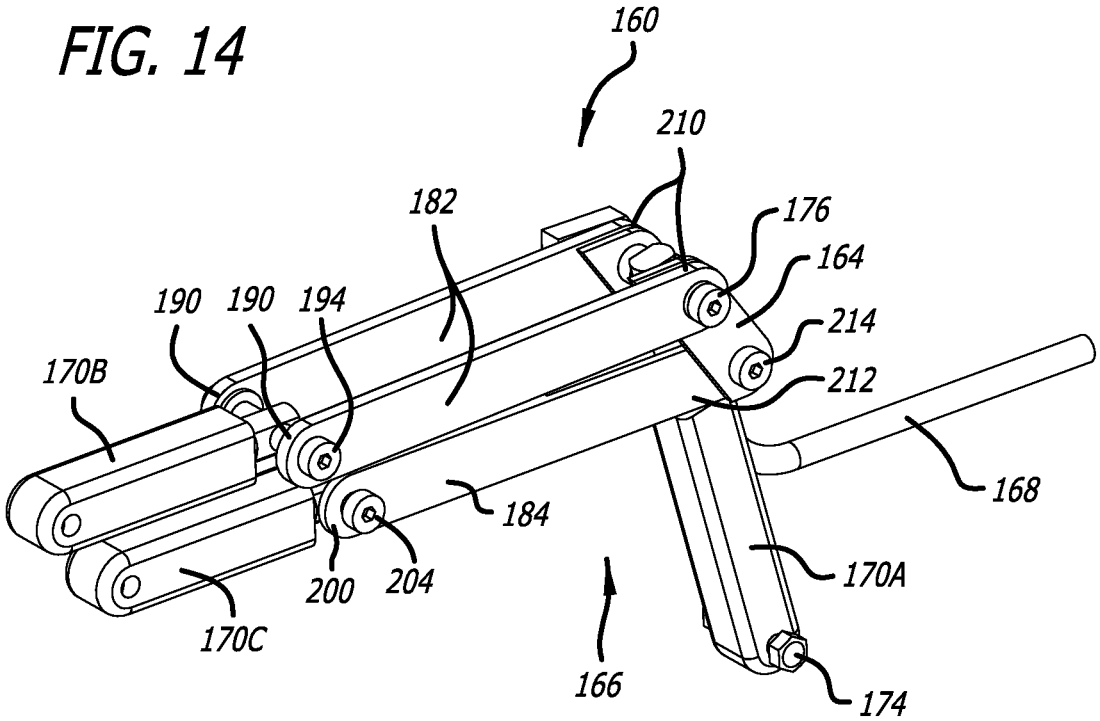
FIG. 14 is a perspective view of a chest support lift mechanism of the torso-lift support of FIGS. 13A-13C with actuators thereof retracted.
Figure 15:
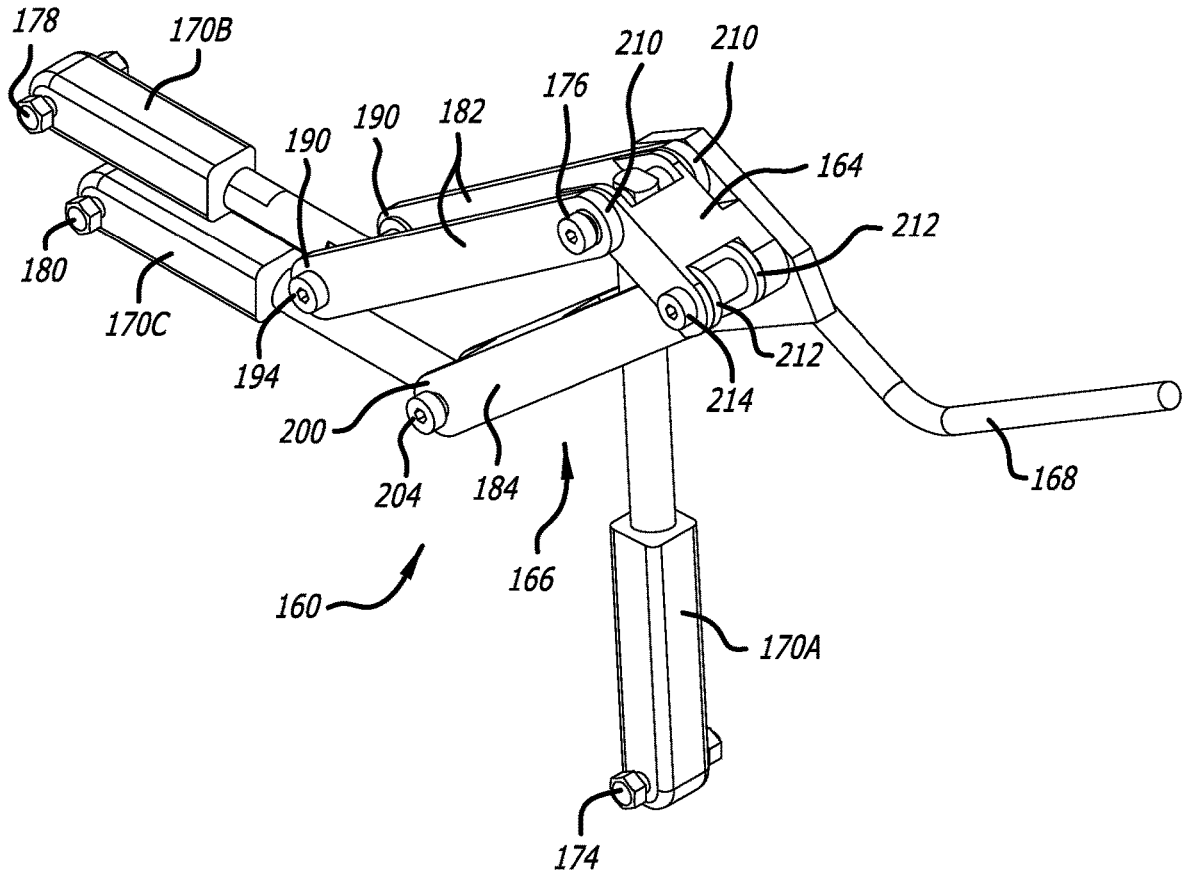
FIG. 15 is another perspective view of a chest support lift mechanism of the torso-lift support of FIGS. 13A-13C with the actuators thereof extended.

As discussed above, the chest support lift mechanism 166 includes the actuators 170A, 170B, and 170C to position and reposition the support plate 164 (and hence, the chest support plate 100). As depicted in FIGS. 14 and 15, for example, the first actuator 170A, the second actuator 1706, and the third actuator 170C are provided. Each of the actuators 170A, 170B, and 170C are interconnected with the offset main beam 12 and the support plate 164, and each of the actuators 170A, 170B, and 170C are moveable between a retracted and extended position. As depicted in FIGS. 13A-13C, the first actuator 170A is pinned to the offset main beam 162 using a pin 174 and pinned to the support plate 164 using a pin 176. Furthermore, the second and third actuators 170B and 170C are received within the offset main beam 162. The second actuator 170B is interconnected with the offset main beam 162 using a pin 178, and the third actuator 170C is interconnected with the offset main beam 162 using a pin 180.

The second actuator 170B is interconnected with the support plate 164 via first links 182, and the third actuator 170C is interconnected with the support plate 164 via second links 184. First ends 190 of the first links 182 are pinned to the second actuator 170B and elongated slots 192 formed in the offset main beam 162 using a pin 194, and first ends 200 of the second links 184 are pinned to the third actuator 170C and elongated slots 202 formed in the offset main beam 162 using a pin 204. The pins 194 and 204 are moveable within the elongated slots 192 and 202. Furthermore, second ends 210 of the first links 182 are pinned to the support plate 164 using the pin 176, and second ends 212 of the second links 184 are pinned to the support plate 164 using a pin 214. To limit interference therebetween, as depicted in FIGS. 13A-13C, the first links 182 are provided on the exterior of the offset main beam 162, and, depending on the position thereof, the second links 184 are positioned on the interior of the offset main beam 162.

Actuation of the actuators 170A, 170B, and 170C facilitates movement of the support plate 164. Furthermore, the amount of actuation of the actuators 170A, 170B, and 170C can be varied to affect different positions of the support plate 164. As such, by varying the amount of actuation of the actuators 170A, 1706, and 170C, the COR 172 thereof can be controlled. As discussed above, the COR 172 can be predetermined, and can be either fixed or varied. Furthermore, the actuation of the actuators 170A, 170B, and 170C can be computer controlled and/or operated by the operator of the surgical frame 10, such that the COR 172 can be programmed by the operator. As such, an algorithm can be used to determine the rates of extension of the actuators 170A, 1706, and 170C to control the COR 172, and the computer controls can handle implementation of the algorithm to provide the predetermined COR. A safety feature can be provided, enabling the operator to read and limit a lifting force applied by the actuators 170A, 170B, and 170C in order to prevent injury to the patient P. Moreover, the torso-lift support 160 can also include safety stops (not shown) to prevent over-extension or compression of the patient P, and sensors (not shown) programmed to send patient position feedback to the safety stops.

FIGS. 16-23 depict portions of the sagittal adjustment assembly 28. The sagittal adjustment assembly 28 can be used to distract or compress the patient's lumbar spine during or after lifting or lowering of the patient's torso by the torso-lift supports. The sagittal adjustment assembly 28 supports and manipulates the lower portion of the patient's body. In doing so, the sagittal adjustment assembly 28 is configured to make adjustments in the sagittal plane of the patient's body, including tilting the pelvis, controlling the position of the upper and lower legs, and lordosing the lumbar spine.

Figure 16:
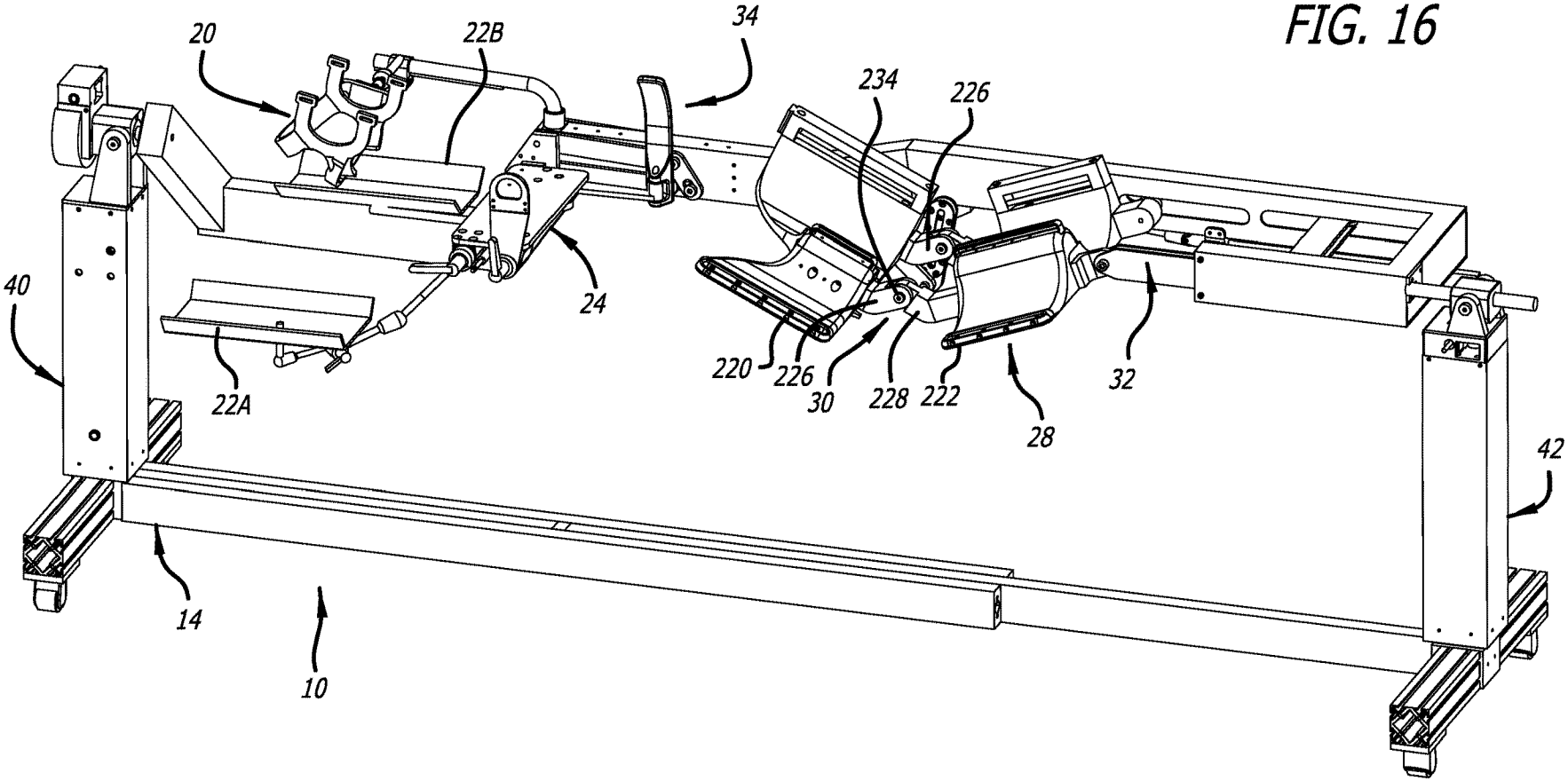
FIG. 16 is a top perspective view of the surgical frame of FIG. 5.
Figure 17:
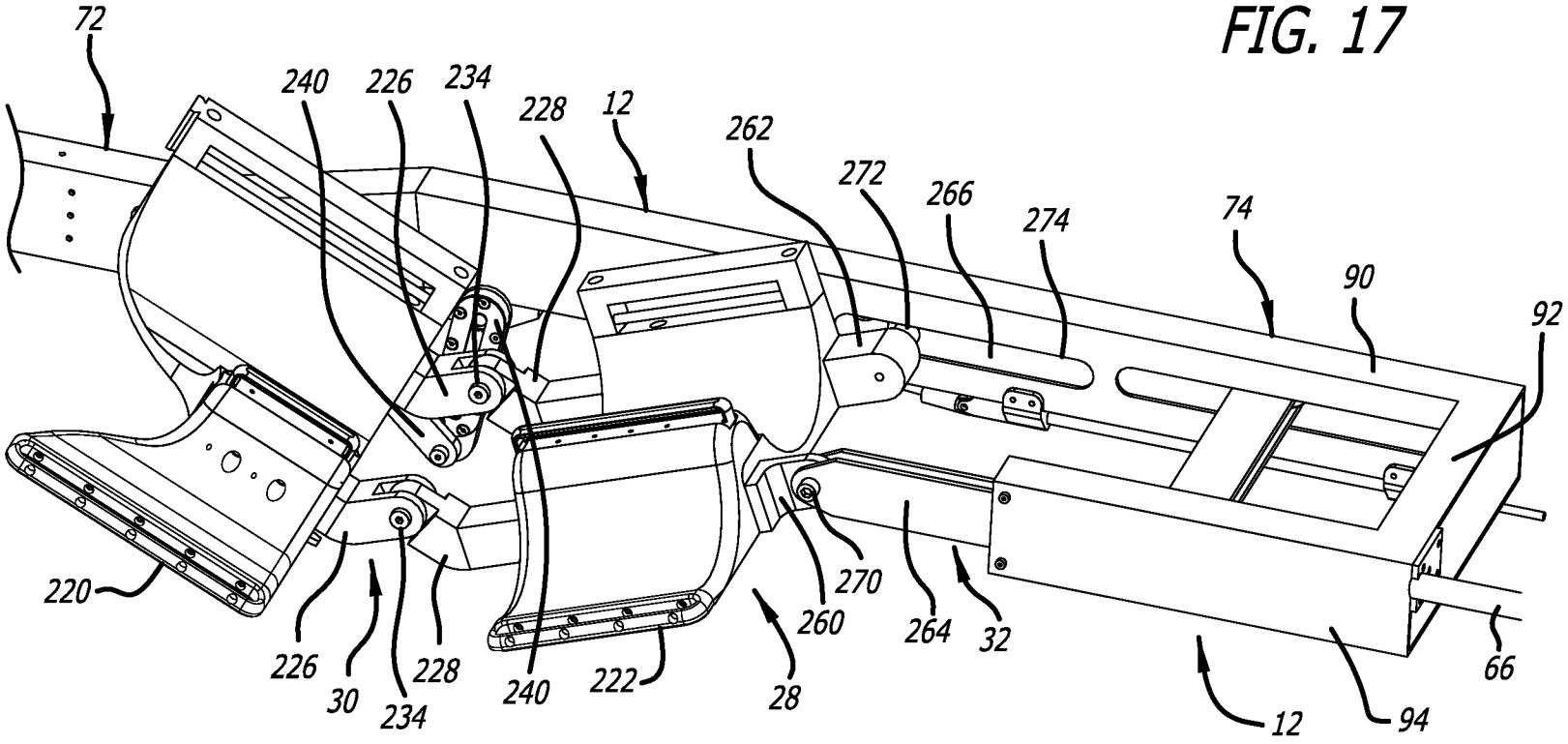
FIG. 17 is an enlarged top perspective view of portions of the surgical frame of FIG. 1 showing a sagittal adjustment assembly including a pelvic-tilt mechanism and leg adjustment mechanism.

As depicted in FIGS. 16 and 17, for example, the sagittal adjustment assembly 28 includes the pelvic-tilt mechanism 30 for supporting the thighs and lower legs of the patient P. The pelvic-tilt mechanism 30 includes a thigh cradle 220 configured to support the patient's thighs, and a lower leg cradle 222 configured to support the patient's shins. Different sizes of thigh and lower leg cradles can be used to accommodate different sizes of patients, i.e., smaller thigh and lower leg cradles can be used with smaller patients, and larger thigh and lower leg cradles can be used with larger patients. Soft straps (not shown) can be used to secure the patient P to the thigh cradle 220 and the lower leg cradle 222. The thigh cradle 220 and the lower leg cradle 222 are moveable and pivotal with respect to one another and to the offset main beam 12. To facilitate rotation of the patient's hips, the thigh cradle 220 and the lower leg cradle 222 can be positioned anterior and inferior to the patient's hips.

Figure 18:
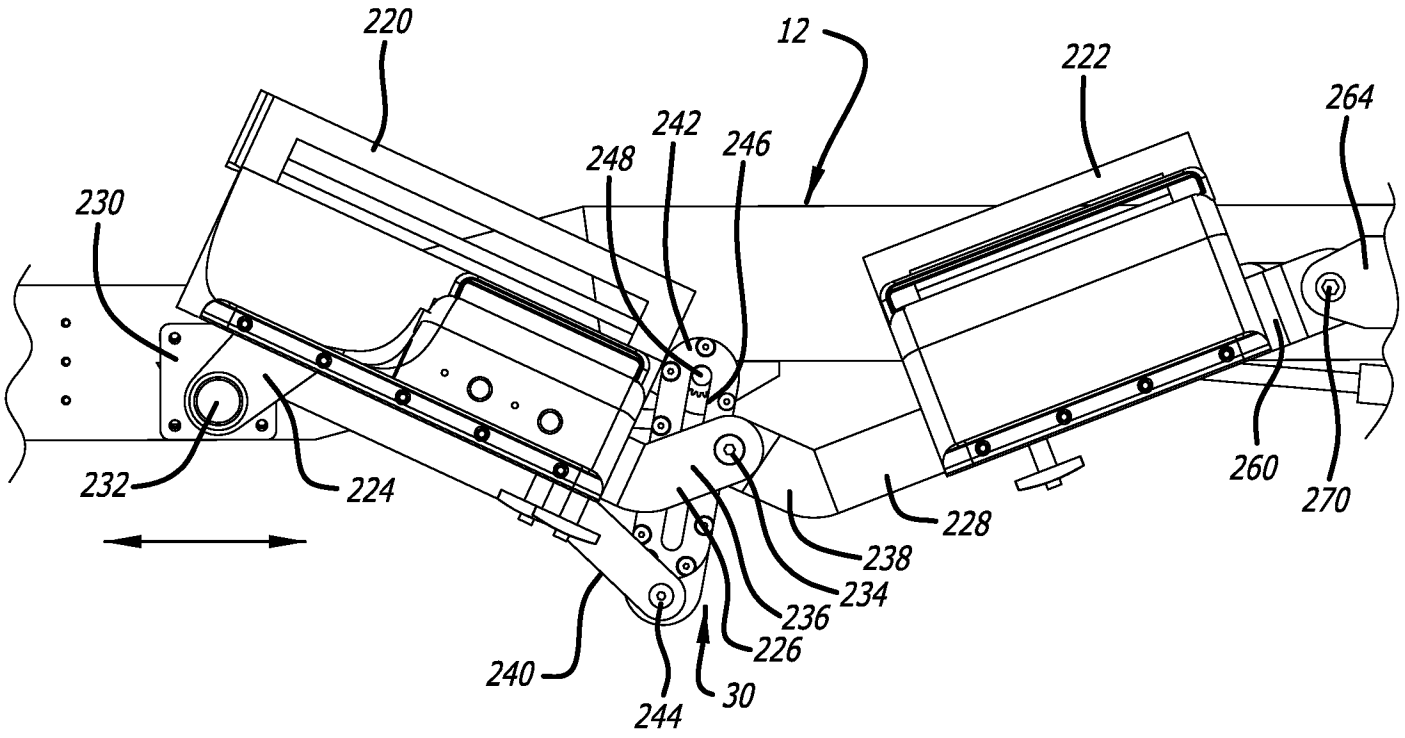
FIG. 18 is an enlarged side elevational view of portions of the surgical frame of FIG. 1 showing the pelvic-tilt mechanism.
Figure 25:
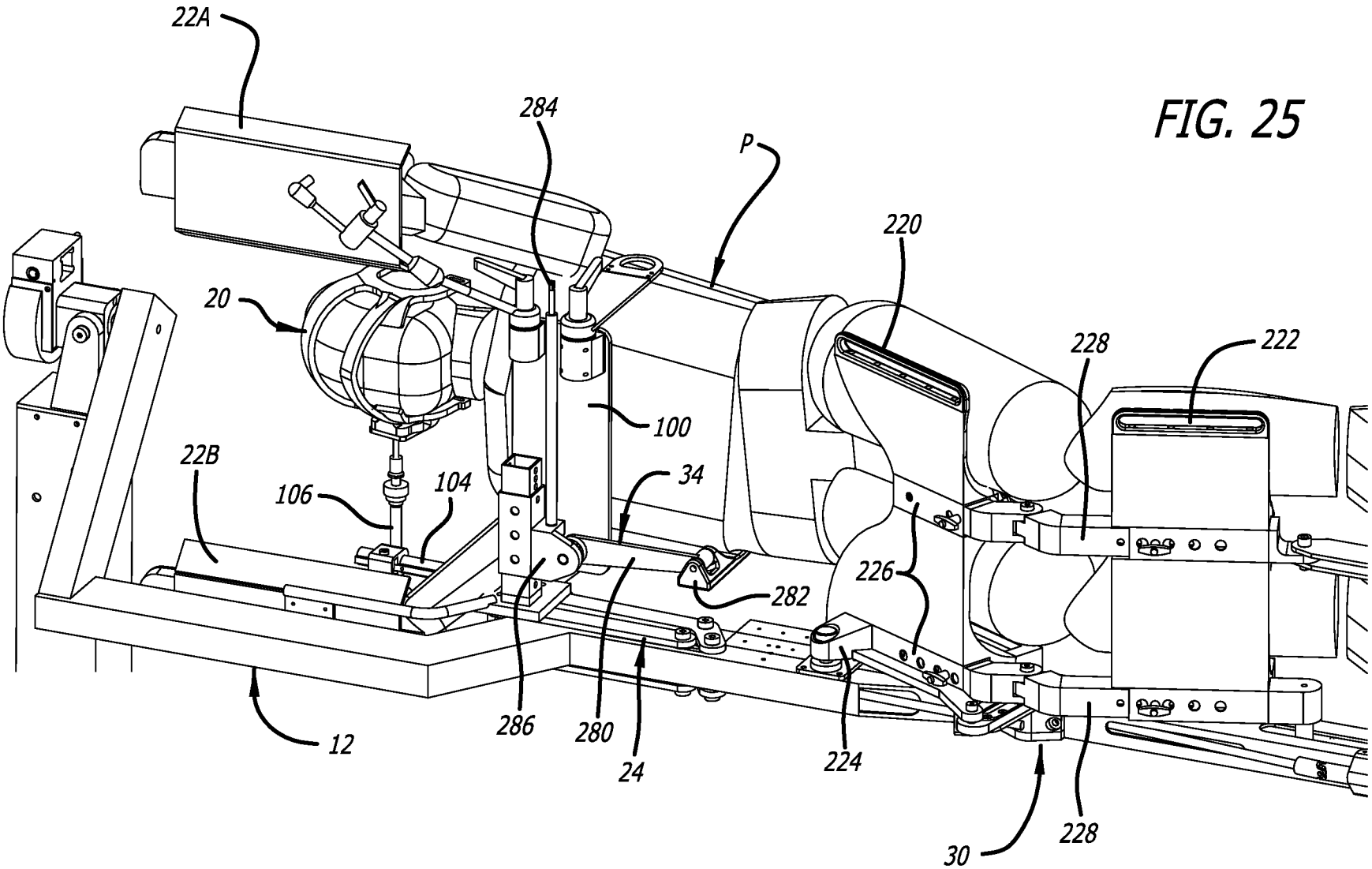
FIG. 25 is a top perspective view of portions of the surgical frame of FIG. 1 showing operation of the coronal adjustment assembly.

As depicted in FIGS. 18 and 25, for example, a first support strut 224 and second support struts 226 are attached to the thigh cradle 220. Furthermore, third support struts 228 are attached to the lower leg cradle 222. The first support strut 224 is pivotally attached to the offset main beam 12 via a support plate 230 and a pin 232, and the second support struts 226 are pivotally attached to the third support struts 228 via pins 234. The pins 234 extend through angled end portions 236 and 238 of the second and third support struts 226 and 228, respectively. Furthermore, the lengths of second and third support struts 226 and 228 are adjustable to facilitate expansion and contraction of the lengths thereof.

To accommodate patients with different torso lengths, the position of the thigh cradle 220 can be adjustable by moving the support plate 230 along the offset main beam 12. Furthermore, to accommodate patients with different thigh and lower leg lengths, the lengths of the second and third support struts 226 and 228 can be adjusted.

Figure 19:
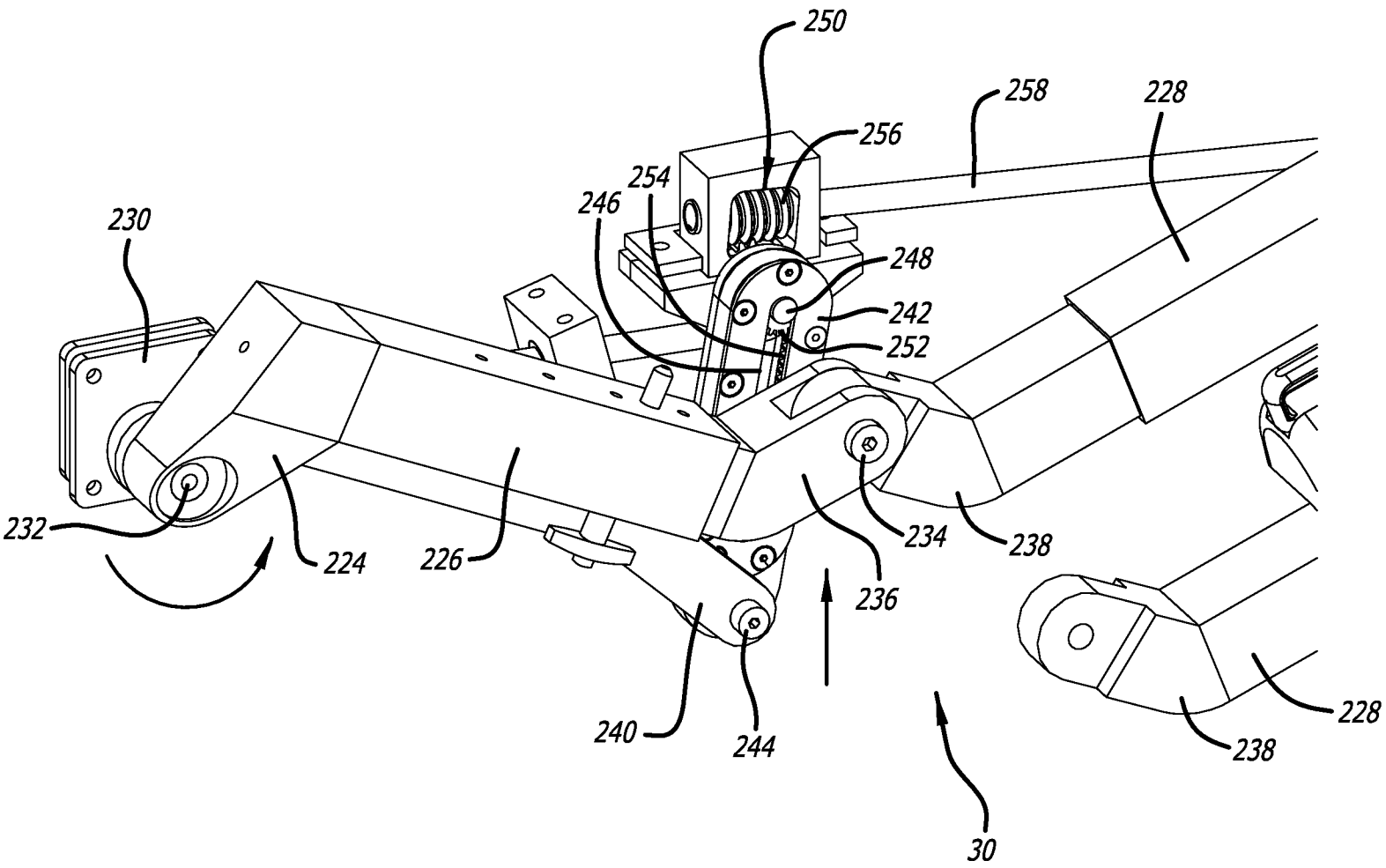
FIG. 19 is an enlarged perspective view of componentry of the pelvic-tilt mechanism.
Figure 20:
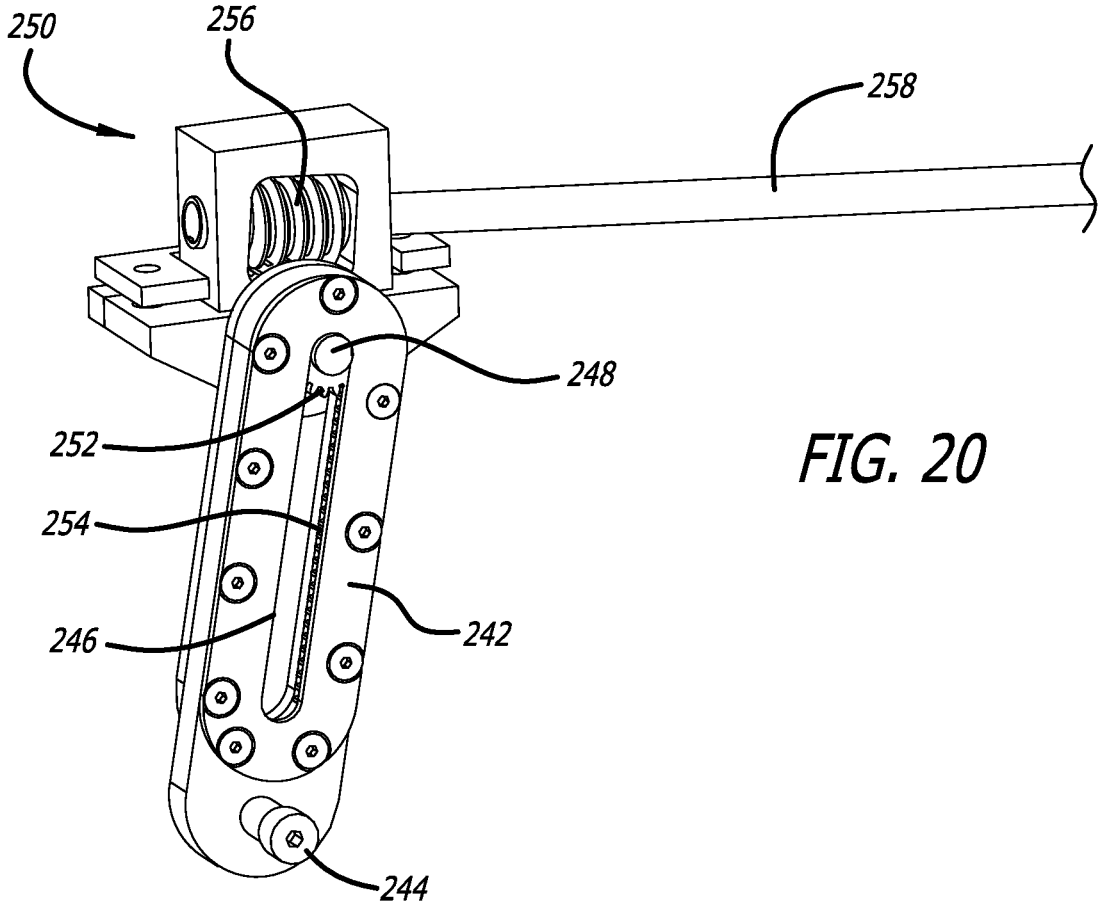
FIG. 20 is an enlarged perspective view of a captured rack and a worm gear assembly of the componentry of the pelvic-tilt mechanism.
Figure 21:
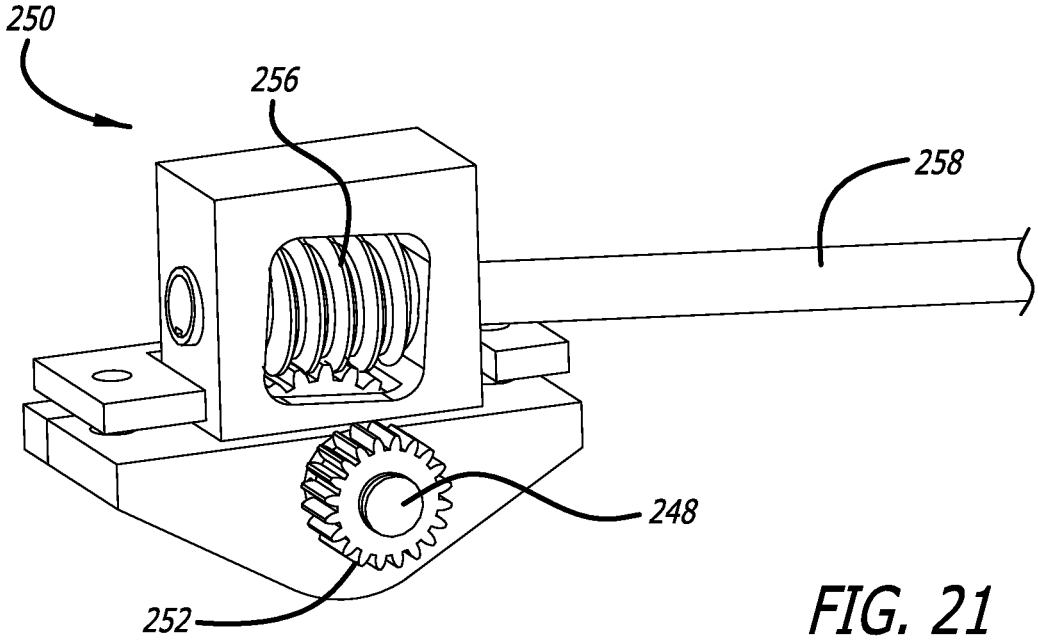
FIG. 21 is an enlarged perspective view of the worm gear assembly of FIG. 20.

To control the pivotal angle between the second and third support struts 226 and 228 (and hence, the pivotal angle between the thigh cradle 220 and lower leg cradle 222), a link 240 is pivotally connected to a captured rack 242 via a pin 244. The captured rack 242 includes an elongated slot 246, through which is inserted a worm gear shaft 248 of a worm gear assembly 250. The worm gear shaft 248 is attached to a gear 252 provided on the interior of the captured rack 242. The gear 252 contacts teeth 254 provided inside the captured rack 242, and rotation of the gear 252 (via contact with the teeth 254) causes motion of the captured rack 242 upwardly and downwardly. The worm gear assembly 250, as depicted in FIGS. 19-21, for example, includes worm gears 256 which engage a drive shaft 258, and which are connected to the worm gear shaft 248.

The worm gear assembly 250 also is configured to function as a brake, which prevents unintentional movement of the sagittal adjustment assembly 28. Rotation of the drive shaft 258 causes rotation of the worm gears 256, thereby causing reciprocal vertical motion of the captured rack 242. The vertical reciprocal motion of the captured rack 242 causes corresponding motion of the link 240, which in turn pivots the second and third support struts 226 and 228 to correspondingly pivot the thigh cradle 220 and lower leg cradle 222. A servomotor (not shown) interconnected with the drive shaft 258 can be computer controlled and/or operated by the operator of the surgical frame 10 to facilitate controlled reciprocal motion of the captured rack 242.

The sagittal adjustment assembly 28 also includes the leg adjustment mechanism 32 facilitating articulation of the thigh cradle 220 and the lower leg cradle 222 with respect to one another. In doing so, the leg adjustment mechanism 32 accommodates the lengthening and shortening of the patient's legs during bending thereof. As depicted in FIG. 17, for example, the leg adjustment mechanism 32 includes a first bracket 260 and a second bracket 262 attached to the lower leg cradle 222. The first bracket 260 is attached to a first carriage portion 264, and the second bracket 262 is attached to a second carriage portion 266 via pins 270 and 272, respectively. The first carriage portion 264 is slidable within third portion 94 of the rear portion 74 of the offset main beam 12, and the second carriage portion 266 is slidable within the first portion 90 of the rear portion 74 of the offset main beam 12. An elongated slot 274 is provided in the first portion 90 to facilitate engagement of the second bracket 262 and the second carriage portion 266 via the pin 272. As the thigh cradle 220 and the lower leg cradle 222 articulate with respect to one another (and the patient's legs bend accordingly), the first carriage 264 and the second carriage 266 can move accordingly to accommodate such movement.

Figure 22:
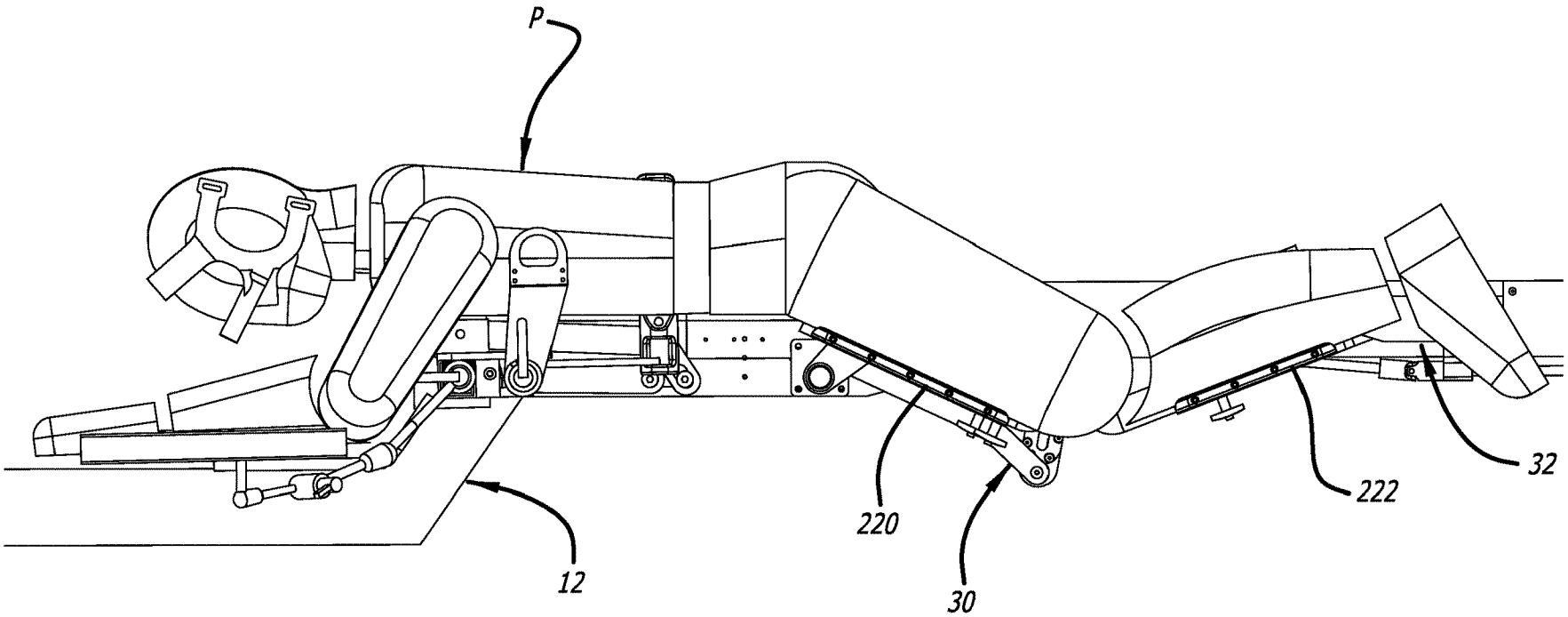
FIG. 22 is a side elevational view of portions of the surgical frame of FIG. 1 showing the patient positioned thereon and the pelvic-tilt mechanism of the sagittal adjustment assembly in the flexed position.
Figure 23:
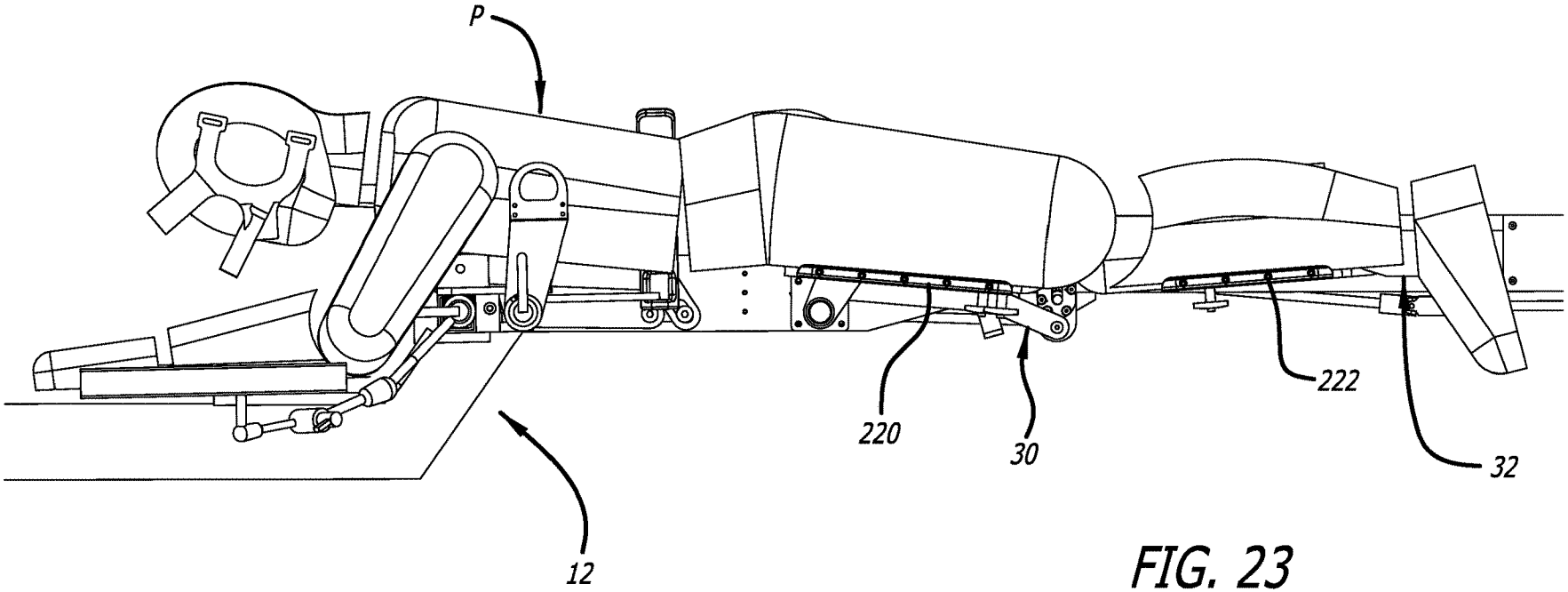
FIG. 23 is another side elevational view of portions of the surgical frame of FIG. 1 showing the patient positioned thereon and the pelvic-tilt mechanism of the sagittal adjustment assembly in the fully extended position.

The pelvic-tilt mechanism 30 is movable between a flexed position and a fully extended position. As depicted in FIG. 22, in the flexed position, the lumbar spine is hypo-lordosed. This opens the posterior boundaries of the lumbar vertebral bodies and allows for easier placement of any interbody devices. The lumbar spine stretches slightly in this position. As depicted in FIG. 23, in the extended position, the lumbar spine is lordosed. This compresses the lumbar spine. When posterior fixation devices, such as rods and screws, are placed, optimal sagittal alignment can be achieved. During sagittal alignment, little to negligible angle change occurs between the thighs and the pelvis. The pelvic-tilt mechanism 30 also can hyper-extend the hips as a means of lordosing the spine, in addition to tilting the pelvis. One of ordinary skill will recognize, however, that straightening the patient's legs does not lordose the spine. Leg straightening is a consequence of rotating the pelvis while maintaining a fixed angle between the pelvis and the thighs.

The sagittal adjustment assembly 28, having the configuration described above, further includes an ability to compress and distract the spine dynamically while in the lordosed or flexed positions. The sagittal adjustment assembly 28 also includes safety stops (not shown) to prevent over-extension or compression of the patient, and sensors (not shown) programmed to send patient position feedback to the safety stops.

Figure 24:
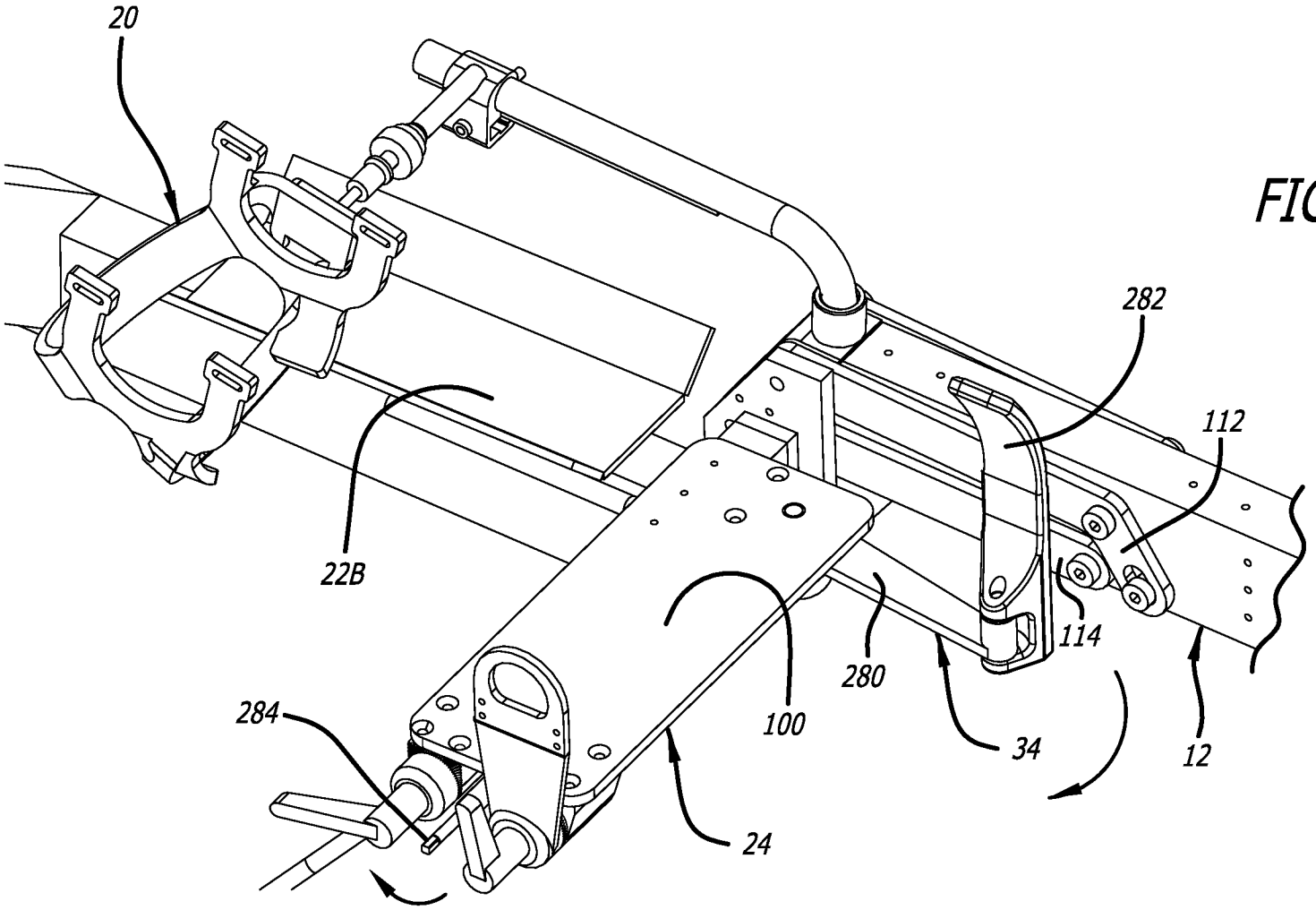
FIG. 24 is an enlarged top perspective view of portions of the surgical frame of FIG. 1 showing a coronal adjustment assembly.
Figure 26:
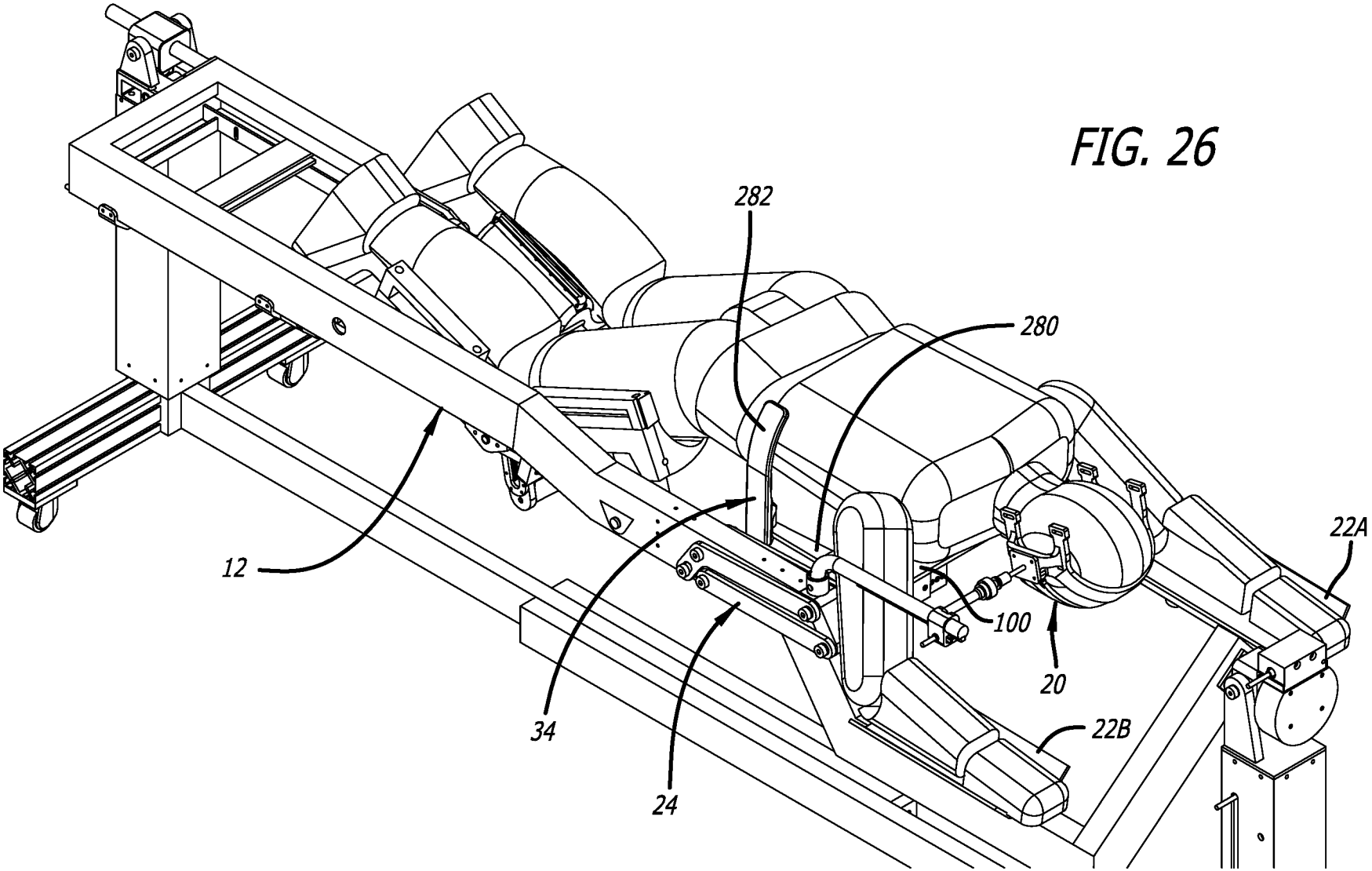
FIG. 26 is a top perspective view of a portion of the surgical frame of FIG. 1 showing operation of the coronal adjustment assembly.
Figure 27:
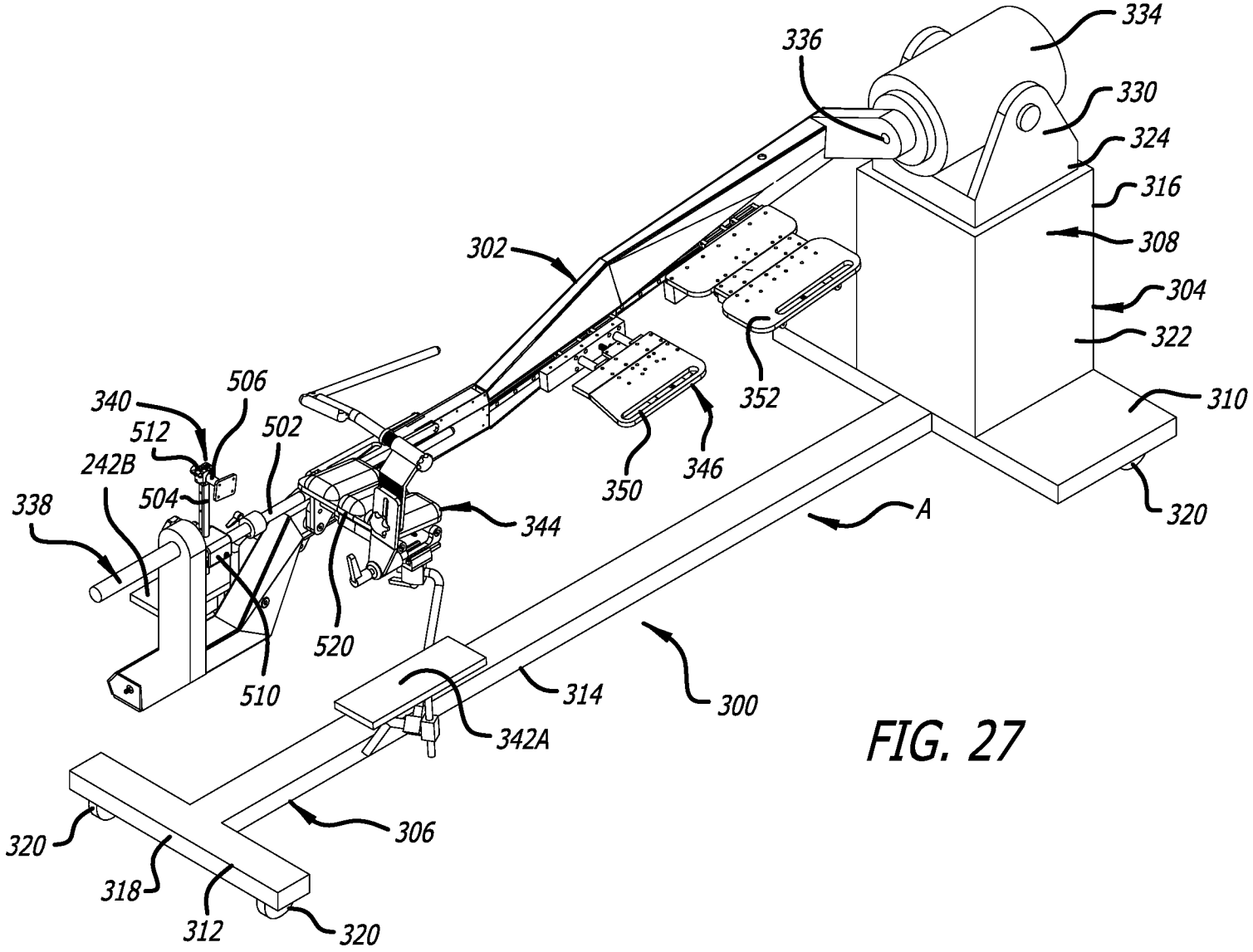
FIG. 27 is a top perspective view of a surgical frame in accordance with an embodiment of the present invention showing a main beam thereof positioned in a first vertical position and a first rotational position.
Figure 28:
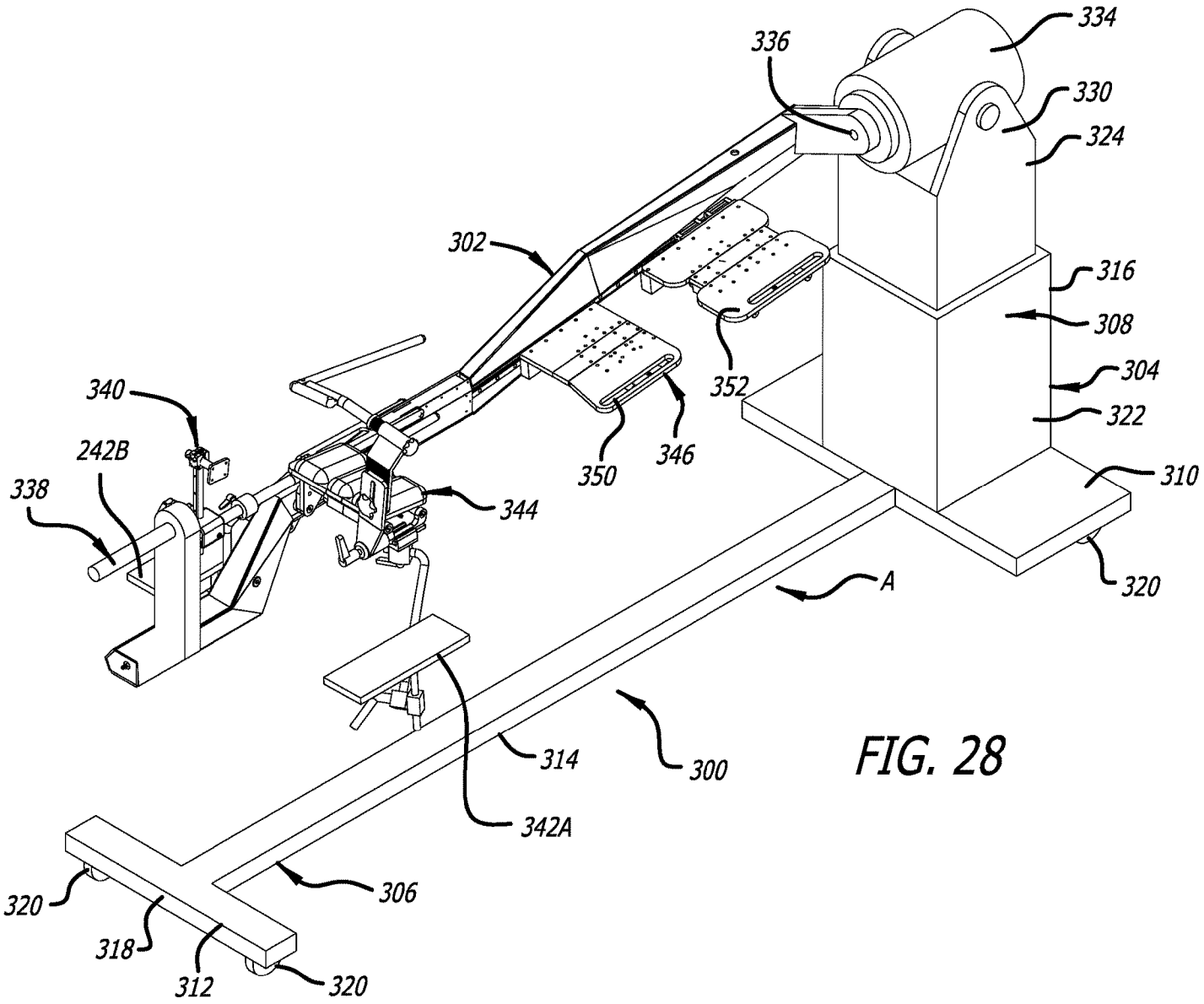
FIG. 28 is another top perspective view of the surgical frame of FIG. 27 showing the main beam positioned in a second vertical position and the first rotational position.
Figure 29:
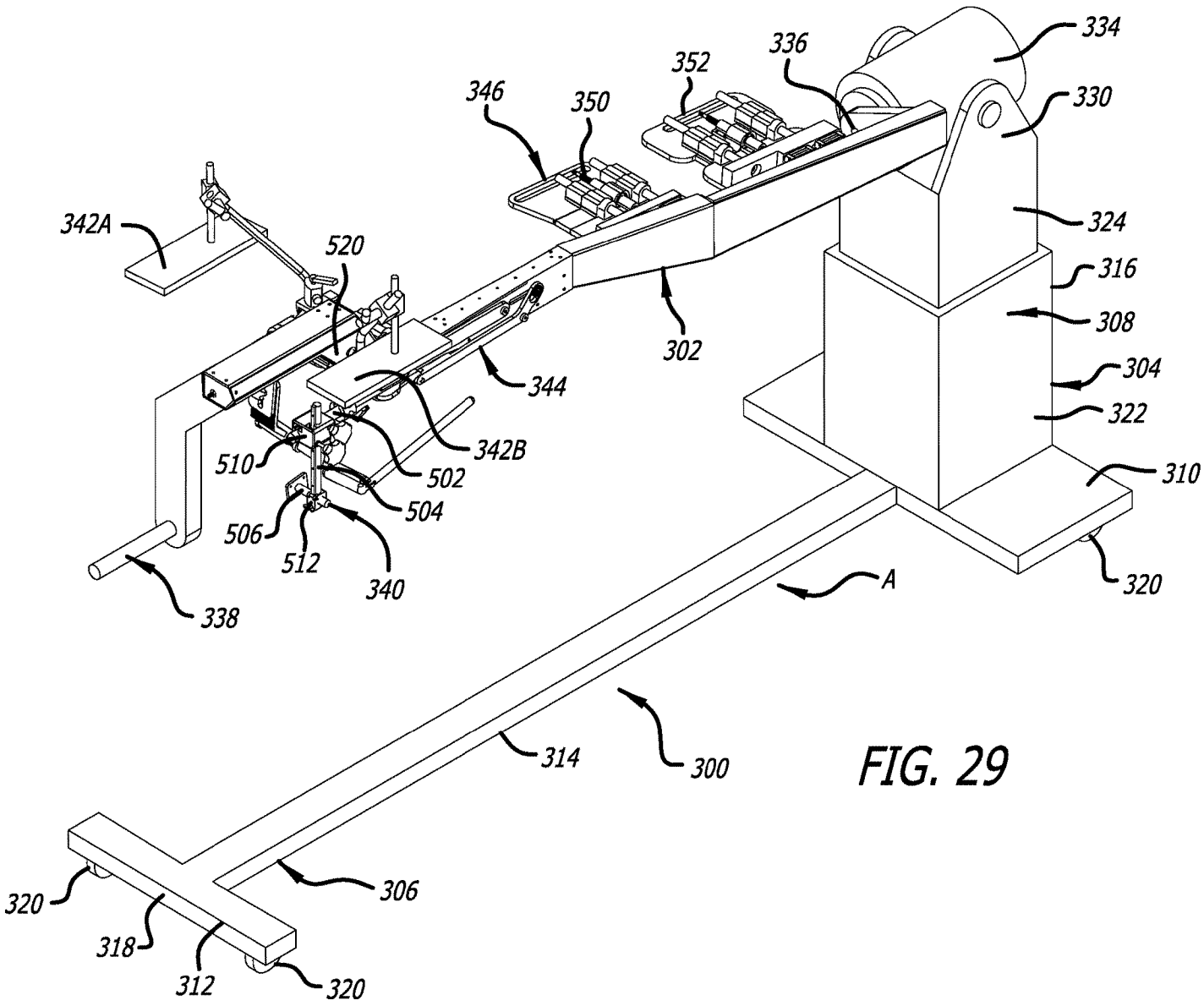
FIG. 29 is another top perspective view of the surgical frame of FIG. 27 showing the main beam positioned in the second vertical position and a second rotational position.

As depicted in FIGS. 24-26, for example, the coronal adjustment assembly 34 is configured to support and manipulate the patient's torso, and further to correct a spinal deformity, including but not limited to a scoliotic spine. As depicted in FIGS. 24-26, for example, the coronal adjustment assembly 34 includes a lever 280 linked to an arcuate radio-lucent paddle 282. As depicted in FIGS. 24 and 25, for example, a rotatable shaft 284 is linked to the lever 280 via a transmission 286, and the rotatable shaft 284 projects from an end of the chest support plate 100. Rotation of the rotatable shaft 284 is translated by the transmission 286 into rotation of the lever 280, causing the paddle 282, which is linked to the lever 280, to swing in an arc. Furthermore, a servomotor (not shown) interconnected with the rotatable shaft 284 can be computer controlled and/or operated by the operator of the surgical frame 10 to facilitate controlled rotation of the lever 280.

As depicted in FIG. 24, for example, adjustments can be made to the position of the paddle 282 to manipulate the torso and straighten the spine. As depicted in FIG. 25, when the offset main beam 12 is positioned such that the patient P is positioned in a lateral position, the coronal adjustment assembly 34 supports the patient's torso. As further depicted in FIG. 26, when the offset main beam 12 is positioned such that the patient P is positioned in a prone position, the coronal adjustment assembly 34 can move the torso laterally, to correct a deformity, including but not limited to a scoliotic spine. When the patient is strapped in via straps (not shown) at the chest and legs, the torso is relatively free to move and can be manipulated. Initially, the paddle 282 is moved by the lever 280 away from the offset main beam 12. After the paddle 282 has been moved away from the offset main beam 12, the torso can be pulled with a strap towards the offset main beam 12. The coronal adjustment assembly 34 also includes safety stops (not shown) to prevent over-extension or compression of the patient, and sensors (not shown) programmed to send patient position feedback to the safety stops.

Preferred embodiments of a surgical frame configured to afford transfer of a patient from and to a surgical table/gurney T are generally indicated by the numeral 300 in FIGS. 27-34 and the numeral 400 in FIGS. 35-40. The surgical frames 300 and 400 serve as an exoskeleton to support the body of the patient P as the patient's body is manipulated thereby. In doing so, the surgical frames 300 and 400 serve to support the patient P such that the patient's spine does not experience unnecessary stress/torsion. As discussed below, the surgical frames 300 and 400 are configured to facilitate transfer of the patient P from the surgical table/gurney T thereto.

The surgical frame 300 is configured to provide a relatively minimal amount of structure adjacent the patient's spine to facilitate access thereto by a surgeon and/or a surgical assistant and to improve the quality of imaging available before, during, and even after surgery. Thus, the workspace around the patient P positioned on the surgical frame 300 and imaging access are thereby increased using the surgical frame 300. Furthermore, radio-lucent or low magnetic susceptibility materials can be used in constructing the structural components adjacent the patient's spine in order to further enhance imaging quality.

As depicted in FIGS. 27-34, the surgical frame 300 includes a main beam 302 and a support structure 304. The main beam 302 extends along a substantial portion of the length of the surgical frame 300, and is spaced from and supported over the ground by the support structure 304. As discussed below, the surgical frame 300 is configured to afford ease of transfer of the patient P from the surgical table/gurney T thereto. As such, the surgical frame 300 affords transfer thereto without subjecting the patient's spine to unnecessary stress/torsion.

The main beam 302 can be rotated a full 360° before, during, and even after surgery to facilitate various positions of the patient P to afford various surgical pathways to the patient's spine depending on the surgery to be performed. As such, the main beam 302 can be positioned to place the patient P in a prone position (e.g., FIG. 34), a lateral position, and in a position 45° between the prone and lateral positions. Furthermore, for example, the offset main beam 302 can be rotated to afford anterior, posterior, lateral, anterolateral, and posterolateral pathways to the spine. As such, the patient's body can be flipped numerous times before, during, and even after surgery without compromising sterility or safety. Also, as discussed below, the main beam 302 can be positioned to aid ease of transfer of the patient P from the surgical table/gurney T to the surgical frame 300. By appropriately positioning the main beam 302, the patient P can be positioned in the supine position on the surgical table/gurney T (FIGS. 30 and 31), and then be transferred to the surgical frame 300 such that the surgical frame 300 supports the patient P. The surgical frame 300 can be configured to lift the patient P from the surgical table/gurney T, and thereafter, the surgical frame 300 can position and reposition the patient P as desired.

As depicted in FIGS. 27-40, the support structure 304 includes a support platform 306 and a support portion 308. The support platform 306 includes a first leg portion 310, a second leg portion 312, and a connecting member portion 314 joining the first and second leg portions 310 and 312 to one another. As such, the first leg portion 310, the second leg portion 312, and the connecting member portion 314 together form a capital "I" shape. The support structure 304 has a first end 316 and a second end 318, and the first leg portion 310 is provided at the first end 316 and the second leg portion 312 is provided at the second end 318.

Casters 320 can be attached to the support platform 306 to afford ease of movement of the surgical frame 300. The first and second leg portions 310 and 312 can be sized, and the casters 320 can be attached at or adjacent to the ends of the first and second leg portions 310 and 312 to provide stability to the surgical frame 300.

The support portion 308, as depicted in FIGS. 27-34, is provided at and extends upwardly from the first end 316 of the support platform 306. The support portion 308 can be removably attached to the support platform 306. Furthermore, the support portion 308 is capable of expanding in order to change the height of the main beam 302. To that end, the support portion 308 includes a lower first portion 322 and an upper second portion 324, and the upper second portion 324 is moveable upwardly and downwardly with respect to the lower first portion 322 via telescoping movement. The upper second portion 324 is moveable between a lower position (e.g., FIG. 27) and an upper position (e.g., FIG. 28). The support portion 308 can be configured to include, for example, a motor or motors, hydraulics, and/or pneumatics (not shown) to facilitate such telescoping action. As discussed below, using the telescoping movement afforded by the support portion 308, the main beam 302 can be raised and lowered to facilitate contact with the patient P on the surgical table/gurney T. Furthermore, the telescoping movement, as discussed below, also affords corresponding movement of the patient P when received on the surgical frame 300 before, during, and even after surgery.

As depicted in FIGS. 27-34, the upper second portion 324 includes a clevis 330 attached to or formed thereon. The clevis 330 pivotally supports a rotator such as motor and motor housing 334 thereon, and the motor and motor housing 334 is interconnected with the main beam 302. Additionally, the clevis 330 can include a pivoter such as a motor or motors, hydraulics, and/or pneumatics (not shown) to facilitate pivotal movement of the motor and motor housing 334 on the clevis 330. As discussed below, using the pivotal movement afforded by the clevis 330, the main beam 302 can be pivoted upwardly and downwardly to facilitate contact with the patient P on the surgical table/gurney T. Furthermore, the pivotal movement, as discussed below, also affords corresponding movement of the patient P when received on the surgical frame 300 before, during, and even after surgery. The pivotal movement of the main beam 302 allows the patient P to be positioned in Trendelenburg and reverse Trendelenburg positions.

The rotator such as the motor and motor housing 334, as depicted in FIGS. 27-29 and 34, is interconnected with the main beam 302 via a rotatable shaft 336. For example, the motor and motor housing 334 can include a stepper motor serving to facilitate selectable rotatable positioning of the rotatable shaft 336, or can include a motor and a transmission (not shown) also serving to facilitate selectable rotatable positioning of the rotatable shaft 336 and the main beam 302 attached thereto. A counter-weight (not shown) can be provided to balance the weight of the main beam 302 and the patient P positioned thereon. The surgical frame 300 can also be configured to rotate the rotatable shaft 336 (and the main beam 302 attached thereto) by a hand crank 338 and, if necessary, a transmission mechanism (not shown). As discussed below, using selectable rotational movement, the rotatable shaft 336 and the main beam 302 attached thereto can be rotated clockwise and counter-clockwise to facilitate contact with the patient P on the surgical table/gurney T. Furthermore, the rotatable movement, as discussed below, also affords corresponding movement of the patient P when received on the surgical frame 300 before, during, and even after surgery.

To engage and support the patient P, the main beam 302 can include various support components that directly contact and support the patient P. For example, as depicted in FIGS. 27-34, the main beam 302 can include a head support 340, arm supports 342A and 342B, a torso-lift support 344, and a leg support 346. The head support 340 can be similar to the head support 20, the arm supports 342A and 342B can be similar to the arm supports 22A and 22B, and the torso-lift support 344 can be similar to the torso-lift supports 24 and 160. A head support similar to the head support 340 is also provided for use with the surgical frame 400, and the description of the surgical frame 400 in this regard is also applicable to the surgical frame 300. Furthermore, while the leg support 346 includes an upper leg support portion 350 and a lower leg support portion 352 that are moveable apart and with respect to one another, the leg support 346 can have a hinged configuration similar to that of the sagittal adjustment assembly 28.

The support components of the surgical frame 300 can be configured to further manipulate the position of the patient's body. Furthermore, the operation of the support components of the surgical frame 300 can be mechanized. For example, motors (not shown) can be provided to drive operation of the torso-lift support 344 and the leg support 346 and correspondingly adjust the patient's body. As such, an operator such as a surgeon and/or a surgical assistant can control actuation of the various support components to manipulate the position of the patient's body, and such manipulation and positioning of the patient P affords a surgeon and/or a surgical assistant significant access to the patient's body.

Like the surgical frame 300, the surgical frame 400 is configured to provide a relatively minimal amount of structure adjacent the patient's spine to facilitate access by a surgeon and/or a surgical assistant thereto and to improve the quality of imaging available before, during, and even after surgery. Thus, the workspace around the patient P positioned on the surgical frame 400 and imaging access are thereby increased using the surgical frame 400. Furthermore, radio-lucent or low magnetic susceptibility materials can be used in constructing the structural components adjacent the patient's spine in order to further enhance imaging quality.

As depicted in FIGS. 35, 36, 39, and 40, the surgical frame 400 includes a main beam 402 and a support structure 404. The main beam 402 extends along a substantial portion of the length of the surgical frame 400, and is spaced from and supported over the ground by the support structure 404. As discussed below, the surgical frame 400 is configured to afford ease of transfer of the patient P from the surgical table/gurney T thereto. As such, the surgical frame 400 affords transfer thereto without subjecting the patient's spine to unnecessary stress/torsion.

The main beam 402 can be rotated a full 360° before, during, and even after surgery to facilitate various positions of the patient P to afford various surgical pathways to the patient's spine depending on the surgery to be performed. As such, the main beam 402 can be positioned to place the patient P in a prone position (e.g., FIG. 40), a lateral position, and in a position 45° between the prone and lateral positions. Furthermore, for example, the offset main beam 402 can be rotated to afford anterior, posterior, lateral, anterolateral, and posterolateral pathways to the spine. As such, the patient's body can be flipped numerous times before, during, and even after surgery without compromising sterility or safety. Also, as discussed below, the main beam 402 can be positioned to aid ease of transfer of the patient P from the surgical table/gurney T to the surgical frame 400. By appropriately positioning the main beam 402, the patient P can be positioned in the supine position on the surgical table/gurney T (FIGS. 35-37), and then be transferred to the surgical frame 400 such that the surgical frame 400 supports the patient P. The surgical frame 400 can be configured to lift the patient P from the surgical table/gurney T, and thereafter, the surgical frame 400 can position and reposition the patient P as desired.

As depicted in FIGS. 35, 36, 39, and 40, the support structure 404 includes a support platform 406, a first support portion 408A, and a second support portion 408B. The support platform 406 includes a first leg portion 410 attached to the first support portion 408A, a second leg portion 412 attached to the second support portion 408B, and a connecting member portion 414 joining the first and second leg portions 410 and 412, the first support portion 408A, and the second support portion 408B to one another. The first leg portion 410, the second leg portion 412, and the connecting member portion 414 together form a capital "I" shape. The first leg portion 410 is provided at a first end 416 of the support structure 404, and the second leg portion 412 is provided at a second end 418 of the support structure 404.

Casters 420 can be attached to the support platform 406 to afford ease of movement of the surgical frame 400. The first and second leg portions 410 and 412 can be sized, and the casters 420 can be attached at or adjacent to the ends of the first and second leg portions 410 and 412 to provide stability to the surgical frame 400 during movement thereof.

As depicted in FIGS. 35, 36, 39, and 40, the first support portion 408A is provided at and extends upwardly from the first end 416 of the support platform 406, and the second support portion 408B is provided at and extends upwardly from the second end 418 of the support platform 406. The first and second support portions 408A and 408B are capable of expanding in order to change the height of the main beam 402. To that end, the first and second support portions 408A and 408B each include a lower first portion 422 and an upper second portion 424, and the upper second portions 424 are moveable upwardly and downwardly with respect to the lower first portions 422 via telescoping movement. The upper second portions 424 are moveable between lower positions and upper positions. The first and second support portions 408A and 408B can be configured to include, for example, motor or motors, hydraulics, and/or pneumatics (not shown) to facilitate such telescoping action. As discussed above, using the telescoping movement afforded by the first and second support portions 408A and 408B, the main beam 402 can be raised and lowered to facilitate contact with the patient P on the surgical table/gurney T. Furthermore, the telescoping movement, as discussed below, also affords corresponding movement of the patient P when received on the surgical frame 400 before, during, and even after surgery.

As depicted in FIGS. 35, 36, 39, and 40, a first clevis 430A is formed on the upper second portion 424 of the first support portion 408A, and a second clevis 430B is formed on the upper second portion 424 of the second support portion 408B. The first clevis 430A pivotally supports a rotator (such as a motor and motor housing 432) and a first support block 434 that are interconnected with the main beam 402. Furthermore, the second clevis 430B pivotally supports a second support block 436 that is interconnected with the main beam 402.

As depicted in FIGS. 35, 36, 39, and 40, the motor and motor housing 432 and the first support block 434 are connected to the main beam 402 via a first rotatable shaft 438A, and the second support block 436 is connected to the main beam 402 via a second rotatable shaft 438B. The pivotal attachment of the motor and motor housing 432 and the first support block 434 and the pivotal attachment of the second support block 436 allows the main beam 402 to be tilted in accordance with the upward and downward movement of the first and second support portions 408A and 408B. As discussed below, using the tilting movement afforded by using the first and second clevises 430A and 430B and raising or lowering the first and second support portions 408A and 408B, the main beam 402 can be tilted to facilitate contact with the patient P on the surgical table/ gurney T. Furthermore, the tilting movement, as discussed below, affords corresponding moment of the patient P when received on the surgical frame 400 before, during, and even after surgery. The tilting movement of the main beam 402 allows the patient P to be positioned in Trendelenburg and reverse Trendelenburg positions.

As discussed above, the rotator such as the motor and motor housing 432 is interconnected with the main beam 402 via the first rotatable shaft 438A. For example, the motor and motor housing 432 can include a stepper motor serving to facilitate selectable rotatable positioning of the first rotatable shaft 438A, or can include a motor and a transmission (not shown) also serving to facilitate selectable rotatable positioning of the first rotatable shaft 438A and the main beam 402 attached thereto. A counter-weight (not shown) can be provided to balance the weight of the main beam 402 and the patient P positioned thereon. The surgical frame 400 can also be configured to rotate the first rotatable shaft 438A (and the main beam 402 attached thereto) by a hand crank (not shown) and, if necessary, a transmission mechanism (not shown). As discussed below, using selectable rotational movement, the first rotatable shaft 438A, the second rotatable shaft 438B, and the main beam 402 can be rotated clockwise and counter-clockwise to facilitate contact with the patient P on the surgical table/gurney T. Furthermore, the rotatable movement, as discussed below, also affords corresponding movement of the patient P when received on the surgical frame 400 before, during, and even after surgery.

To engage and support the patient P, the main beam 402, like the main beam 302, can include various support components that directly contact the patient P. For example, as depicted in FIGS. 35-40, the main beam 402 can include a head support 440, arm supports 442A and 442B, a torso-lift support 444, and a leg support 446. The head support 440 can be similar to head supports 20 and 340, the arm supports 442A and 442B can be similar to the arm supports 22A and 22B and the arm supports 342A and 342B, and the torso-lift support 444 can be similar to the torso-lift supports 24, 160, and 344. The description of the head support 440 and the surgical frame 400 in this regard is also applicable to the surgical frame 300. The leg support 446 can also be similar to the leg support 346. Furthermore, while the leg support 446, like the leg support 346, includes an upper leg support portion 450 and a lower leg support portion 452 that are moveable apart and with respect to one another, the leg support 446 can have a hinged configuration similar to that of the sagittal adjustment assembly 28.

The support components of the surgical frame 400 can be configured to further manipulate the position of the patient's body. Furthermore, the operation of the support components of the surgical frame 400 can be mechanized. For example, motors (not shown) can be provided to drive operation of the torso-lift support 444 and the leg support 446 and correspondingly adjust the patient's body. As such, an operator such as a surgeon and/or a surgical assistant can control actuation of the various support components to manipulate the position of the patient's body, and such manipulation and positioning of the patient P affords a surgeon and/or a surgical assistant significant access to the patient's body.

Using the above-described features, the surgical frames 300 and 400 are configured to afford ease of transfer of the patient P from a surgical table/gurney T thereto, and afford transfer thereto without subjecting the patient's spine to unnecessary stress/torsion. In doing so, the patient P can be transferred to the surgical frames 300 and 400 without manually lifting the patient P from the surgical table/gurney T.

To illustrate, by appropriately positioning the main beam 302 of the surgical frame 300 and the main beam 402 of the surgical frame 400, the patient P can be transferred from the surgical table/gurney T. As discussed above, the main beam 302 (and ultimately the patient P received thereon) can be raised and lowered by the support portion 308, the main beam 302 (and ultimately the patient P received thereon) can be pivoted upwardly and downwardly by using the clevis 330, and the main beam 302 (and ultimately the patient P received thereon) can be rotated by the motor and motor housing 334. Furthermore, as discussed above, the main beam 402 (and ultimately the patient P received thereon) can be raised and lowered by the first and second support portions 408A and 408B, the main beam 402 (and ultimately the patient P received thereon) can be tilted by using the first and second clevises 430A and 430B and raising or lowering the first and second support portions 408A and 408B, and the main beam 402 (and ultimately the patient P received thereon) can be rotated by the motor and motor housing 432.

These features afford the positioning and repositioning of the main beams 302 and 402 to facilitate contact thereof with the patient P laying on the surgical table/gurney T. That is, the adjustment of the main beams 302 and 402 using these features allows the main beams 302 and 402 to be positioned in order to contact the patient P. Thus, for example, the patient P can be positioned in the supine position on the surgical table/gurney T (FIGS. 30, 31, 35, and 36), and then be transferred to the surgical frames 300 and 400 such that the surgical frames 300 and 400 support the patient P (FIGS. 32-34 and 39-40). Soft straps (not shown) can be used to facilitate attachment of the patient P to the support components on the main beams 302 and 402. Thereafter, the surgical frames 300 and 400 can lift the patient P from the surgical table/gurney T, the surgical table/gurney T can be removed, and the patient P can be positioned and repositioned as desired using the surgical frames 300 and 400.

Figure 30:
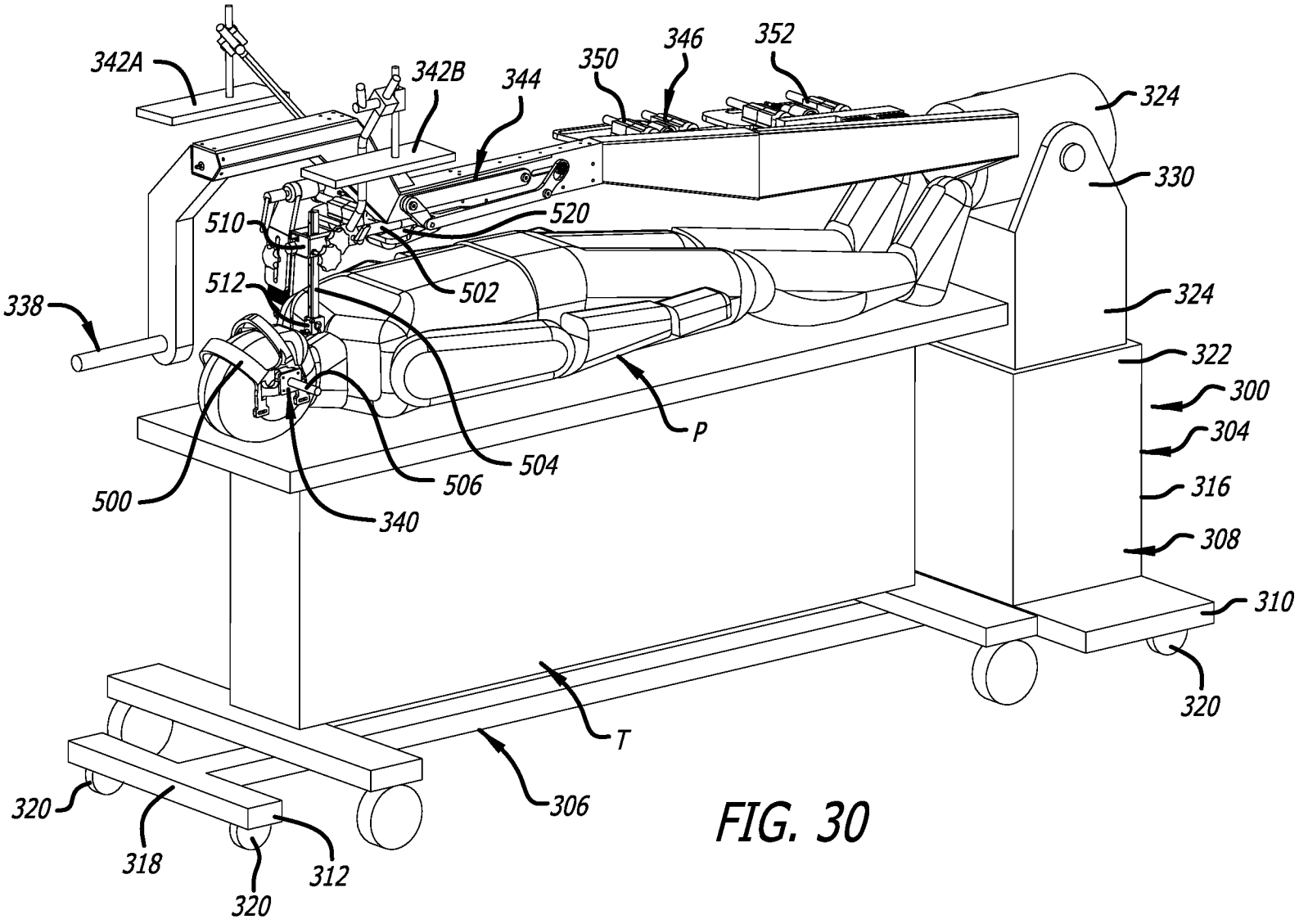
FIG. 30 is another top perspective view of the surgical frame of FIG. 27 showing the main beam positioned in the second vertical position and the second rotational position, with a surgical table/gurney and a patient laying thereon positioned under the main beam.
Figure 31:
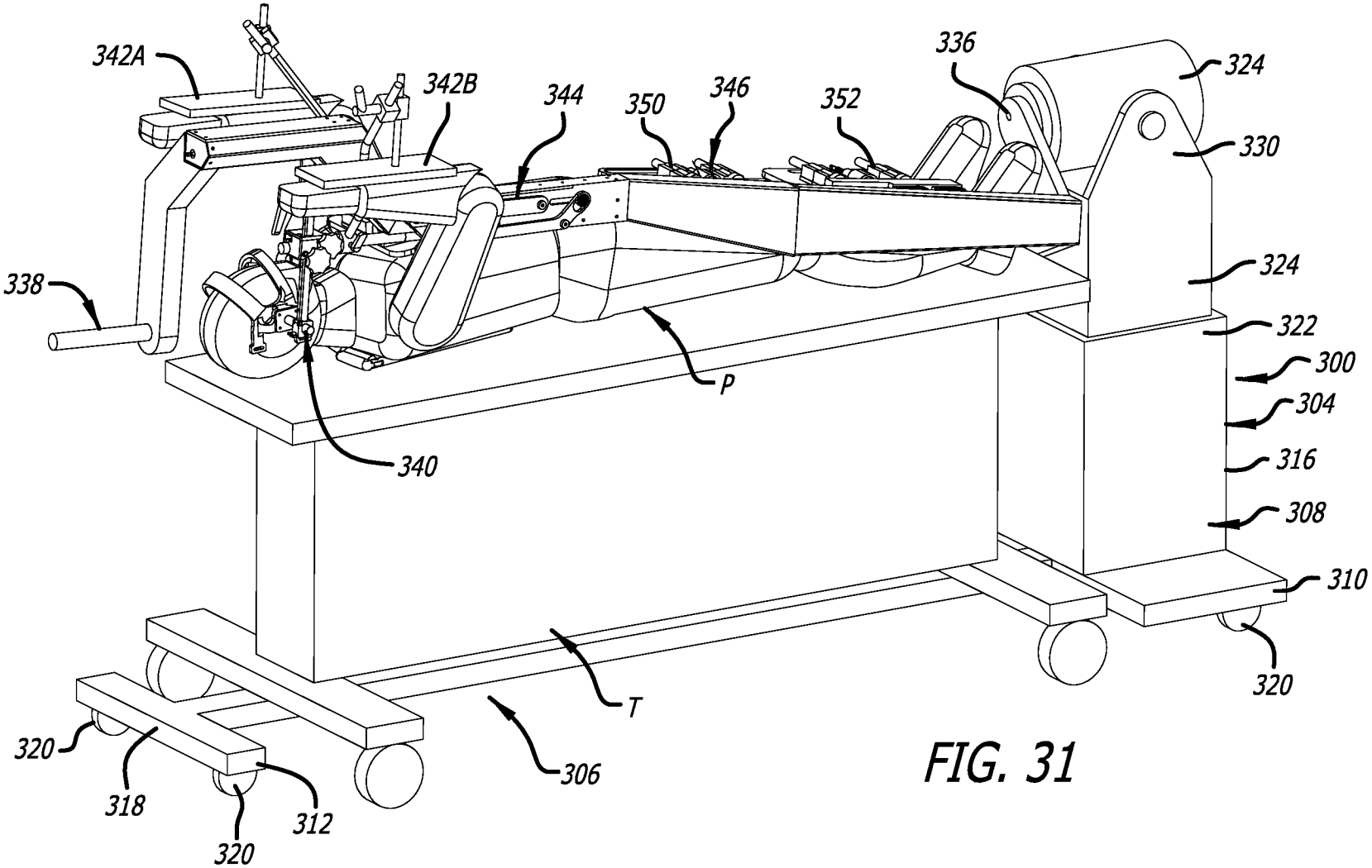
FIG. 31 is another top perspective view of the surgical frame of FIG. 27 showing the main beam positioned in a third vertical position and the second rotational position, with the main beam positioned adjacent the patient, so that the patient can be transferred from the surgical table/gurney to the main beam.
Figure 32:
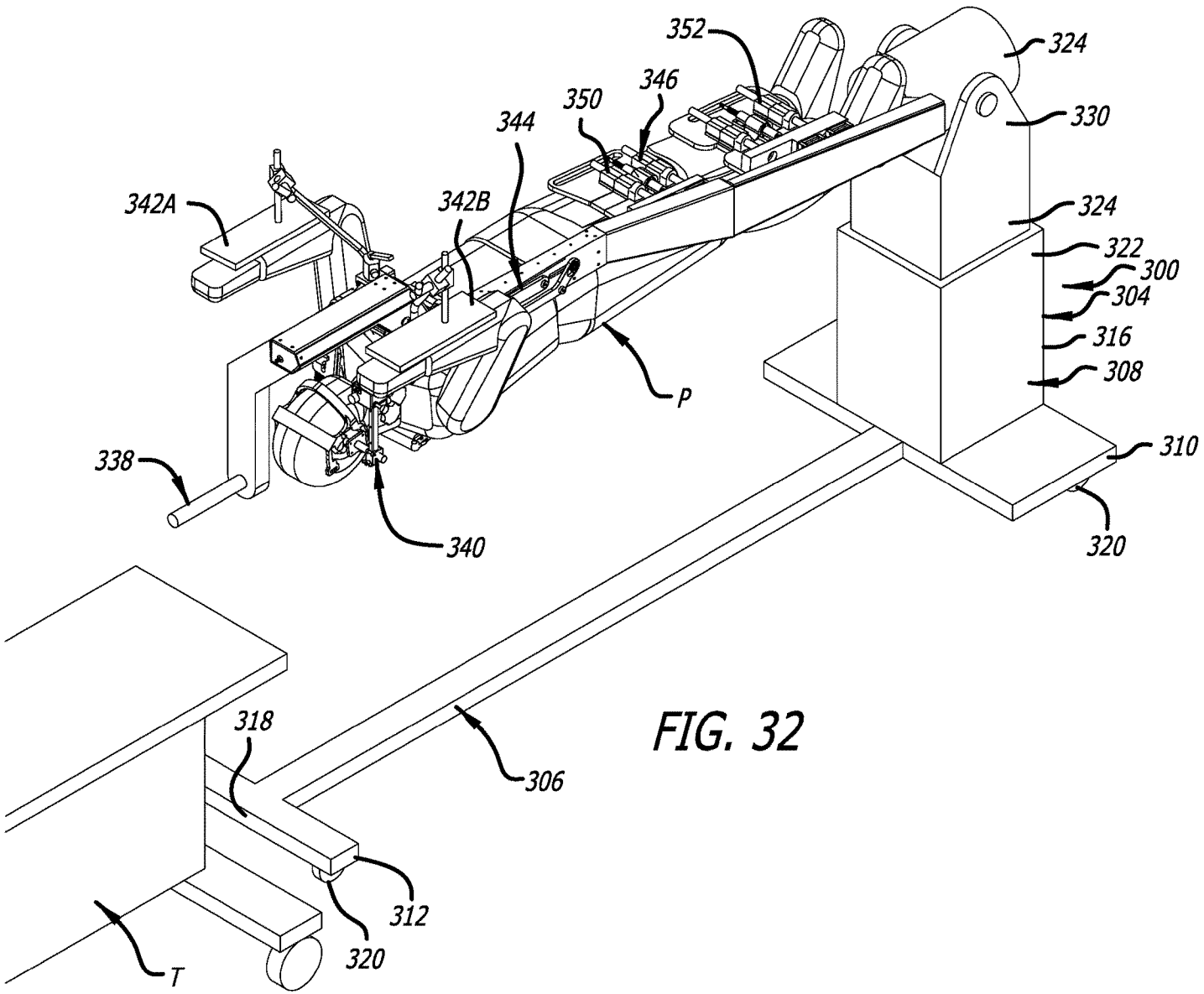
FIG. 32 is another top perspective view of the surgical frame of FIG. 27 and the patient positioned thereon showing the main beam in the second vertical position and the second rotational position, so that the surgical table/gurney can be removed from under the main beam and the patient positioned thereon.
Figure 33:
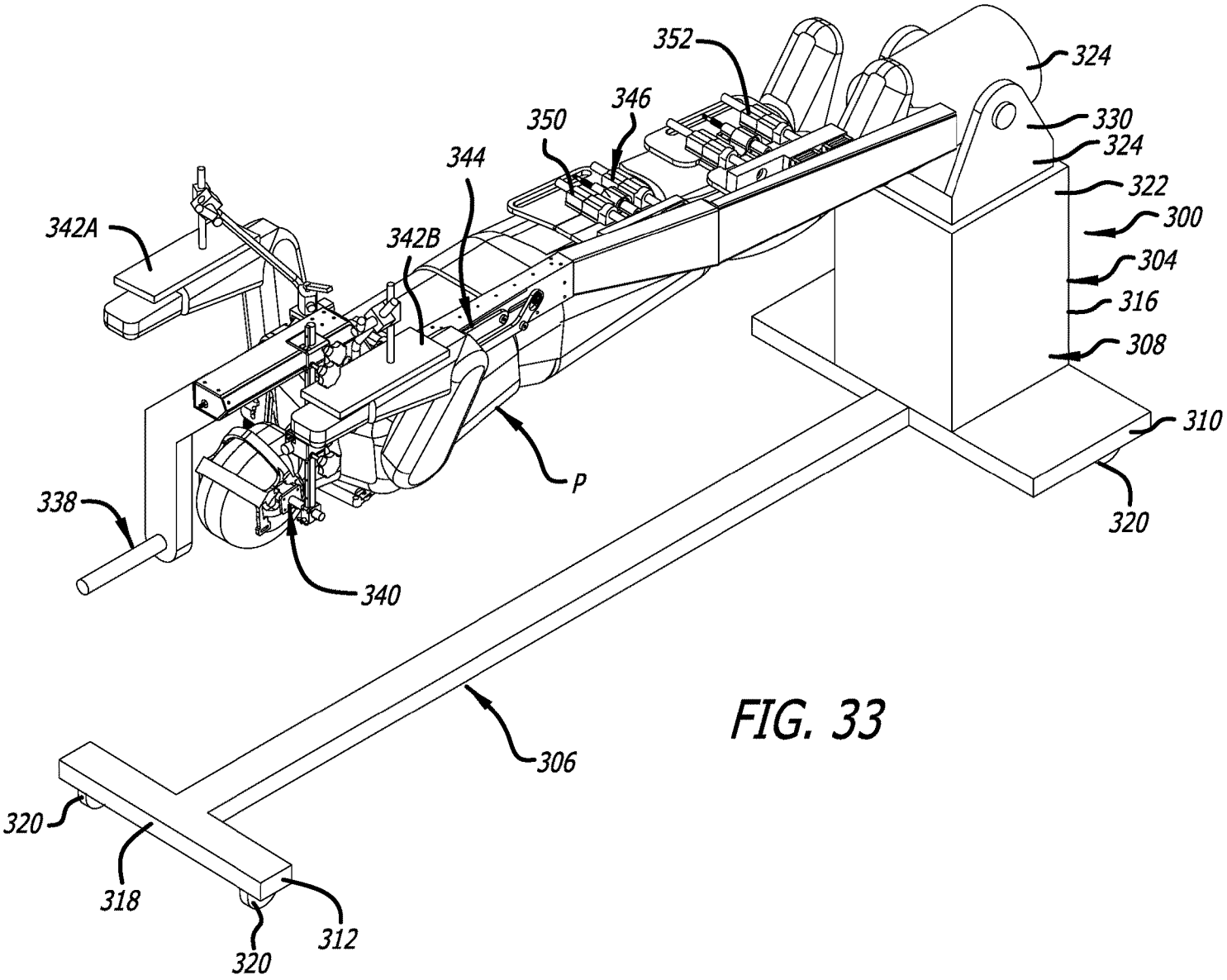
FIG. 33 is another top perspective view of the surgical frame of FIG. 27 and the patient positioned thereon showing the main beam in the first vertical position and the second rotational position.
Figure 34:
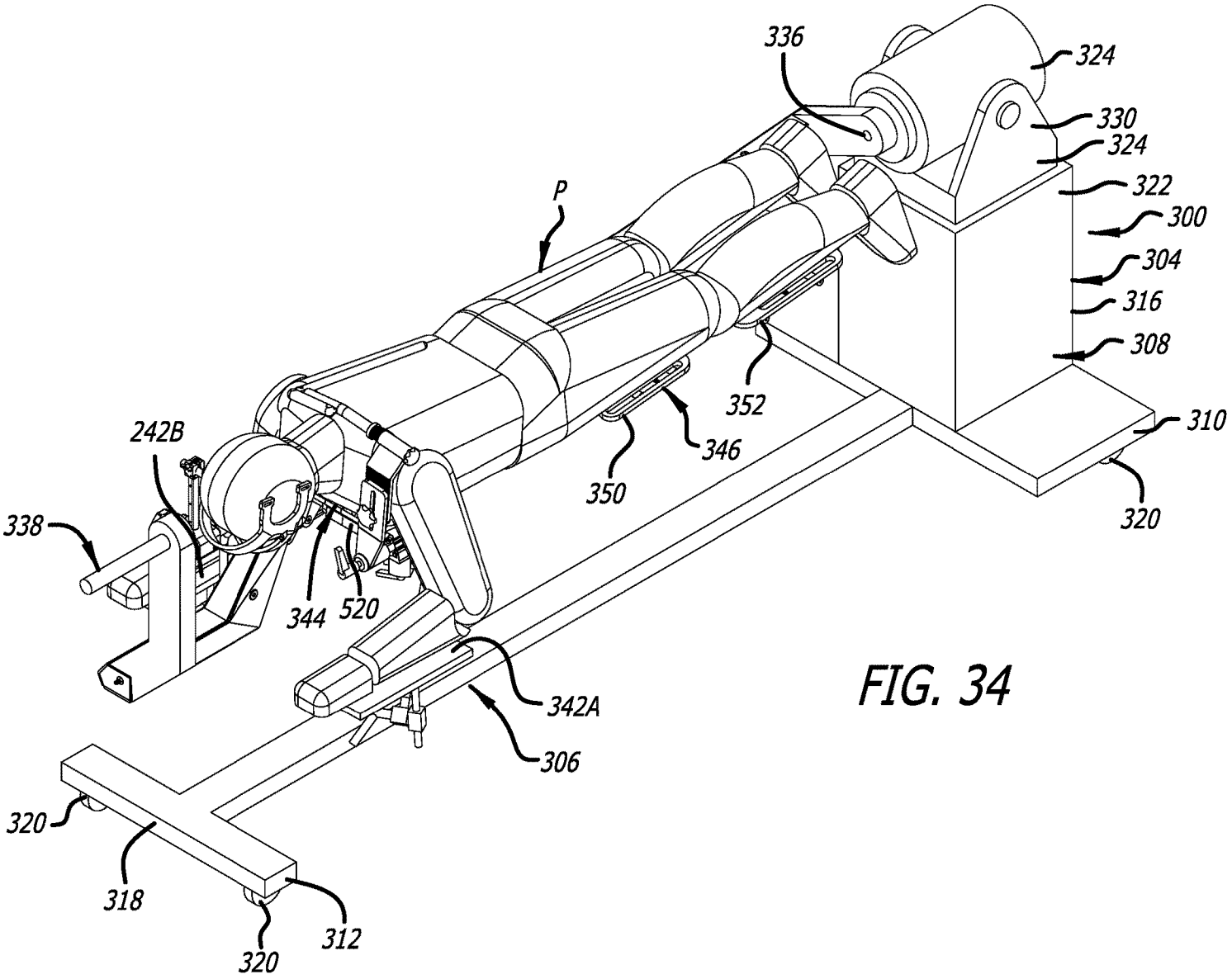
FIG. 34 is another top perspective view of the surgical frame of FIG. 27 and the patient positioned thereon showing the main beam in the first vertical position and the first rotational position.
Figure 35:
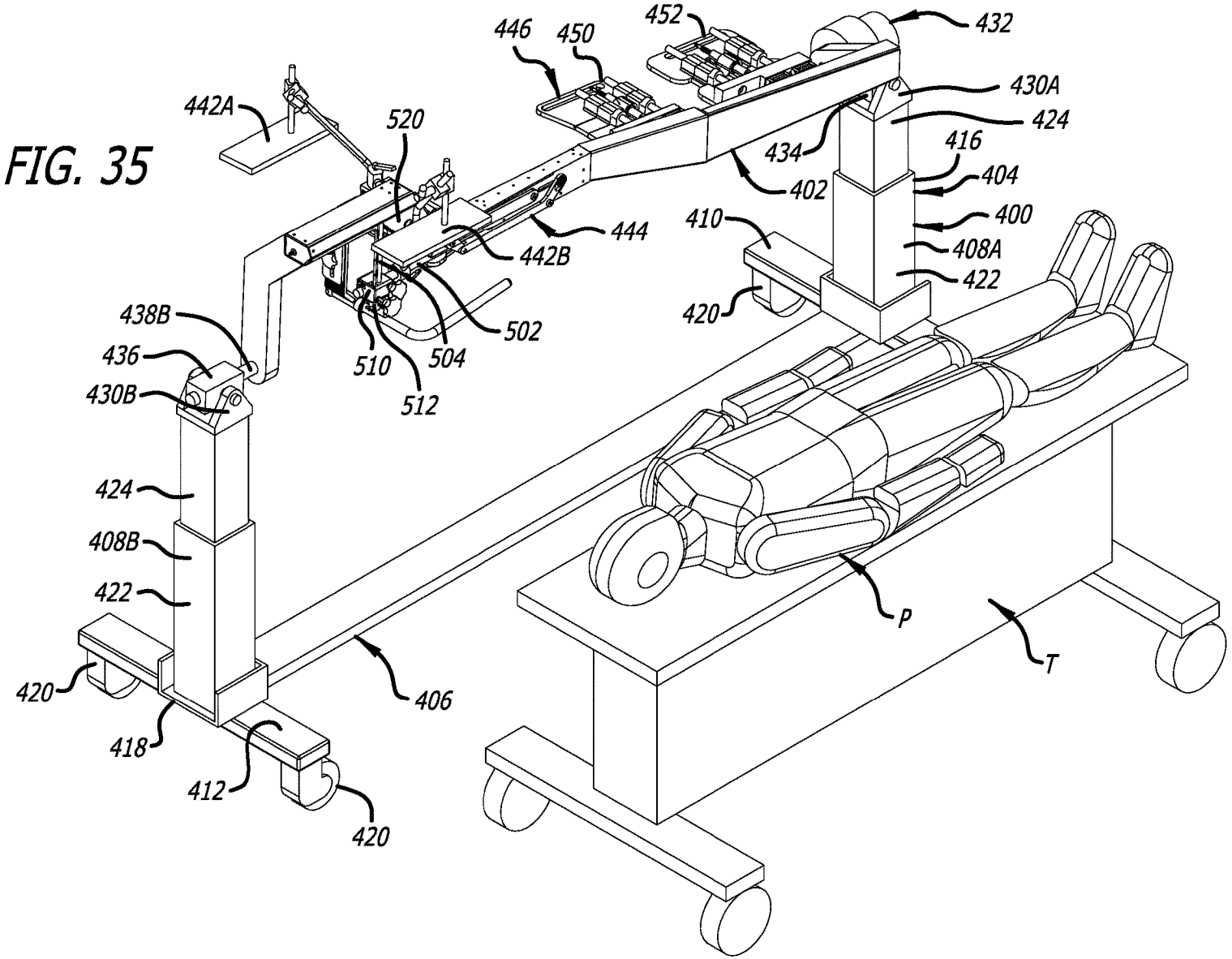
FIG. 35 is a top perspective view of a surgical frame in accordance with another embodiment of the present invention showing a main beam thereof positioned in a first vertical position and a first rotational position, with a surgical table/gurney and a patient laying thereon provided for positioning under the main beam of the surgical frame.
Figure 36:
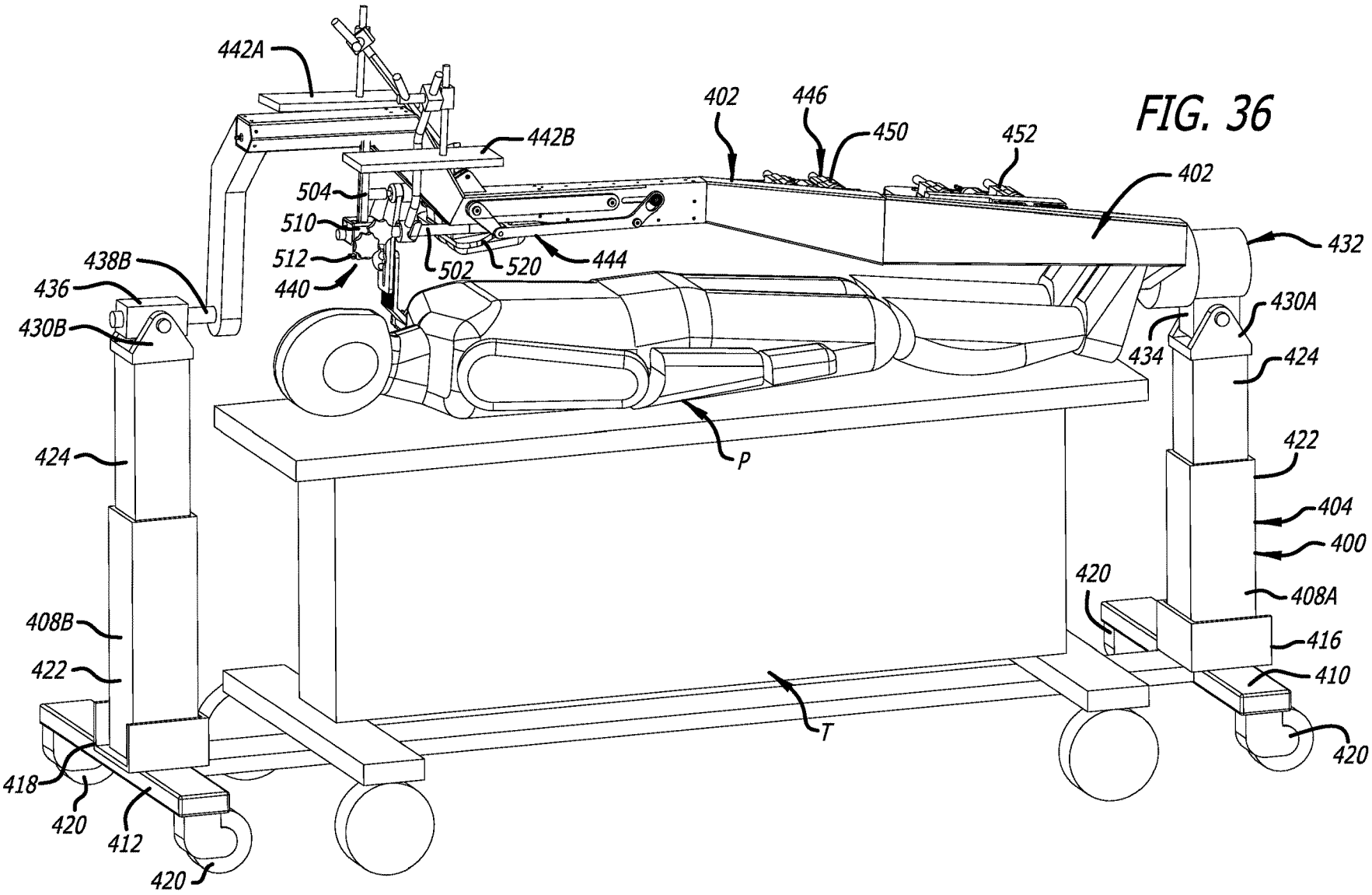
FIG. 36 is an enlarged top perspective view of the surgical frame of FIG. 35 showing the main beam positioned in the first vertical position and the first rotational position, with the surgical table/gurney and the patient laying thereon positioned under the main beam.

More specifically, to facilitate transfer of the patient P from the surgical table/gurney T, the surgical table/gurney T can be first positioned, as depicted in FIGS. 30 and 31, under the main beam 302 of the surgical table 300, or, as depicted in FIG. 36, under the main beam 402 of the surgical table 400. The main beams 302 and 402 can be raised, pivoted/tilted, and/or rotated to allow the surgical table/gurney T to be positioned thereunder. Thereafter, the main beams 302 and 402 can be lowered, pivoted/tilted, and/or rotated to facilitate contact of the surgical frames 300 and 400 with the patient P.

As depicted in FIGS. 30, 31, 35, and 36, the patient P is positioned in the supine position on the surgical table/gurney T. Thereafter, the head support 340 and the head support 440 can be attached to the head of the patient P, the torso-lift support 344 and the torso-lift support 444 can be attached to the torso of the patient P, and the leg support 346 and the leg support 446 can be attached to the legs of the patient P.

The head support 340 and the head support 440 can each include a facial support cradle 500, a first support post 502, a second support post 504, and a third support post 506. The head supports 340 and 440 can be used to adjust the position of the head of the patient P received on the surgical frames 300 and 400. The head supports 340 can 440 can also be used to facilitate attachment of the patient P to the surgical frames 300 and 400.

Figure 37:
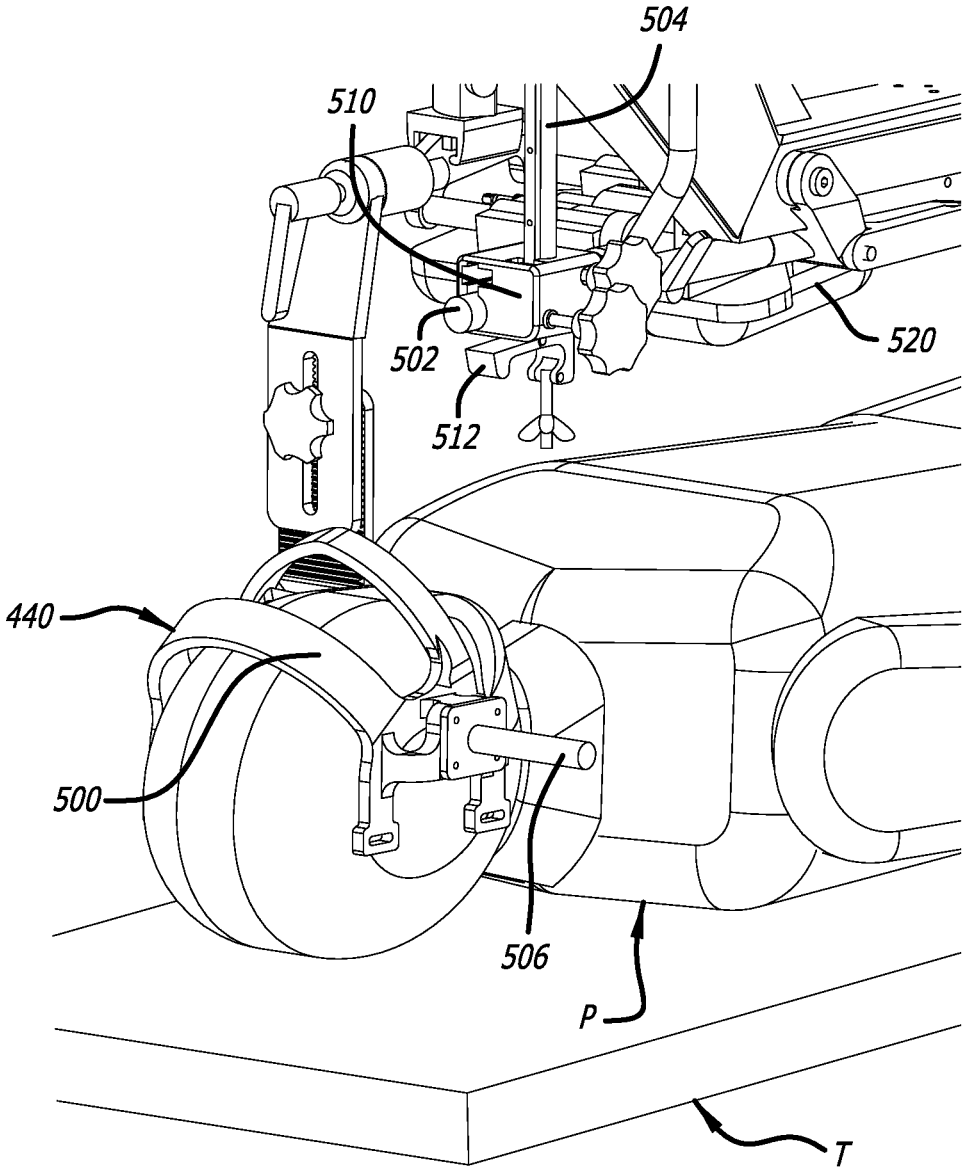
FIG. 37 is an enlarged top perspective view of the surgical table/gurney, the patient laying on the surgical table/gurney, and a head support of the surgical frame, with a first portion of the head support being attached to the head of the patient, and a second portion of the head support being positioned for attachment to the first portion.
Figure 38:
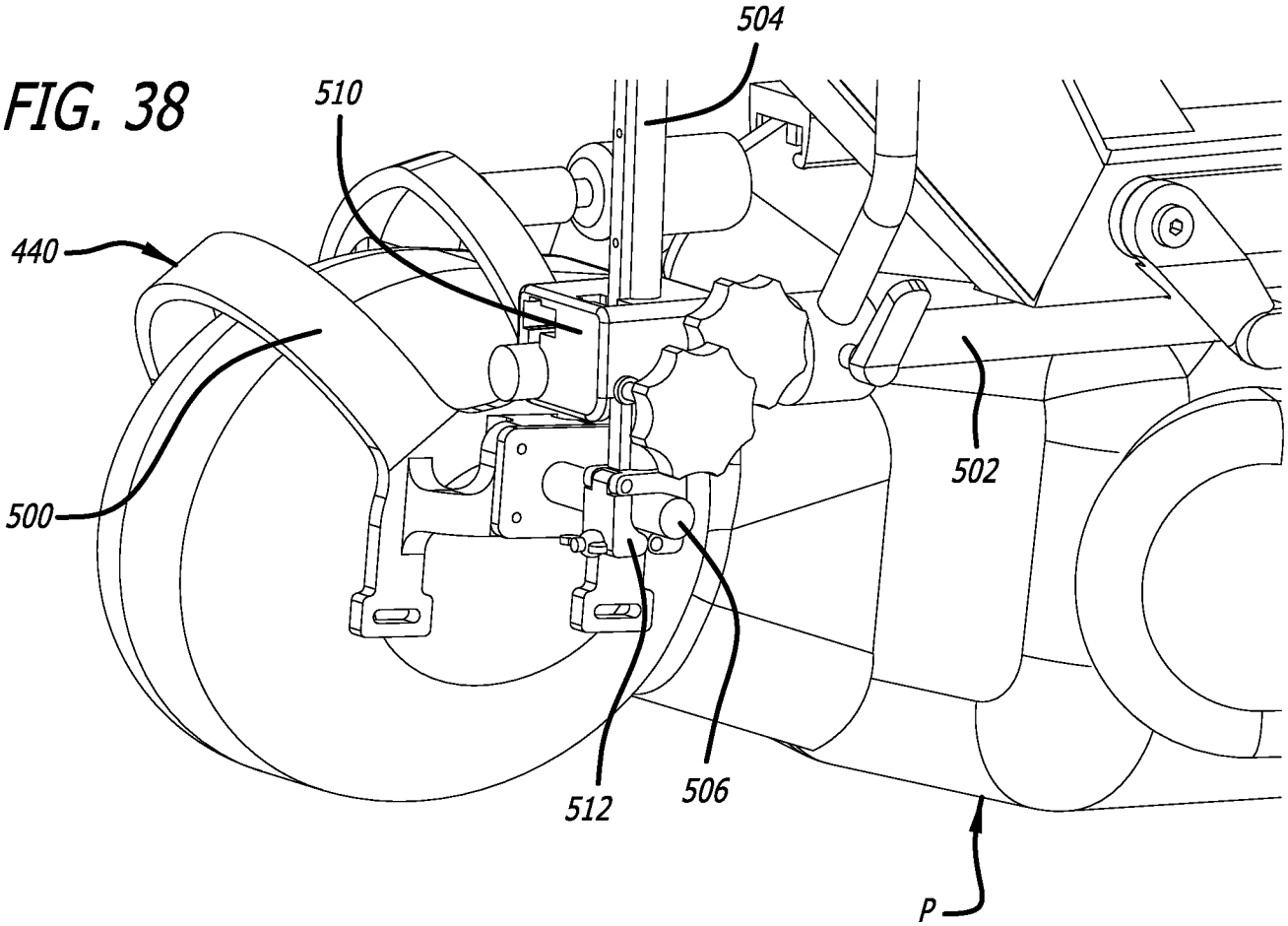
FIG. 38 is an enlarged top perspective view of the head support supporting the head of the patient on the surgical frame.
Figure 39:
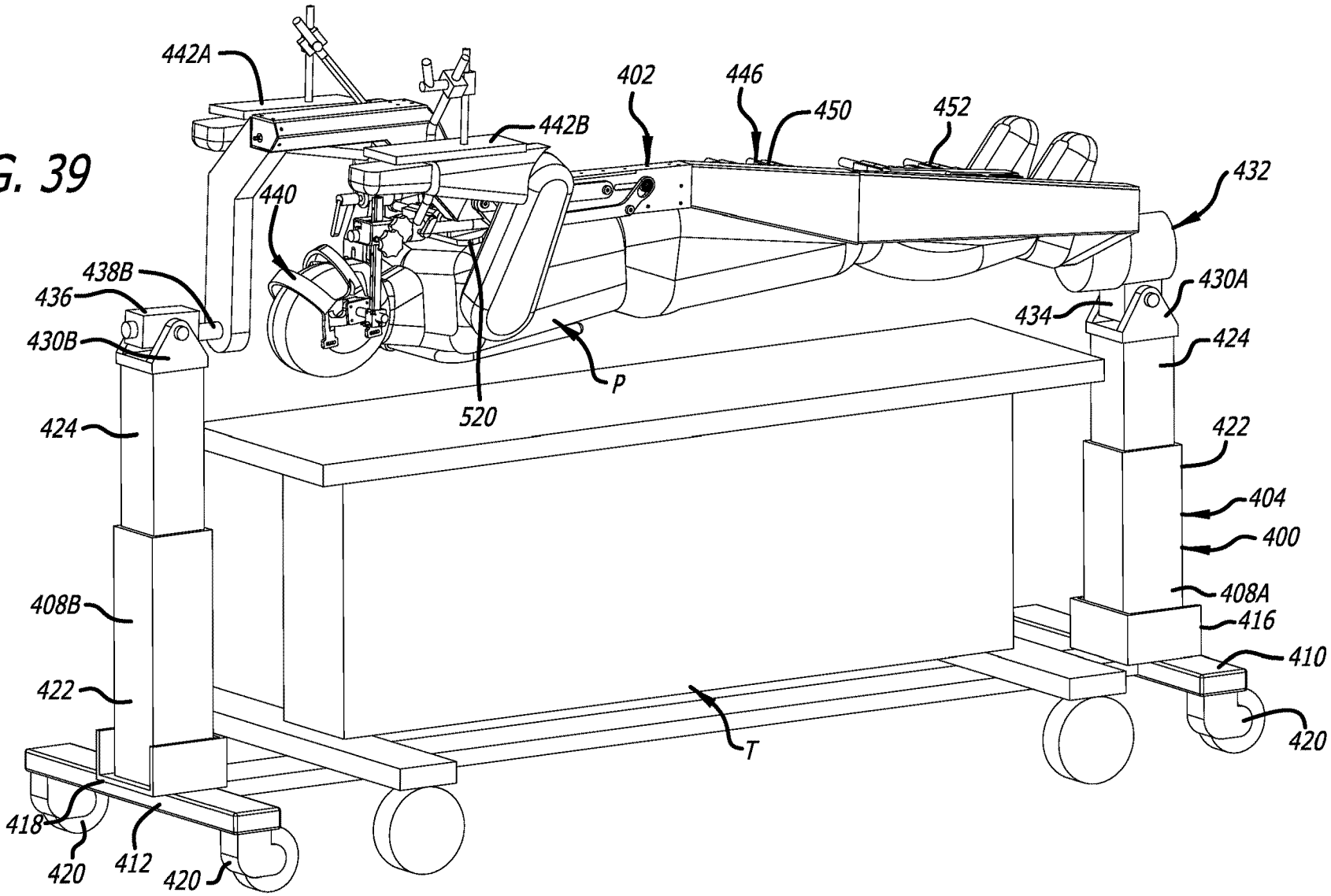
FIG. 39 is an enlarged top perspective view of the surgical frame of FIG. 35 and the patient positioned thereon showing the main beam in the first vertical position and the first rotational position.
Figure 40:
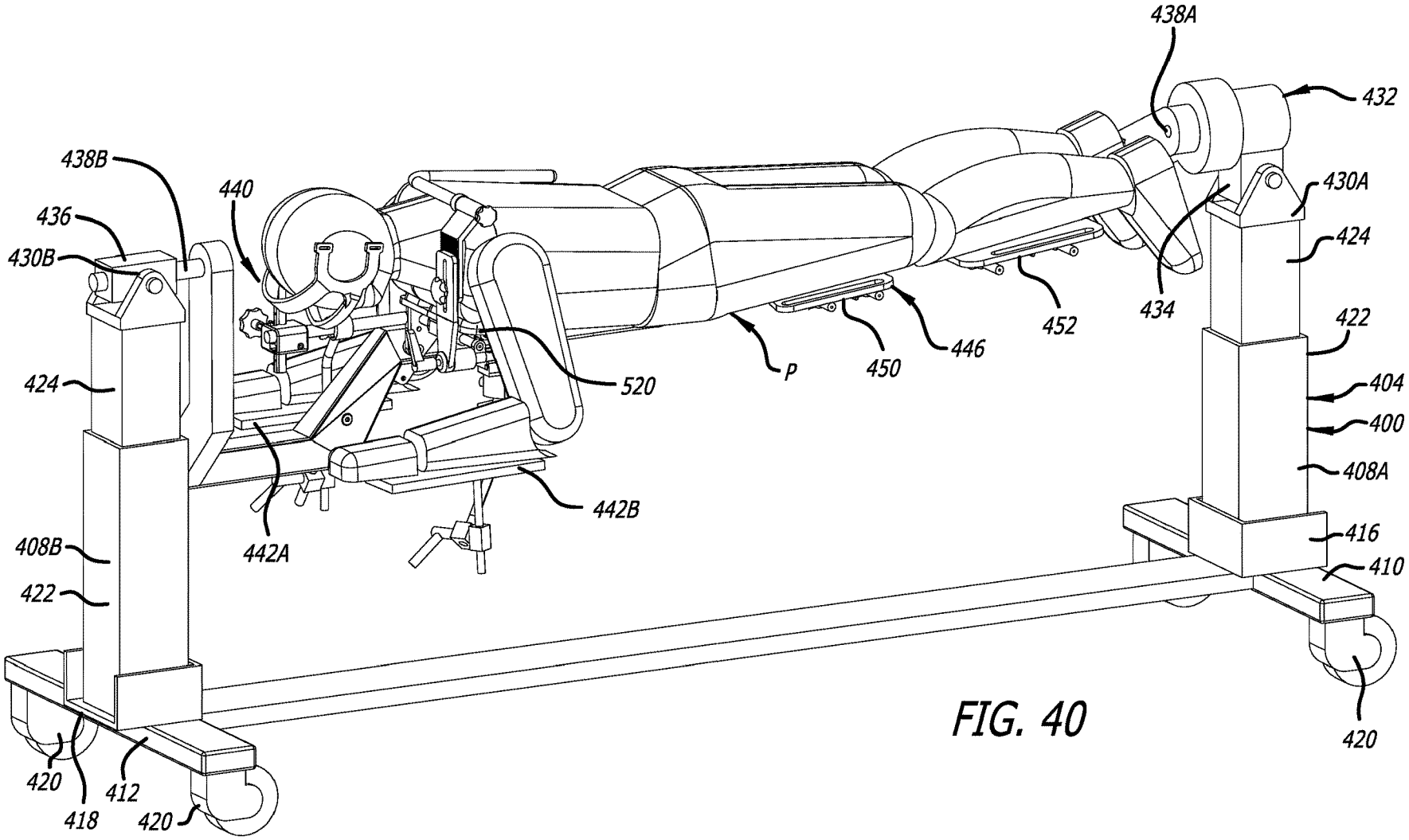
FIG. 40 is an enlarged top perspective view of the surgical frame of FIG. 35 and the patient positioned thereon showing the main beam in the first vertical position and a second rotational position.

To illustrate, as depicted in FIGS. 37 and 38, portions of the head support 440 of the surgical frame 400 can be moved to contact the patient P laying on the surgical table/gurney T. As depicted in FIGS. 37 and 38, the facial support cradle 500 is attached to the head of the patient P, and the first support post 502 of the head support 440 is attached to the main beam 402. The first support post 502 and the second support post 504 are attached to one another by a first collar portion 510. The first collar portion 510 is moveable and fixedly positionable with respect to the first support post 502, and the second support post 504 is moveable and fixedly positionable with respect to the first collar portion 510. A second collar portion 512 is attached to the second support post 504, and the third support post 506 is moveable and fixedly positionable with respect to the second collar portion 512. The third support post 506 can be attached to the face support cradle 500 prior to attachment to the second collar portion 512.

Thus, the facial support cradle 500 can be attached to the head of the patient P laying on the surgical table/gurney T, the third support post 506 can be attached to the facial support cradle 500, and the first support post 502 and the second support post 504 can be adjusted to facilitate attachment of the facial support cradle 500 to the second collar portion 512 via the third support post 506. Thereafter, soft straps (not shown) can be used to secure attachment of the facial support cradle 500 to the patient's head. The description of the surgical frame 400 in this regard is also applicable to the surgical frame 300. Thus, using the head supports 340 and 440, the patient's head can be attached to the main beams 302 and 402. Thereafter, the patient P can be lifted from the surgical table/gurney T using the surgical frames 300 and 400, and the head supports 340 and 440 support the patient's head thereon.

The torso-lift support 344 and the torso-lift support 444 each include a chest support plate 520. The chest support plate 520 of each of the torso-lift supports 344 and 444 are moveable thereby with respect to the main beams 302 and 402, and can be used to adjust the position of the patient's torso when the patient P is supported by the surgical frames 300 and 400. The torso-lift supports 344 and 444 can also be used to facilitate attachment of the patient P to the surgical frames 300 and 400. To illustrate, the chest support plate 520 of each of the torso-lift supports 344 and 444 can be moved to contact the patient P laying on the surgical table/gurney T. Soft straps (not shown) can be used to secure attachment of the chest support plate 520 of each of the torso-lift supports 344 and 444 to the patient's chest. Thus, using the torso-lift supports 344 and 444, the patient's torso can be attached to the main beams 302 and 402. Thereafter, the patient P can be lifted from the surgical table/gurney T using the surgical frames 300 and 400, and the torso-lift supports 344 and 444 support the patient's torso thereon.

The leg support 346 and the leg support 446 each include the upper leg support portions 350 and 450, and the lower leg support portions 352 and 452, respectively. The upper leg support portions 350 and 450, and the lower leg support portions 352 and 452 of the leg supports 346 and 446 are moveable thereby with respect to the main beams 302 and 402, and can be used to adjust the position of the patient's legs when the patient P is supported by the surgical frames 300 and 400. The leg supports 346 and 446 can also be used to facilitate attachment of the patient P to the surgical frames 300 and 400. To illustrate, the upper leg support portions 350 and 450, and the lower leg support portions 352 and 452 can be moved to contact the patient P laying on the surgical table/gurney T. Soft straps (not shown) can be used to secure attachment of the upper leg portions 350 and 450, and the lower leg portions 352 and 452 to the patient's legs. Thus, using the leg supports 346 and 446, the patient's legs can be attached to the main beams 302 and 402. Thereafter, the patient P can be lifted from the surgical table/gurney T using the surgical frames 300 and 400, and the leg supports 346 and 446 support the patient's legs thereon.

In view of the configurations of the surgical frames 300 and 400 and as discussed above, the patient P can be lifted from the surgical table/gurney T, and the surgical table/gurney T can be removed from under the main beams 302 and 402. Thereafter, the patient's body can be manipulated using the surgical frames 300 and 400. As discussed above, the patient's body can be raised and lowered, pivoted or tilted, and rotated via manipulation of the main beams 302 and 402. Furthermore, as discussed above, the position of the patient's head can be adjusted using the head supports 340 and 440, the position of the patient's torso can be adjusted using the torso-lift supports 344 and 444, and the position of the patient's legs can be adjusted using the leg supports 346 and 446.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A method of transferring a patient from a surgical table/gurney using a surgical frame, the method comprising:
- positioning the surgical table/gurney with the patient positioned thereon in a patient receiving area at least partially under a main beam of the surgical frame;
- positioning at least a portion of the main beam adjacent the patient;
- attaching portions of the patient to the main beam;
- lifting the patient from the surgical table/gurney using the surgical frame; and
- at least one of raising, lowering, pivoting, or tilting, and rotating the main beam and the patient attached thereto to position the patient for surgery.

2. The method of claim 1, further comprising laying the patient on the surgical table/gurney in a supine position, and rotating the patient between the supine position and a prone position using the surgical frame.

3. The method of claim 1, wherein attaching portions of the patient to the main beam includes attaching, while the patient is laying on the surgical table/gurney, at least one of the head of the patient to a head support, the chest of the patient to a torso-lift support, and the legs of the patient to a leg support.

4. The method of claim 3, further comprising at least one of adjusting a position of the head of the patient using the head support, adjusting a position of the chest of the patient using the torso-lift support, and adjusting a position of the legs of the patient using the leg support.

5. The method of claim 1, wherein the main beam is interconnected with a support structure, and the raising of the main beam includes increasing the height of at least portions of the support structure, and the lowering of the main beam includes decreasing the height of at least portions of the support structure.

6. The method of claim 1, wherein the main beam is interconnected with a pivoter, and the pivoting of the main beam includes pivoting the main beam using the pivoter in at least one of an upward direction and a downward direction.

7. The method of claim 1, wherein the main beam is interconnected with a first support structure and a second support structure, and the tilting of the main beam includes at least one of increasing the height of one of the first and second support structures, and decreasing the height of the other of the first and second support structures.

8. The method of claim 7, wherein the patient receiving area is between the first support structure and the second support structure.

9. The method of claim 1, wherein the main beam is interconnected with a rotator, and the rotating of the main beam includes rotating the main beam using the rotator in at least one of a clockwise direction and a counter-clockwise direction.

10. A method of transferring a patient from a surgical table/gurney using a surgical frame, the method comprising:

positioning the surgical table/gurney with the patient positioned thereon in a patient receiving area between a first support structure and a second support structure supporting a main beam of the surgical frame;

positioning at least a portion of the main beam adjacent the patient;

attaching portions of the patient to the main beam;

lifting the patient from the surgical table/gurney by raising the main beam of the surgical frame;

removing the surgical table/gurney from the patient receiving area; and at least one of raising, lowering, pivoting, or tilting, and rotating the main beam and the patient attached thereto to position the patient for surgery.

11. The method of claim 10, further comprising:

positioning the surgical table/gurney in the patient receiving area;

lowering the patient onto the surgical table/gurney by lowering the main beam of the surgical frame after completion of surgery; and removing the surgical table/gurney and the patient positioned thereon from the patient receiving area.

12. The method of claim 10, further comprising laying the patient on the surgical table/gurney in a supine position, and rotating the patient between the supine position and a prone position using the surgical frame.

13. The method of claim 10, wherein attaching portions of the patient to the main beam includes attaching, while the patient is laying on the surgical table/gurney, at least one of the head of the patient to a head support, the chest of the patient to a torso-lift support, and the legs of the patient to a leg support.

14. The method of claim 13, further comprising at least one of adjusting a position of the head of the patient using the head support, adjusting a position of the chest of the patient using the torso-lift support, and adjusting a position of the legs of the patient using the leg support.

15. The method of claim 10, wherein the raising of the main beam includes increasing the height of the first support structure and the second support structure, and the lowering of the main beam includes decreasing the height of the first support structure and the second support structure.

16. The method of claim 10, wherein the tilting of the main beam includes increasing the height of at least one of the first support structure and second support structure, and decreasing the height of the at least one of the first support structure and second support structure.

17. The method of claim 10, wherein the main beam is interconnected with a rotator, and the rotating of the main beam includes rotating the main beam using the rotator in at least one of a clockwise direction and a counter-clockwise direction.

18. The method of claim 10, wherein the patient receiving area is at least partially under the main beam of the surgical frame.

19. A method of transferring a patient from a surgical table/gurney using a surgical frame, the method comprising:

positioning the surgical table/gurney with the patient positioned thereon in a patient receiving area defined by the surgical frame;

positioning at least a portion of a main beam of the surgical frame adjacent the patient;

attaching portions of the patient to the main beam;

lifting the patient from the surgical table/gurney by raising the main beam of the surgical frame;

removing the surgical table/gurney from the patient receiving area;

at least one of raising, lowering, pivoting, or tilting, and rotating the main beam and the patient attached thereto to position the patient for surgery;

performing surgery on the patient;

positioning the surgical table/gurney in the patient receiving area after completion of the surgery;

lowering the patient onto the surgical table/gurney by lowering the main beam of the surgical frame after completion of surgery; and removing the surgical table/gurney with the patient positioned thereon from the patient receiving area after completion of the surgery.

20. The method of claim 19, wherein the patient is laid on the surgical table/gurney in a supine position, and the patient can be rotated between the supine position and a prone position using the surgical frame.

* * * * *